US008679267B2

(12) United States Patent
Branagan et al.

(10) Patent No.: US 8,679,267 B2
(45) **Date of Patent: *Mar. 25, 2014**

(54) DUCTILE METALLIC GLASSES IN RIBBON FORM

(75) Inventors: Daniel James Branagan, Idaho Falls, ID (US); Brian E. Meacham, Idaho Falls, ID (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 23 days.

This patent is subject to a terminal disclaimer.

(21) Appl. No.: 13/532,313

(22) Filed: Jun. 25, 2012

(65) Prior Publication Data

US 2012/0263621 A1 Oct. 18, 2012

Related U.S. Application Data

(62) Division of application No. 12/547,367, filed on Aug. 25, 2009, now Pat. No. 8,206,520.

(60) Provisional application No. 61/091,558, filed on Aug. 25, 2008.

(51) Int. Cl.
*C22C 45/02* (2006.01)
*C22C 38/08* (2006.01)

(52) U.S. Cl.
USPC ..... 148/403; 148/561; 420/95; 420/98; 420/121

(58) Field of Classification Search
USPC ..... 148/561, 403; 420/95, 98, 121
See application file for complete search history.

(56) References Cited

U.S. PATENT DOCUMENTS

| | | | | |
|---|---|---|---|---|
| 4,144,058 | A | 3/1979 | Chen et al. | |
| 6,077,367 | A | 6/2000 | Mizushima et al. | |
| 8,317,949 | B2 * | 11/2012 | Branagan et al. | 148/561 |
| 2005/0263216 | A1 | 12/2005 | Chin et al. | |
| 2008/0053274 | A1 | 3/2008 | Branagan et al. | |

FOREIGN PATENT DOCUMENTS

| | | |
|---|---|---|
| WO | 2010005745 | 1/2010 |
| WO | 2010048060 | 4/2010 |

OTHER PUBLICATIONS

Valiev, "Institute of Physics of Advanced Materials," Nature Materials vol. 3, Aug. 2004 (p. 511-516).
ASTM E 2456-06, Standard Terminology Relating to Nanotechnology, 2007.
Gleiter, "Nanocrystalline Materials," Prog. Mater. Sci. 33 (1989), 223-315.

(Continued)

*Primary Examiner* — Deborah Yee
(74) *Attorney, Agent, or Firm* — Grossman, Tucker, Perreault & Pfleger, PLLC

(57) ABSTRACT

The present disclosure relates to an iron based alloy composition that may include iron present in the range of 45 to 70 atomic percent, nickel present in the range of 10 to 30 atomic percent, cobalt present in the range of 0 to 15 atomic percent, boron present in the range of 7 to 25 atomic percent, carbon present in the range of 0 to 6 atomic percent, and silicon present in the range of 0 to 2 atomic percent, wherein the alloy composition exhibits an elastic strain of greater than 0.5% and a tensile strength of greater than 1 GPa.

12 Claims, 82 Drawing Sheets

(56) References Cited

OTHER PUBLICATIONS

Dao, "Toward a quantitative understanding of mechanical behavior of nanocrystalline metals," Acta Materialia 55 (2007), 4041-4065.
Klement, "Non-crystalline Structure in Solidified Gold-Silicon Alloys," Nature 187 (1960), 869-870.
Johnson, "Bulk Glass-Forming Metallic Alloys: Science and Technology," MRS Bull. 24 (1999), 42-56.
Inoue, "Stabilization of Metallic Supercooled Liquid and Bulk Amorphous Alloys," Acta mater. 48 (2000) 279-306.
Greer, "Bulk Metallic Glasses: At the Cutting Edge of Metals Research," MRS Bulletin 32 (2007), 611.
Jia, "Effects of Nanocrystalline and Ultrafine Grain Sizes on Constitutive Behavior and Shear Bands in Iron," Acta Mater. 51 (2003), 3495-3509.
Flores, "Mean Stress Effects on Flow Localization and Failure in a Bulk Metallic Glass," Acta mater. 49 (2001) 2527-2537.
Zhao,"Simultaneously Increasing the Ductility and Strength of Nanostructured Alloys," Adv. Mater. 18 (2006), 2280 2283.
Steif, "Strain Localization in Amorphous Metals," Acta Metall. 30 (1982), 447-455.
Zhang, "Modulated oscillatory hardening and dynamic recrystallization in cryomilled nanocrystalline Zn," Acta Mater. 50 (2002), 3995-4004.
Chen, Deformation-induced nanocrystal formation in shear bands of amorphous alloys Nature 367 (1994), 541-543.
Hays, "Microstructure Controlled Shear Band Pattern Formation and Enhanced Plasticity of Bulk Metallic Glasses Containing in situ Formed Ductile Phase Dendrite Dispersions," Phys. Rev. Lett. 84 (2000), 2901-2904.
Yim, "Bulk metallic glass matrix composites," Appl. Phys. Lett. 71 (1997), 3808-3810.
Szuecs, "Mechanical Properties of Zr56.2 Ti13.8 Nb5.0 Cu6.9 Ni5.6 Be12.5 Ductile Phase Reinforced Bulk Metallic Glass Composite," Acta Mater. 49 (2001) 1507-1513.
Yavari, "FeNiB-based metallic glasses with fcc crystallisation products," Journal of Non-Crystalline Solids 304 (2002) 44-50.
Fan,"Metallic glass matrix composite with precipitated ductile reinforcement," Appl. Phys. Lett. 81 (2002) 1020-1022.
Wang et al., "High tensile ductility in a Nanostructured Metal," Letters to Nature vol. 419, Oct. 31, 2002 (p. 912-915).
Lee, "Effect of a controlled volume fraction of dendritic phases on tensile and compressive ductility in La-based metallic glass matrix composites," Acta Materialia 52 (2004) 4121-4131.
Wada, "Enhancement of room-temperature plasticity in a bulk metallic glass by finely dispersed porosity," Applied Physics Letters 86, 251907 (2005).
Saida, "Nanoscale multistep shear band formation by deformation~induced nanocrystallization in Zr—Al—Ni—Pd bulk metallic glass," Applied Physics Letters 87, 151907 (2005).
Lee et al., "Crystallization-induced plasticity of Cu—Zr containing bulk amorphous alloys," Acta Materialia 54 (2006) 349-355.
Fan, "Ductility of bulk nanocrystalline composites and metallic glasses at room temperature," Appl. Phys. Lett. 77 (2000) 46-48.
Kim, "Role of nanometer-scale quasicrystals in improving the mechanical behavior of Ti-based bulk metallic glasses," Appl. Phys. Lett. 83 (2003) 3093-3095.
Das, "'Work-Hardenable' Ductile Bulk Metallic Glass," Phys. Rev. Lett. 94 (2005) 205501 (4 Pages).
Lu et al., "Ultrahigh strength and high electrical conductivity in copper," Science, vol. 304, Apr. 16, 2004 (p. 422-426).
Kim, "Heterogeneity of a CU47.5Zr47.5Al5 bulk metallic glass" Applied Physics Letters 88, 051911 (2006) (3 Pages).
Yao, "Superductile bulk metallic glass," Applied Physics Letters 88, 122106 (2006) (3 Pages).
Kim, "Work hardening ability of ductile Ti45Cu40Ni7.5Zr5Sn2.5 and CU47.5Zr47.5Al5 bulk metallic glasses," Applied Physics Letters 89, 071908 (2006) (3 Pages).
Chen et al., "Extraordinary Plasticity of Ductile Bulk Metallic Glasses," PRL 96, 245502 (2006).
Chen, "Free-volume-induced enhancement of plasticity in a monolithic bulk metallic glass at room temperature," Scripta Materialia 59 (2008) 75-78.
Hofmann, "Designing metallic glass matrix composites with high toughness and tensile ductility," Nature 451 (2008) 1085 (6 Pages).
Schroers, et al., "Ductile Bulk Metallic Glass," PRL 93, 255506 (2004) (4 Pages).
Flores, "Local heating associated with crack tip plasticity in Zr—Ti—Ni—Cu—Be bulk amorphous metals," J. Mater. Res., vol. 14, No. 3, Mar. 1999, p. 638-643.
Liu, et al., "Super Plastic Bulk Metallic Glasses at Room Temperature," Science vol. 315, Mar. 9, 2007, pp. 1385-1388.
International Search Report and Written Opinion dated Nov. 13, 2009 issued in related International Patent Application No. PCT/US09/54942.
Extended European Search Report dated Dec. 16, 2011 issued in related European Patent Application No. 09812023.1-2122.
Xing, "Enhanced plastic strain in Zr-based bulk amorphous alloys," AMerican Physical Society, Physical Review B, vol. 64, 180201(R) (2001).
Kato et al., "Synthesis and Mechanical Properties of Bulk Amorphous Zr—Al—Ni—Cu Alloys Containing ZrC Particles," Material Translations Online vol. 38 No. 09 (1997) 1 Page.

* cited by examiner

DUCTILE METALLIC GLASSES IN RIBBON FORM

CROSS-REFERENCE TO RELATED APPLICATIONS

This application is a divisional application of U.S. application Ser. No. 12/547,367, filed Aug. 25, 2009, now U.S. Pat. No. 8,206,520 which claims the benefit of U.S. Provisional Patent Application Ser. No. 61/091,558, filed on Aug. 25, 2008, which is fully incorporated herein by reference.

FIELD OF INVENTION

The present disclosure relates to chemistries of matter which may result in amorphous or amorphous/nanocrystalline structures which may yield relatively high strength and relatively high plastic elongation.

INTRODUCTION

Metallic nanocrystalline materials and metallic glasses may be considered classes of materials known to exhibit relatively high hardness and strength characteristics. Due to their perceived potential, they may be considered candidates for structural applications. However, these classes of materials may also exhibit relatively limited fracture toughness associated with the relatively rapid propagation of shear bands and/or cracks which may be a concern for the technological utilization of these materials. While these materials may show adequate ductility by testing in compression, when testing in tension these materials may exhibit elongations that may be close to zero and in the brittle regime. The inherent inability of these classes of material to be able to deform in tension at room temperature may be a limiting factor for potential structural applications where intrinsic ductility may be needed to potentially avoid catastrophic failure.

Nanocrystalline materials may be understood to include, by definition, polycrystalline structures with a mean grain size below 100 nm. They have been the subject of widespread research since the mid-1980s when Gleiter made the argument that metals and alloys, if made nanocrystalline, may exhibit a number of appealing mechanical characteristics of potential significance for structural applications. But despite relatively attractive properties (high hardness, yield stress and fracture strength), it is well known that nanocrystalline materials may generally show a disappointing and relatively low tensile elongation and may tend to fail in an extremely brittle manner. In fact, the decrease of ductility for decreasing grain sizes has been known for a long time as attested, for instance, by the empirical correlation between the work hardening exponent and the grain size proposed by Morrison for cold rolled and conventionally recrystallized mild steels. As the grain size is progressively decreased, the formation of dislocation pile-ups may become more difficult limiting the capacity for strain hardening, leading to mechanical instability and cracking under loading.

Many researchers have attempted to improve the ductility of nanocrystalline materials while minimizing loss of high strength by adjusting the microstructure. Valiev, et al., proposed that an increased content of high-angle grain boundaries in nanocrystalline materials could be beneficial to an increase in ductility. In a search to improve ductility of nanocrystalline materials, relatively ductile base metals have generally been used such as copper, aluminum or zinc with some limited success. For example, Wang, et al., fabricated nanocrystalline Cu with a bimodal grain size distribution (100 nm and 1.7 μm) based on the thermomechanical treatment of severe plastic deformation. The resulting highly stressed microstructure which was only partially nanoscale was found to exhibit a 65% total elongation to failure while retaining a relative high strength. Recently, Lu, et al., produced a nanocrystalline copper coating with nanometer sized twins embedded in submicrometer grained matrix by pulsed electrodepositon. The relatively good ductility and high strength was attributed to the interaction of glide dislocations with twin boundaries. In another recent approach, nanocrystalline second-phase particles of 4-10 nm were incorporated into the nanocrystalline Al matrix (about 100 nm). The nanocrystalline particles were found to interact with the slipping dislocation and enhanced the strain hardening rate which leads to the evident improvement of ductility. Using these approaches, enhanced tensile ductility has been achieved in a number of nanocrystalline materials such as 15% in pure Cu with mean grain size of 23 nm or 30% in pure Zn with mean grain size of 59 nm. However, it should be noted that the tensile strength of these nanocrystalline materials did not exceed 1 GPa. For nanocrystalline materials, such as iron based materials with higher tensile strength, the achievement of adequate ductility (>2% elongation) appears to still be a challenge.

Amorphous metallic alloys (i.e. metallic glasses) represent a relatively young class of materials, having been first reported in 1960 when Klement, et al., performed rapid-quenched experiments on Au—Si alloys. Since that time, there has been remarkable progress in exploring alloys compositions for glass formers, seeking elemental combinations with ever-lower critical cooling rates for the retention of an amorphous structure. Due to the absence of long-range order, metallic glasses may exhibit what is believed to be somewhat atypical properties, such as relatively high strength, high hardness, large elastic limit, good soft magnetic properties and high corrosion resistance. However, owing to strain softening and/or thermal softening, plastic deformation of metallic glasses may be localized into shear bands, resulting in a relatively limited plastic strain (less than 2%) and catastrophic failure at room temperature. Different approaches have been applied to enhanced ductility of metallic glasses including: introducing heterogeneities such as micrometer-sized crystallinities, or a distribution of porosities, forming nanometer-sized crystallinities, glassy phase separation, or by introducing free volume in amorphous structure. The heterogeneous structure of these composites may act as an initi–
*/+3 ation site for the formation of shear bands and/or a barrier to the relatively rapid propagation of shear bands, which may result in enhancement of global plasticity, but sometimes a decrease in the strength. Recently, a number of metallic glasses have been fabricated in which the plasticity was attributed to stress-induced nanocrystallization or a relatively high Poisson ratio. It should be noted, that despite that metallic glasses have somewhat enhanced plasticity during compression tests (12-15%); the tensile elongation of metallic glasses does not exceed 2%. Very recent results on improvement of tensile ductility of metallic glasses was published in Nature, wherein 13% tensile elongation was achieved in a zirconium based alloys with large dendrites (20-50 μm in size) embedded in glassy matrix. It should be noted that this material is considered to be primarily crystalline and might be considered as a microcrystalline alloy with residual amorphous phase along dendrite boundaries. The maximum strength of these alloys as reported is 1.5 GPa. Thus, while metallic glasses are known to exhibit favorable characteristics of relatively high strength and high elastic limit, their ability to deform in tension may be limited which may somewhat severely limit the industrial utilization of this class of materials.

SUMMARY

In one aspect, the present disclosure relates to an iron based alloy composition. The iron based alloy may include iron present in the range of 45 to 70 atomic percent, nickel present in the range of 10 to 30 atomic percent, cobalt present in the range of 0 to 15 atomic percent, boron present in the range of 7 to 25 atomic percent, carbon present in the range of 0 to 6 atomic percent; and silicon present in the range of 0 to 2 atomic percent, wherein the alloy exhibits an elastic strain of greater than 0.5% and a tensile strength of greater than 1 GPa.

In another aspect, the present disclosure relates to a method of forming an alloy including melting one or more feedstocks to form an alloy and forming ribbon from the alloy. The alloy may include iron present in the range of 45 to 70 atomic percent, nickel present in the range of 10 to 30 atomic percent, cobalt present in the range of 0 to 15 atomic percent, boron present in the range of 7 to 25 atomic percent, carbon present in the range of 0 to 6 atomic percent; and silicon present in the range of 0 to 2 atomic percent. Furthermore, the ribbon may exhibit an elastic strain of greater than 0.5% and a tensile strength of greater than 1 GPa.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

Figure 1A:
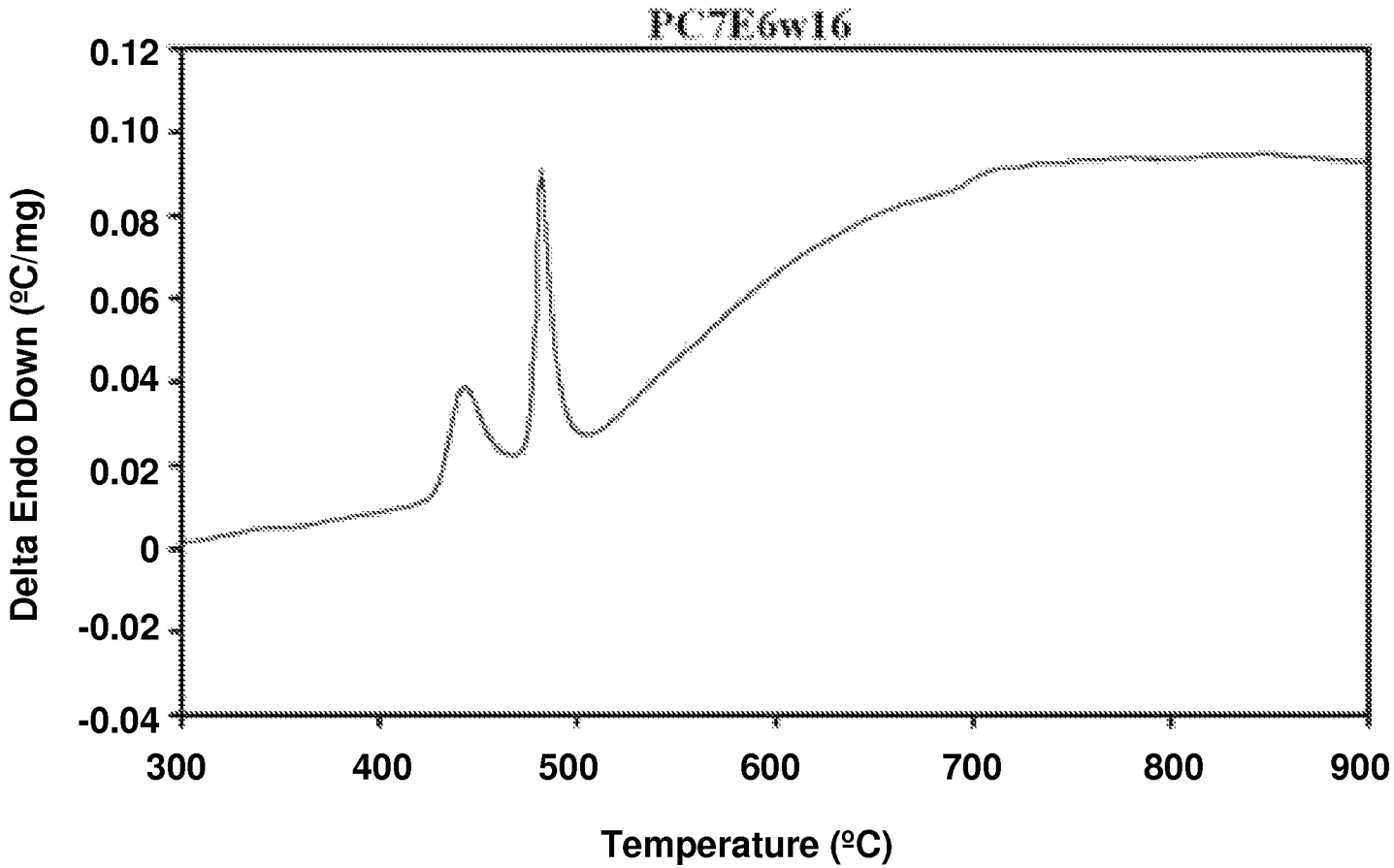
FIGS. 1*a* through 1*f* illustrate examples of DTA curves of the PC7E6 series alloys showing the presence of glass to crystalline transformation peak(s) and/or melting peak(s); a) PC7E6 melt-spun at 16 m/s, b) PC7E6JC melt-spun at 16 m/s, c) PC7E6JB melt-spun at 16 m/s, d) PC7E6JA melt-spun at 16 m/s, e) PC7E6J1 melt-spun at 16 m/s, and f) PC7E6J3 melt-spun at 16 m/s.
Figure 1B:
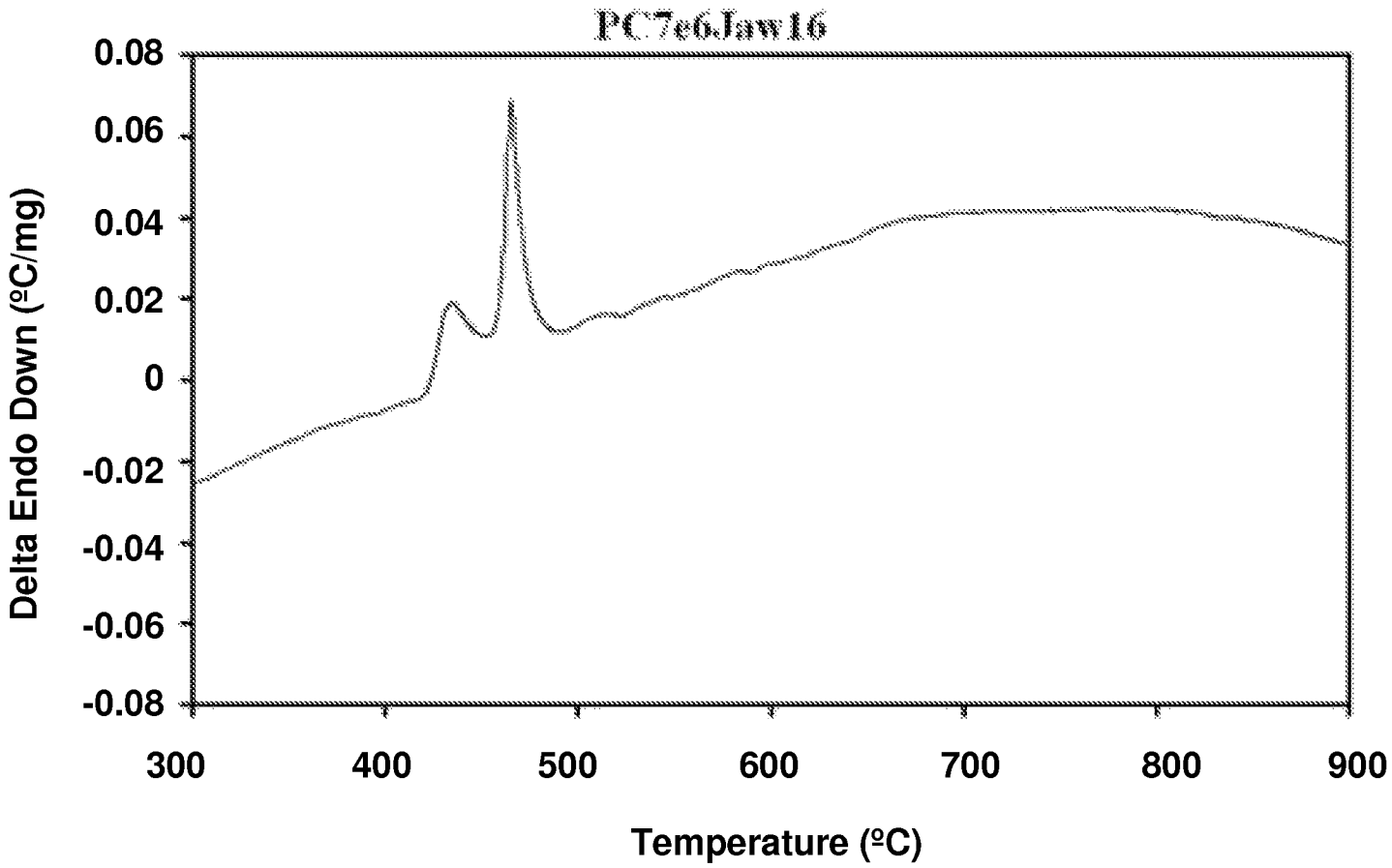
Figure 1C:
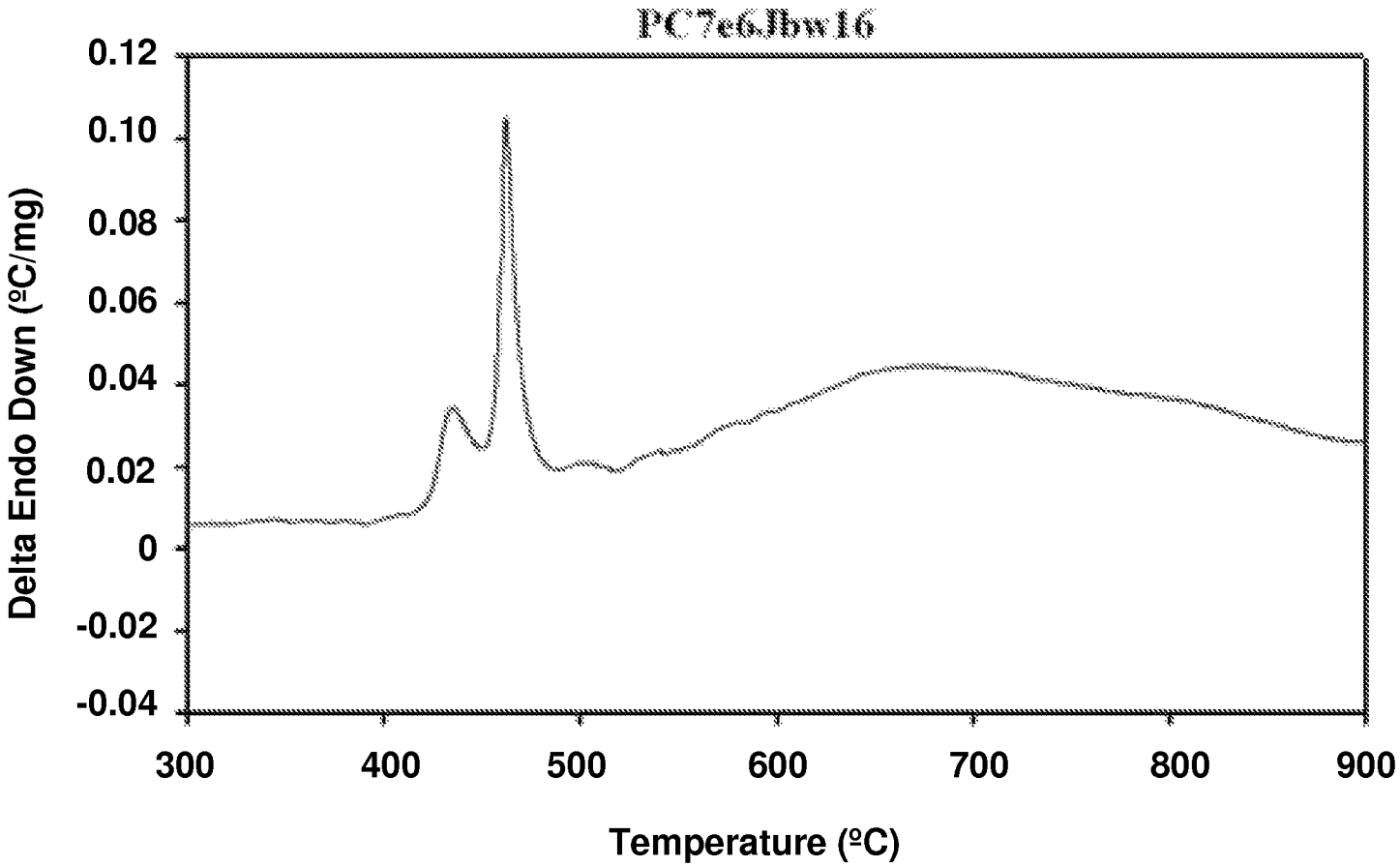
Figure 1D:
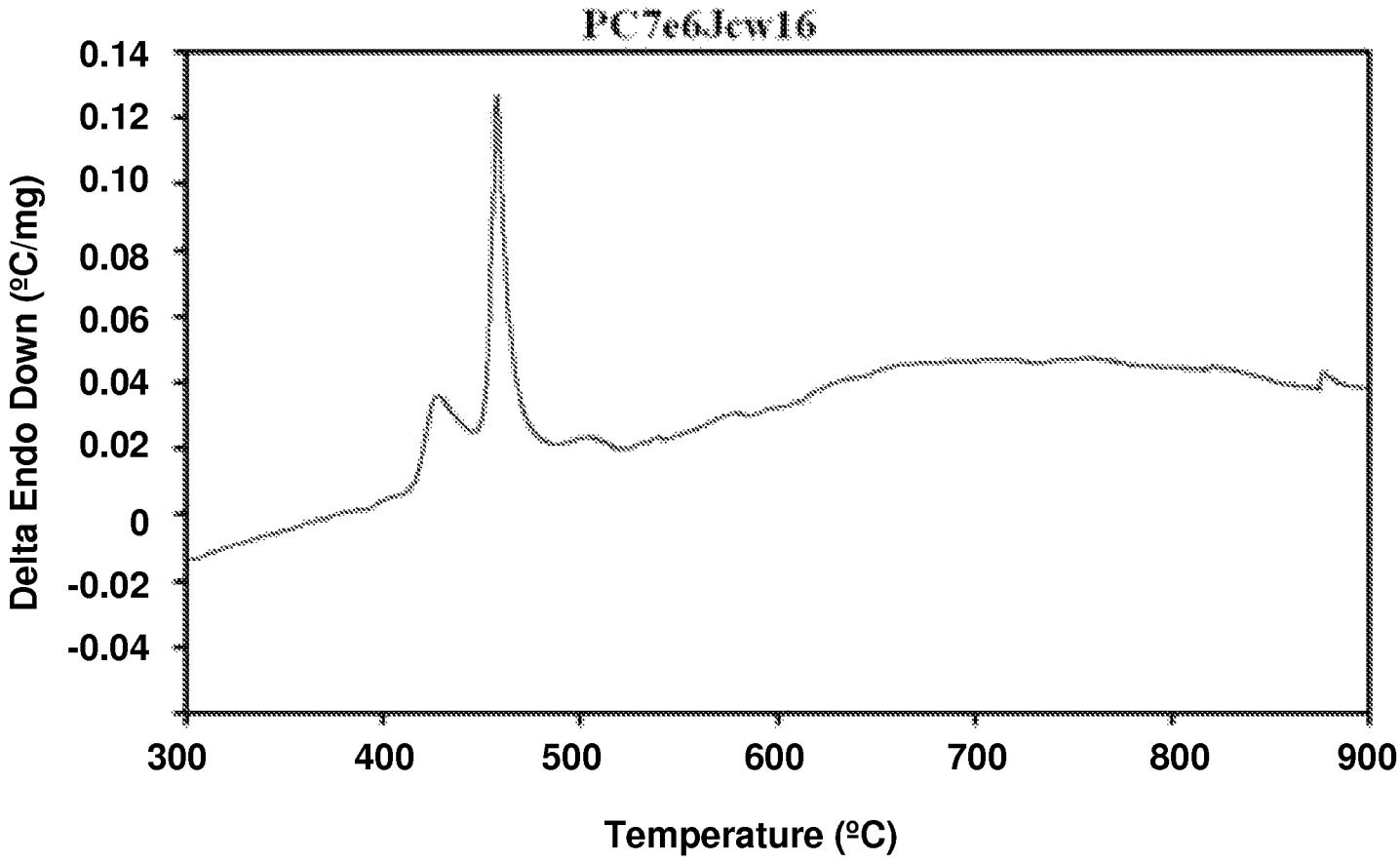
Figure 1E:
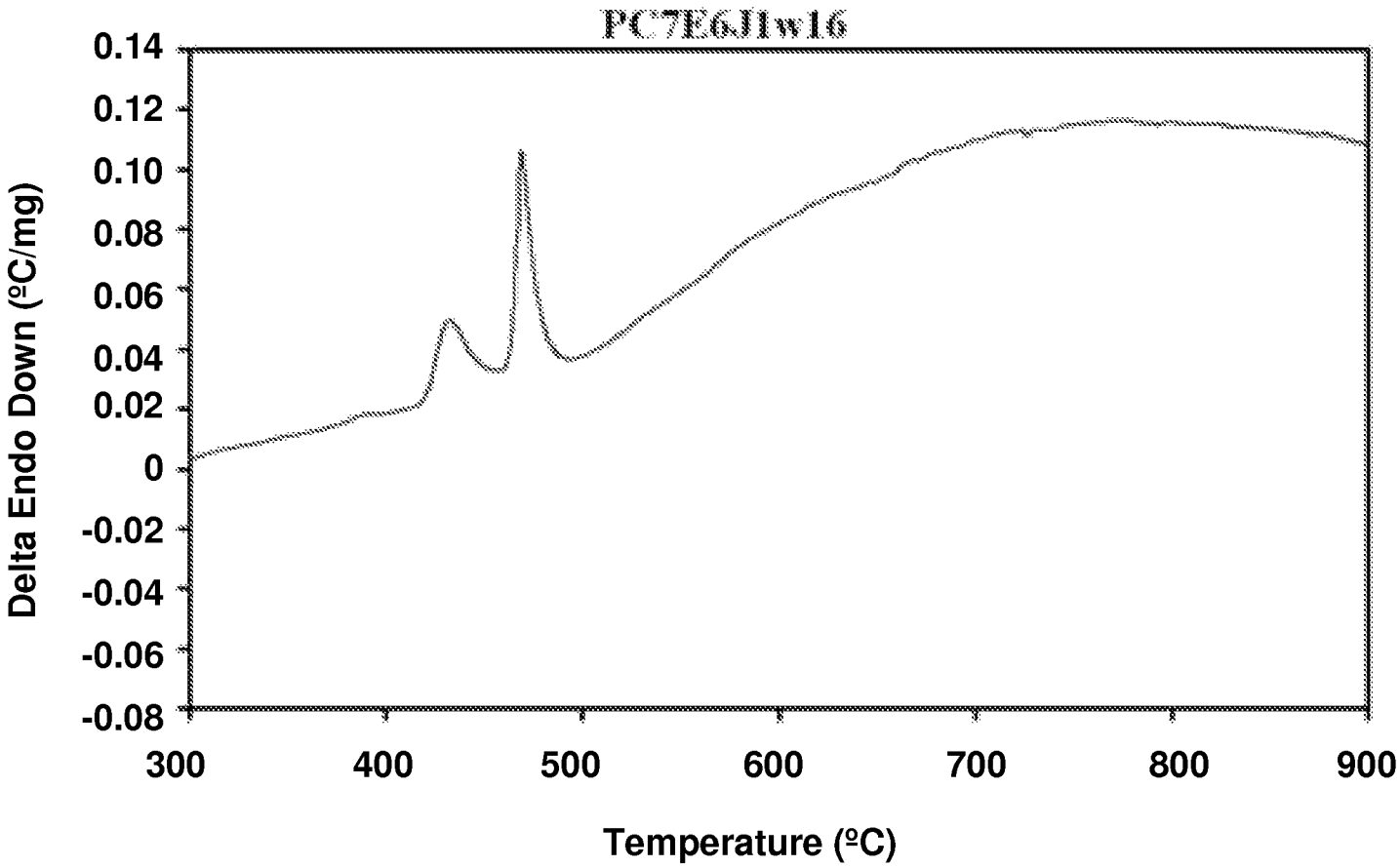
Figure 1F:
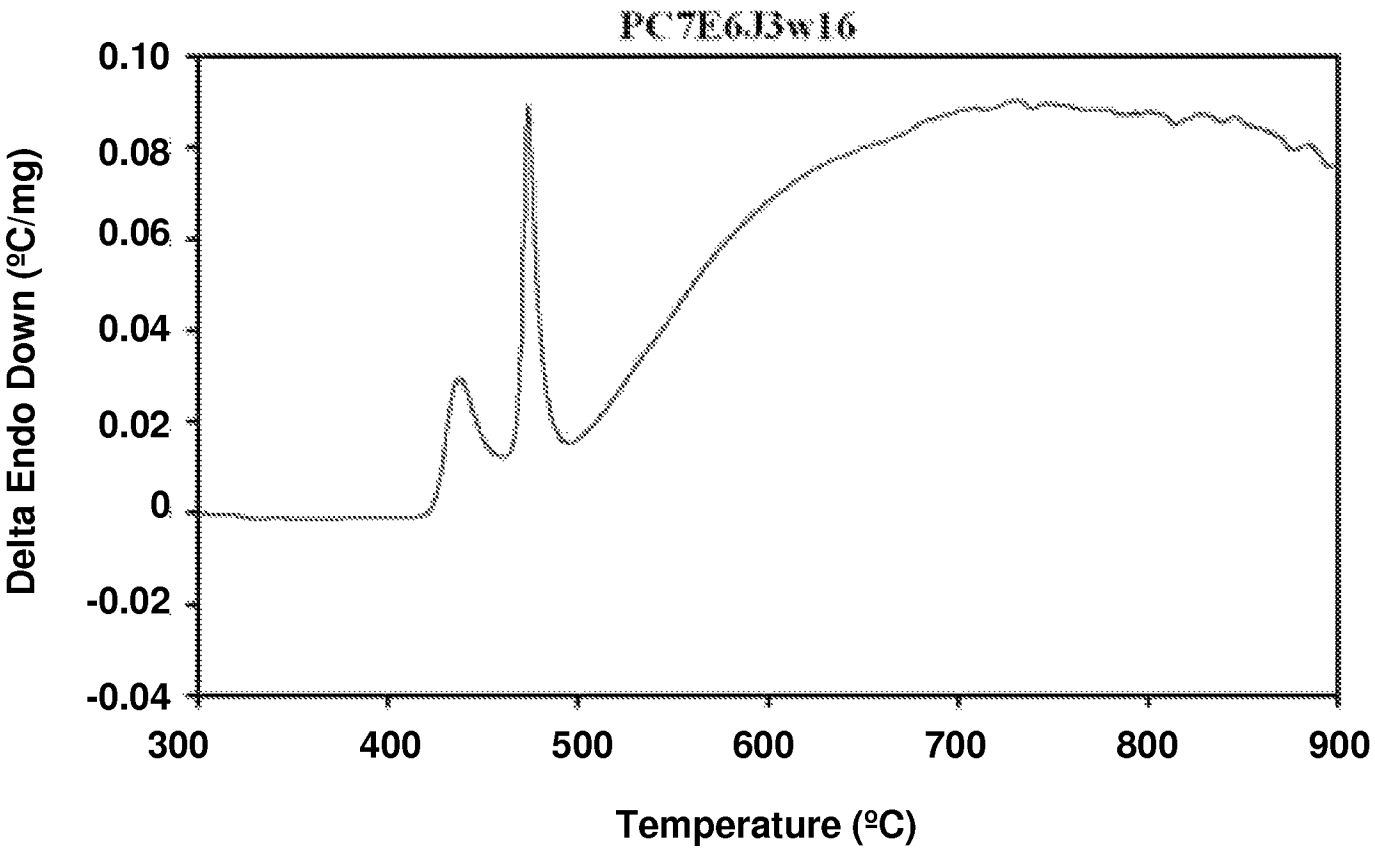
Figure 2A:
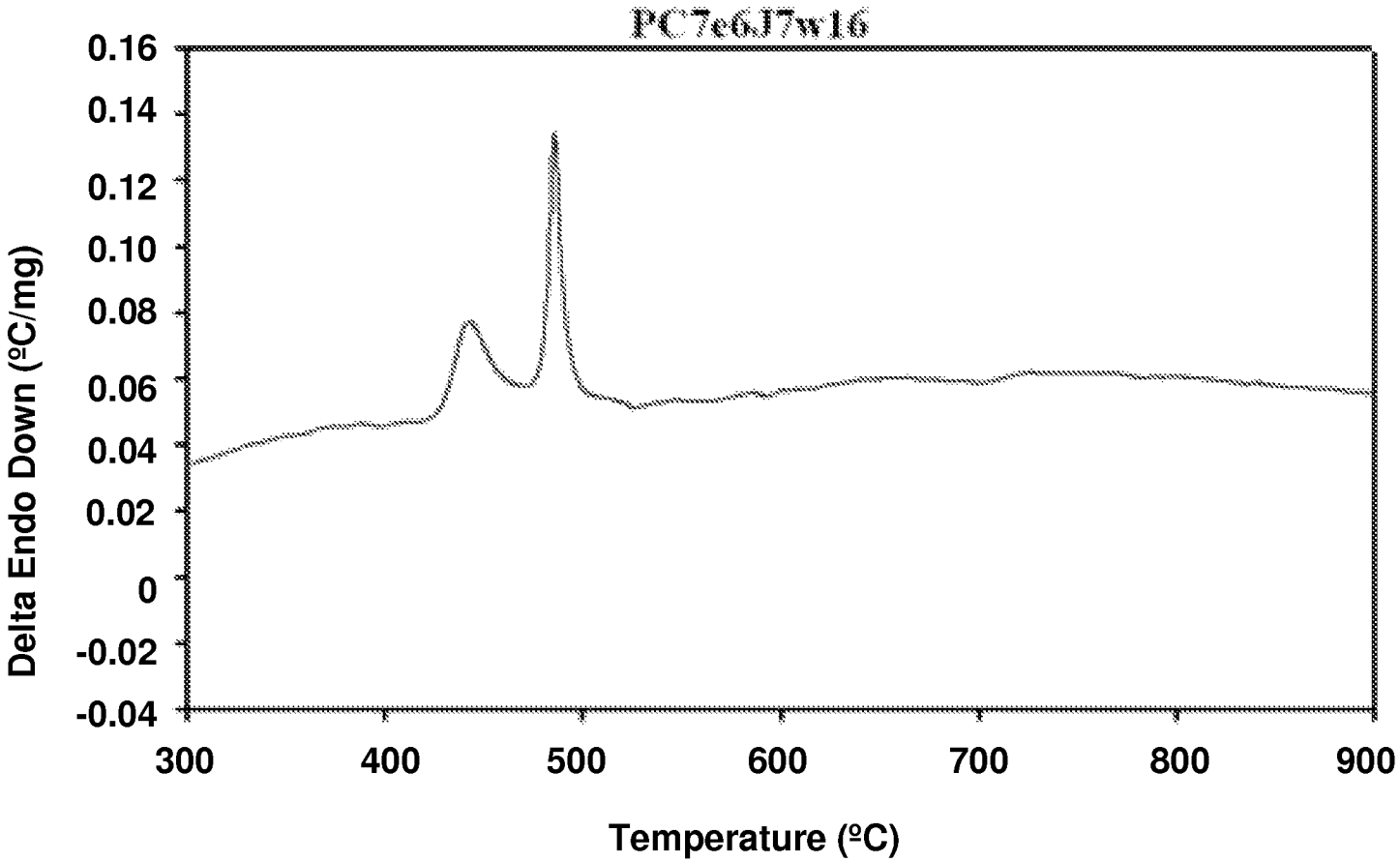
FIGS. 2*a* through 2*f* illustrate examples of DTA curves of the PC7E6 series alloys showing the presence of glass to crystalline transformation peak(s) and/or melting peak(s); a) PC7E6J7 melt-spun at 16 m/s, b) PC7E6J9 melt-spun at 16 m/s, c) PC7E6H1 melt-spun at 16 m/s, d) PC7E6H3 melt-spun at 16 m/s, e) PC7E6H7 melt-spun at 16 m/s, and f) PC7E6H9 melt-spun at 16 m/s.
Figure 2B:
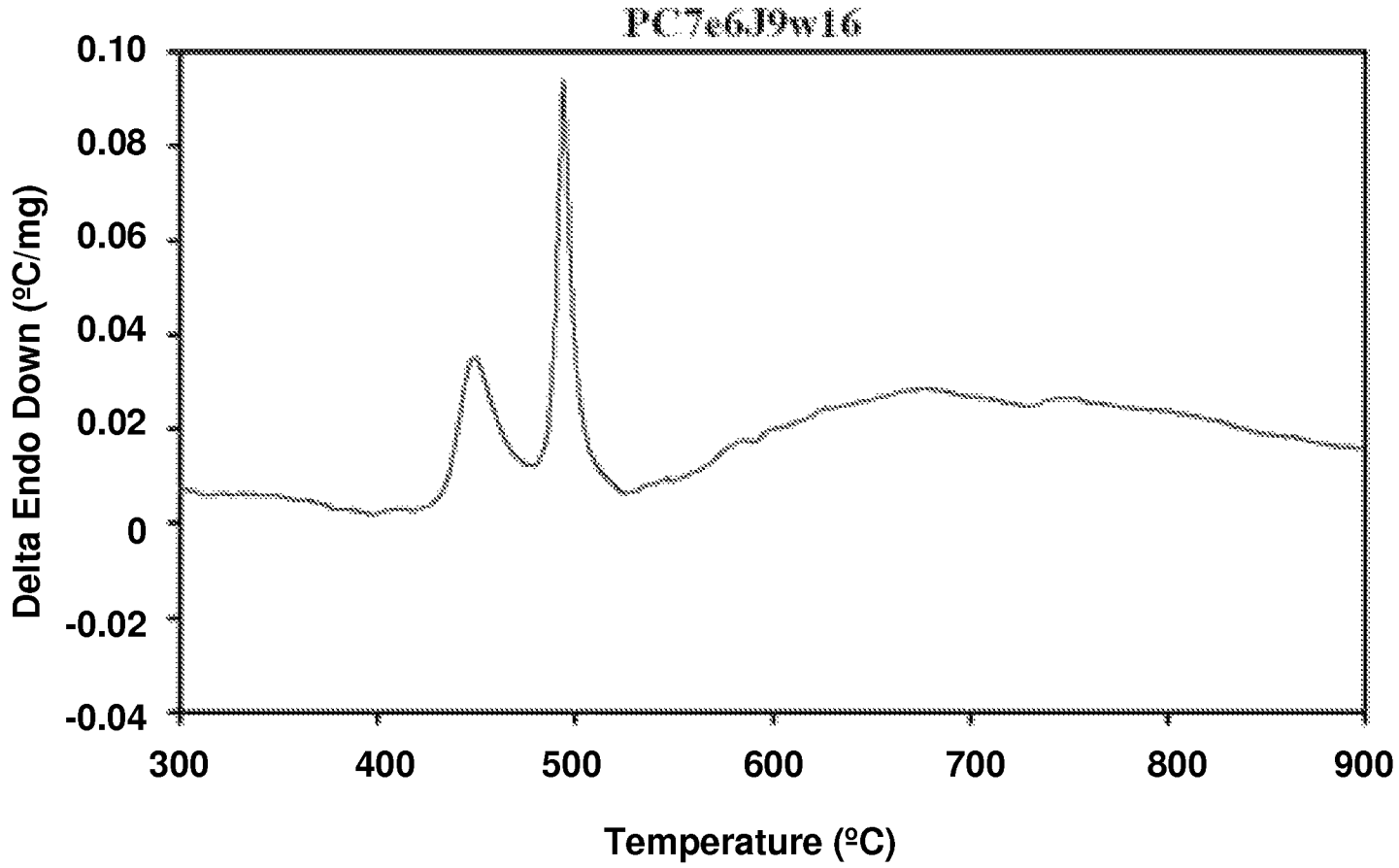
Figure 2C:
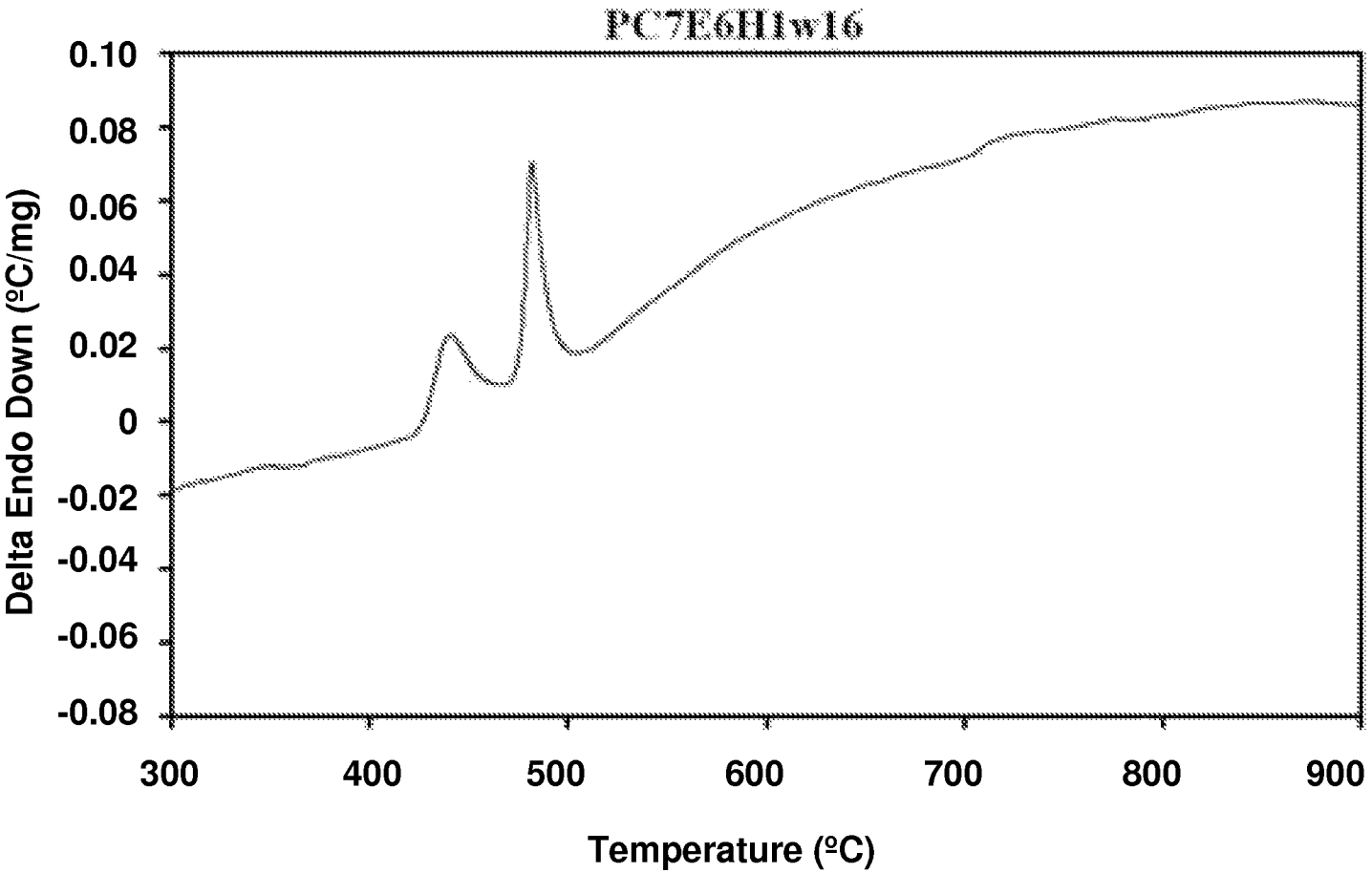
Figure 2D:
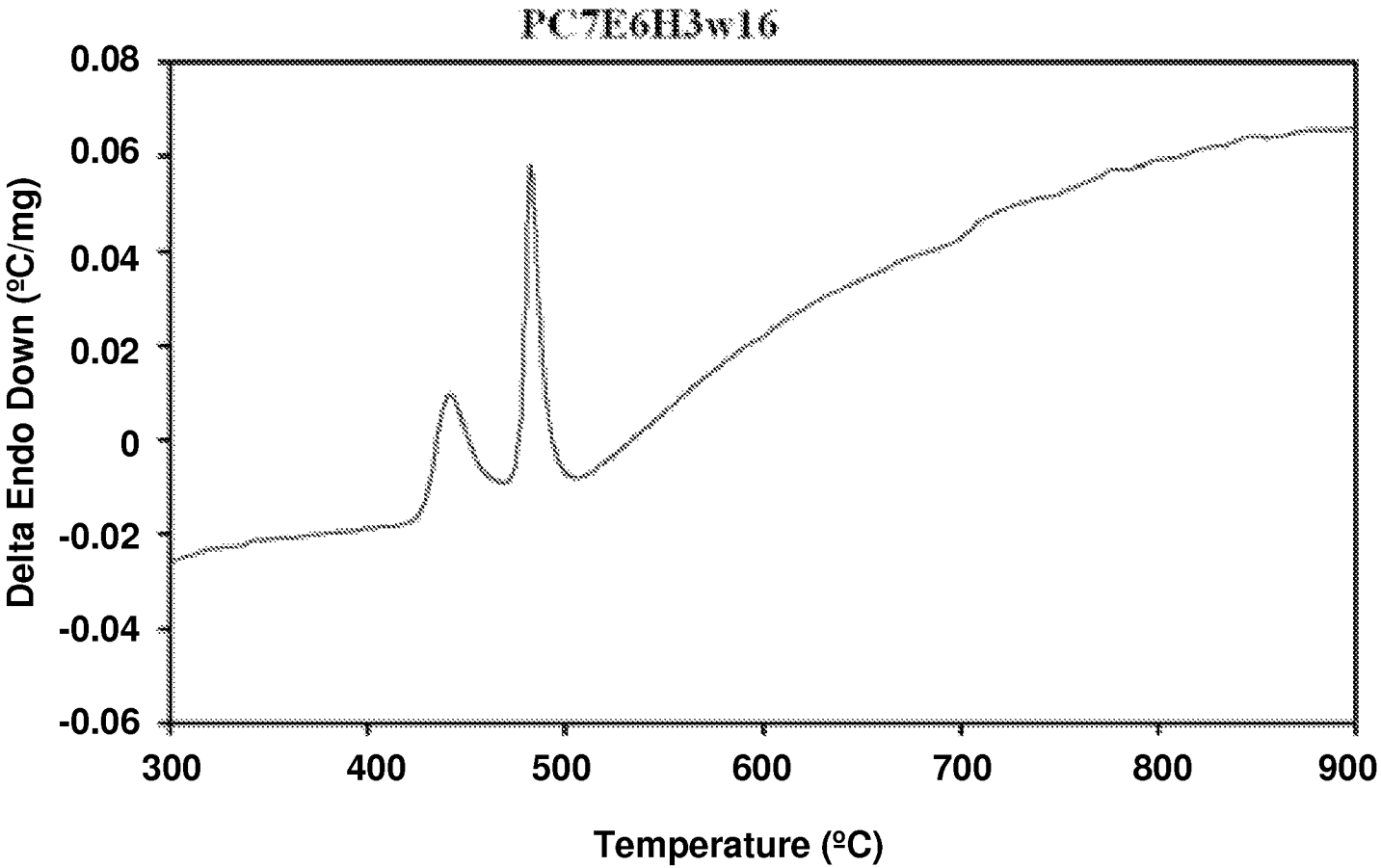
Figure 2E:
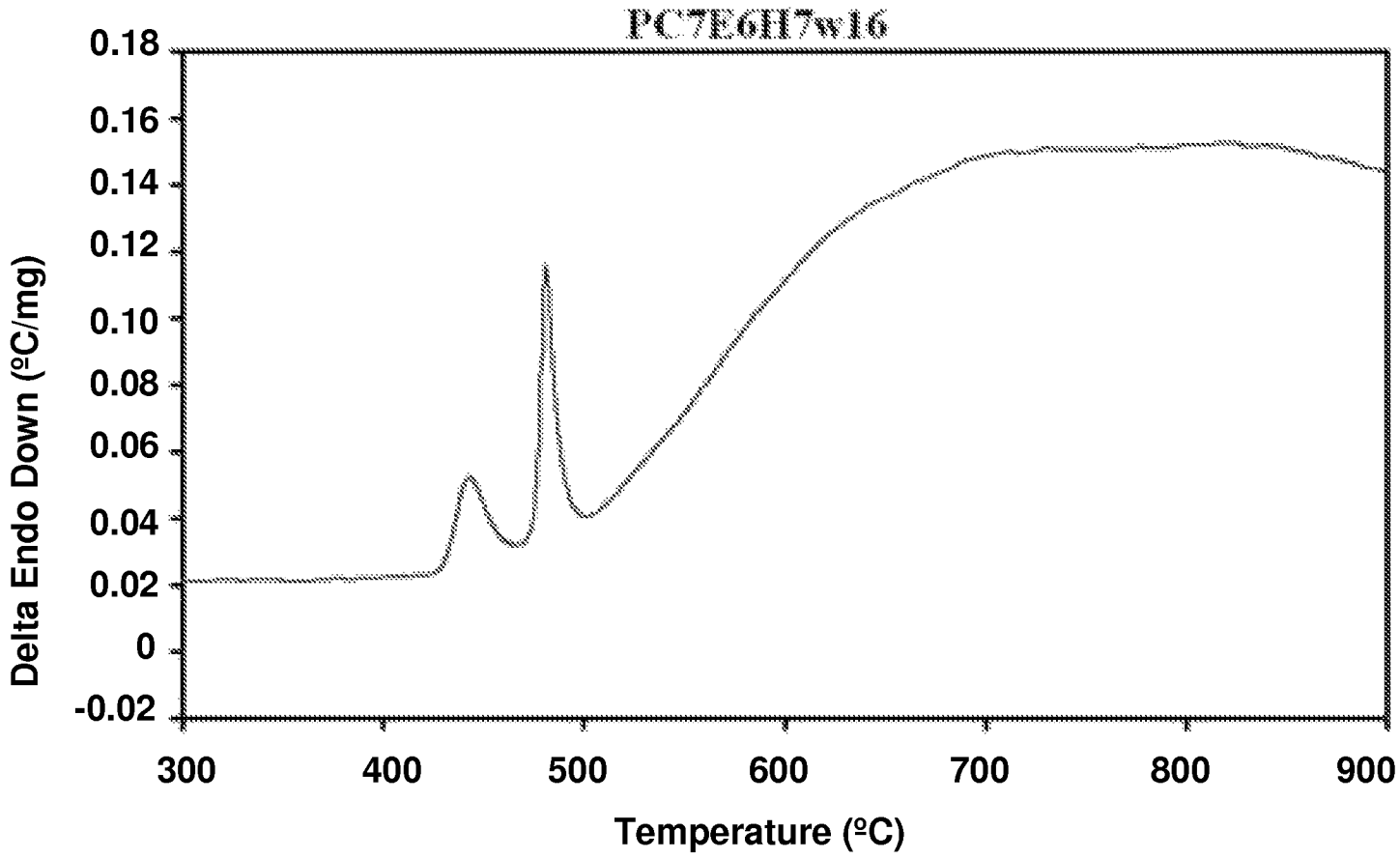
Figure 2F:
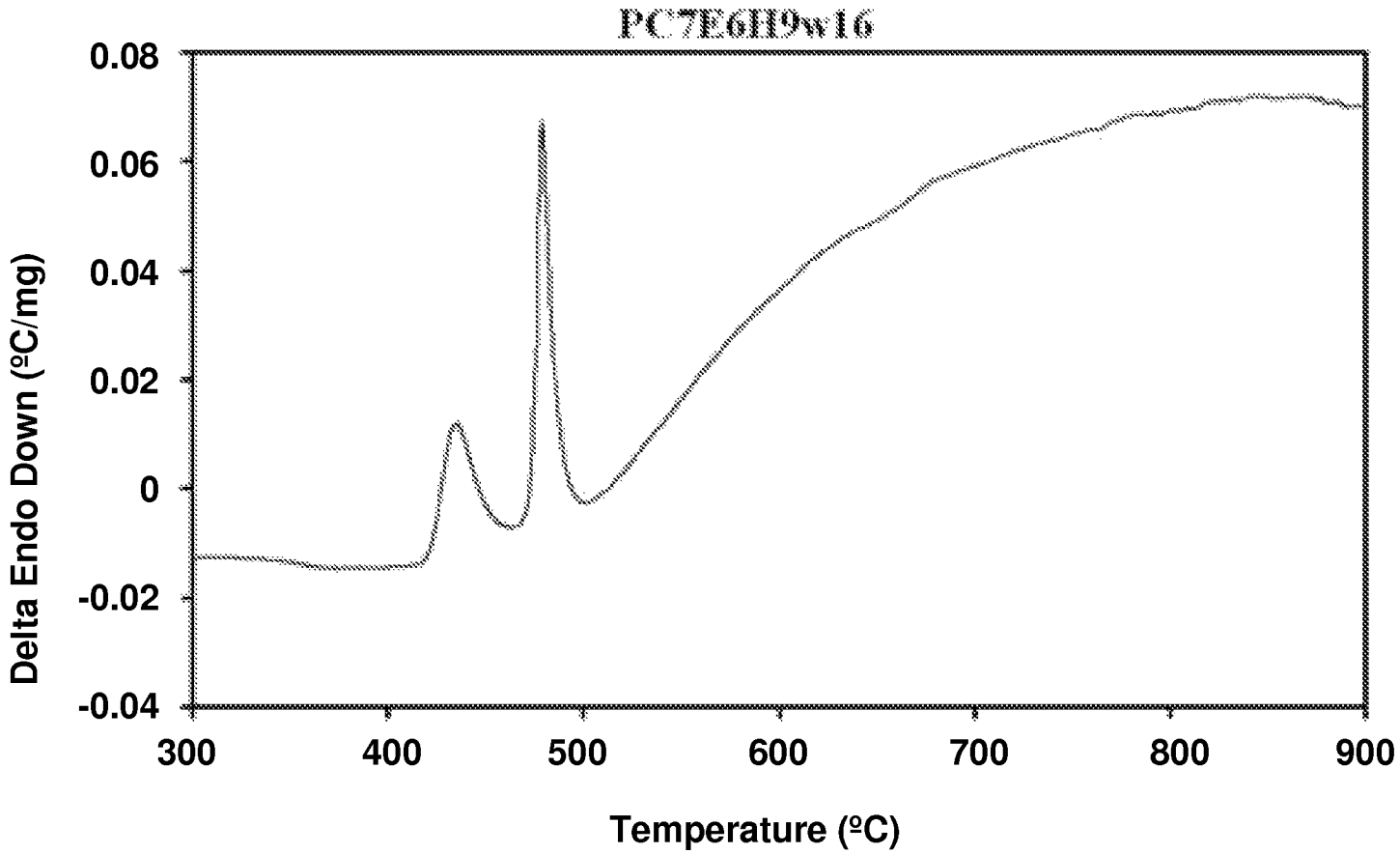
Figure 3A:
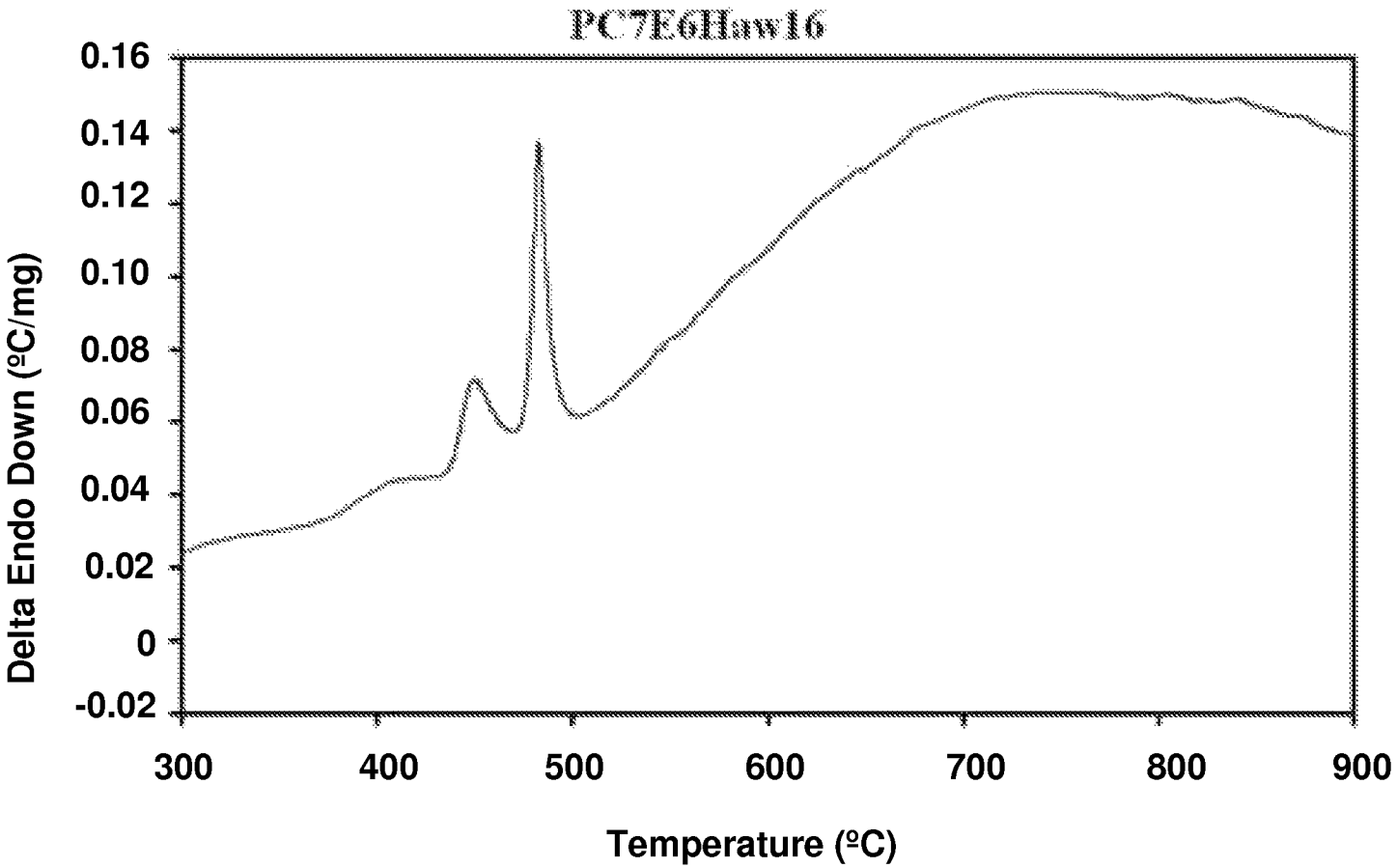
FIGS. 3*a* through 3*f* illustrate examples of DTA curves of the PC7E6 series alloys showing the presence of glass to crystalline transformation peak(s) and/or melting peak(s); a) PC7E6HA melt-spun at 16 m/s, b) PC7E6HB melt-spun at 16 m/s, c) PC7E6HC melt-spun at 16 m/s, d) PC7E6J1H9 melt-spun at 16 m/s, e) PC7E6J3H9 melt-spun at 16 m/s, and f) PC7E6J7H9 melt-spun at 16 m/s.
Figure 3B:
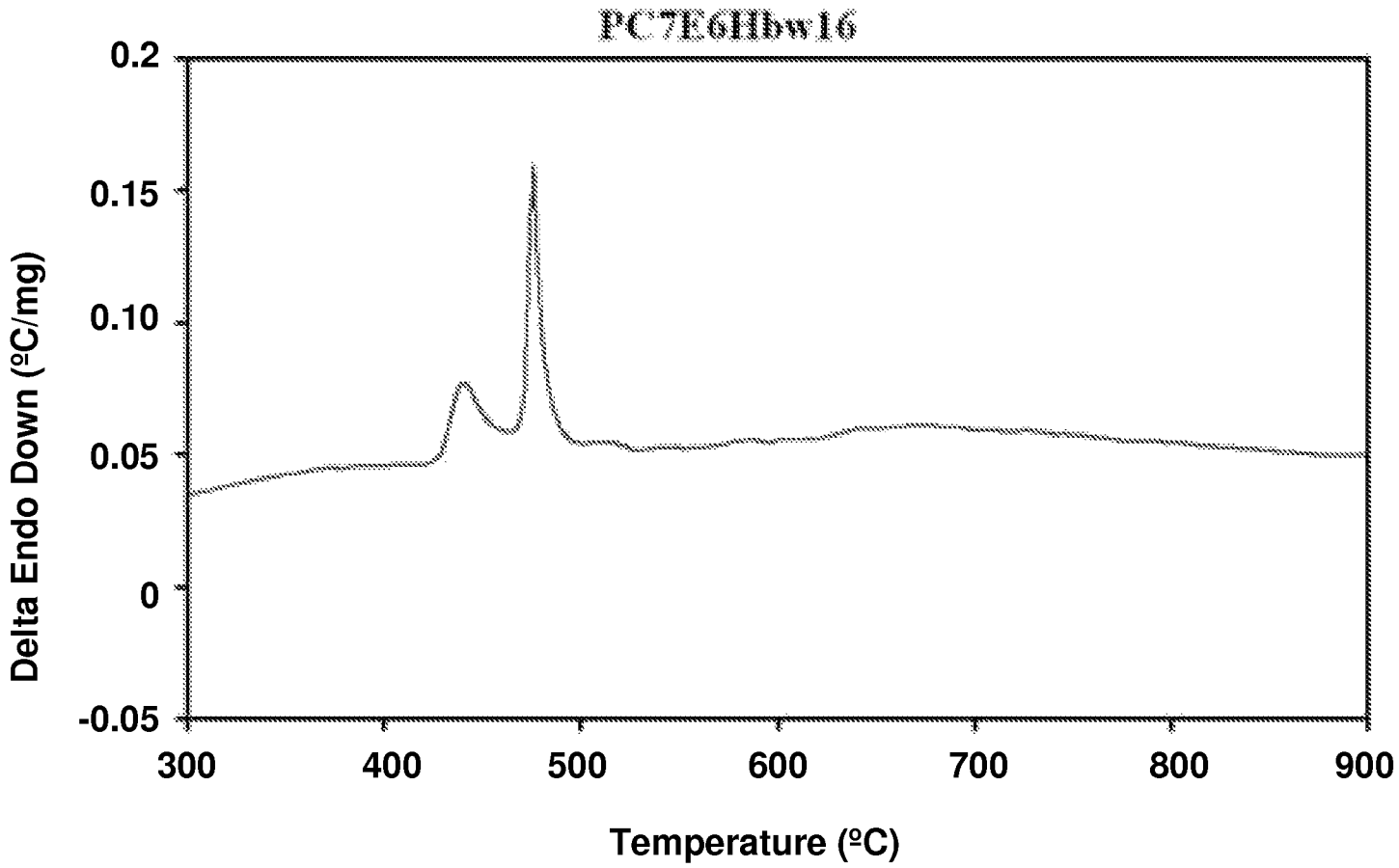
Figure 3C:
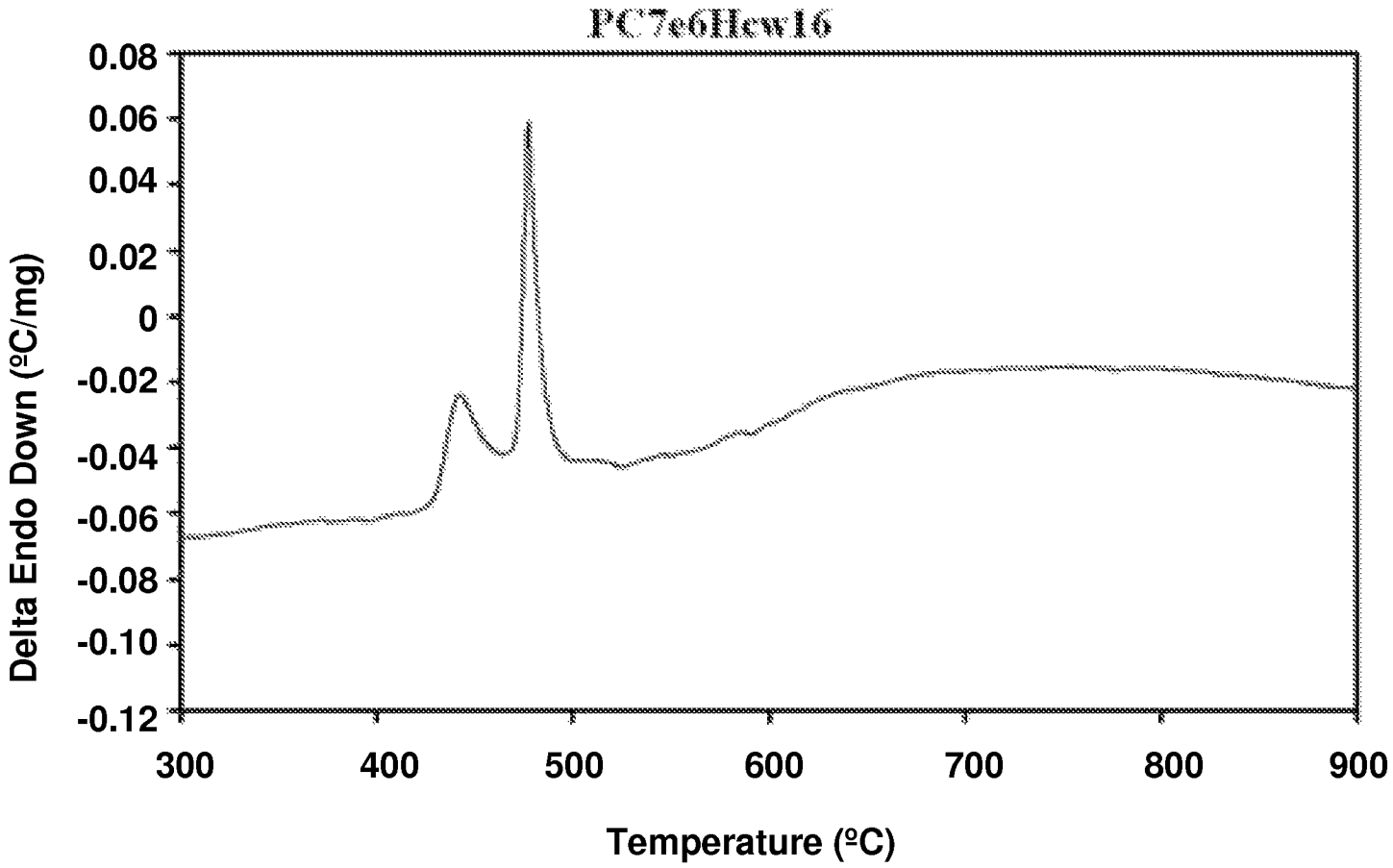
Figure 3D:
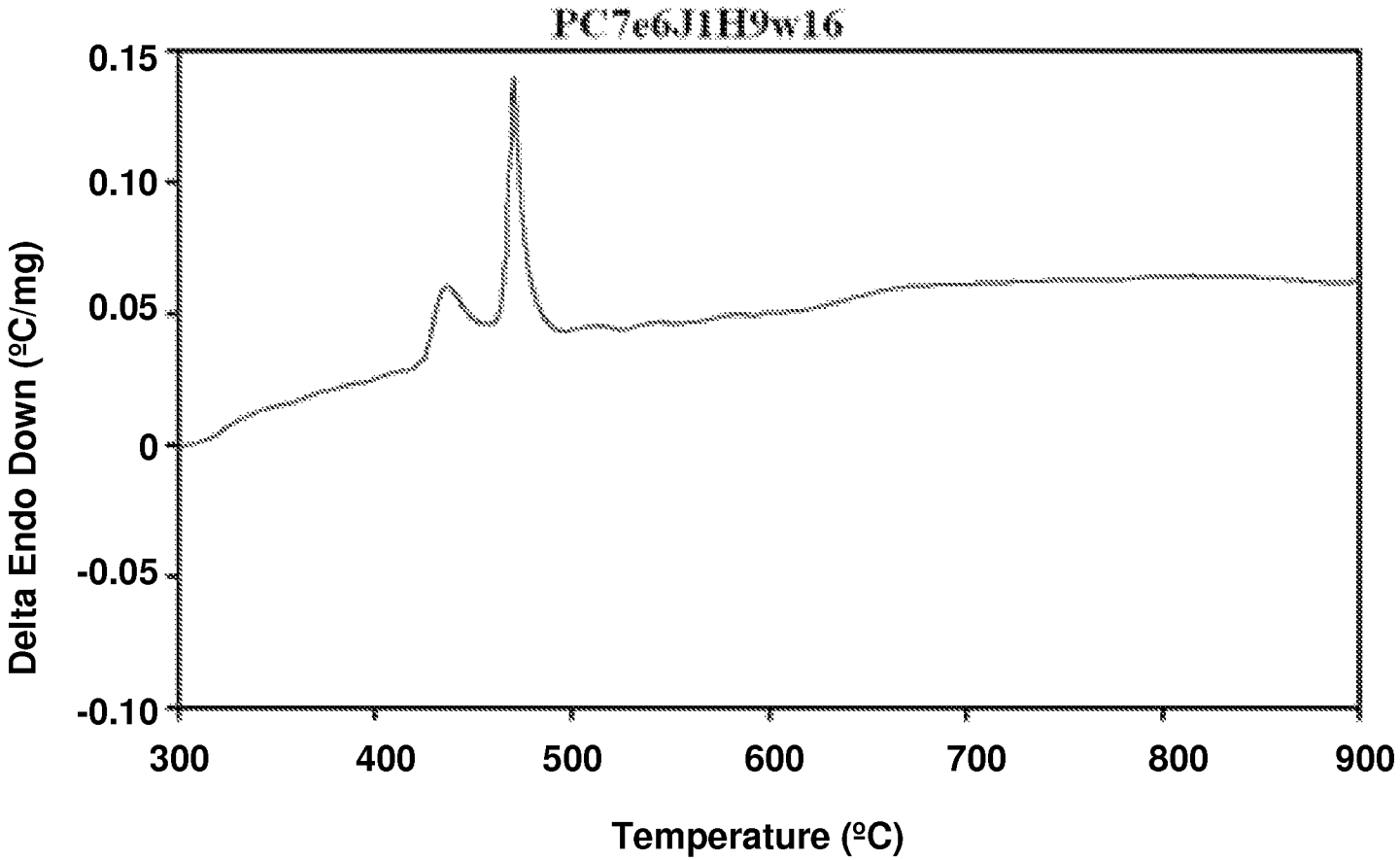
Figure 3E:
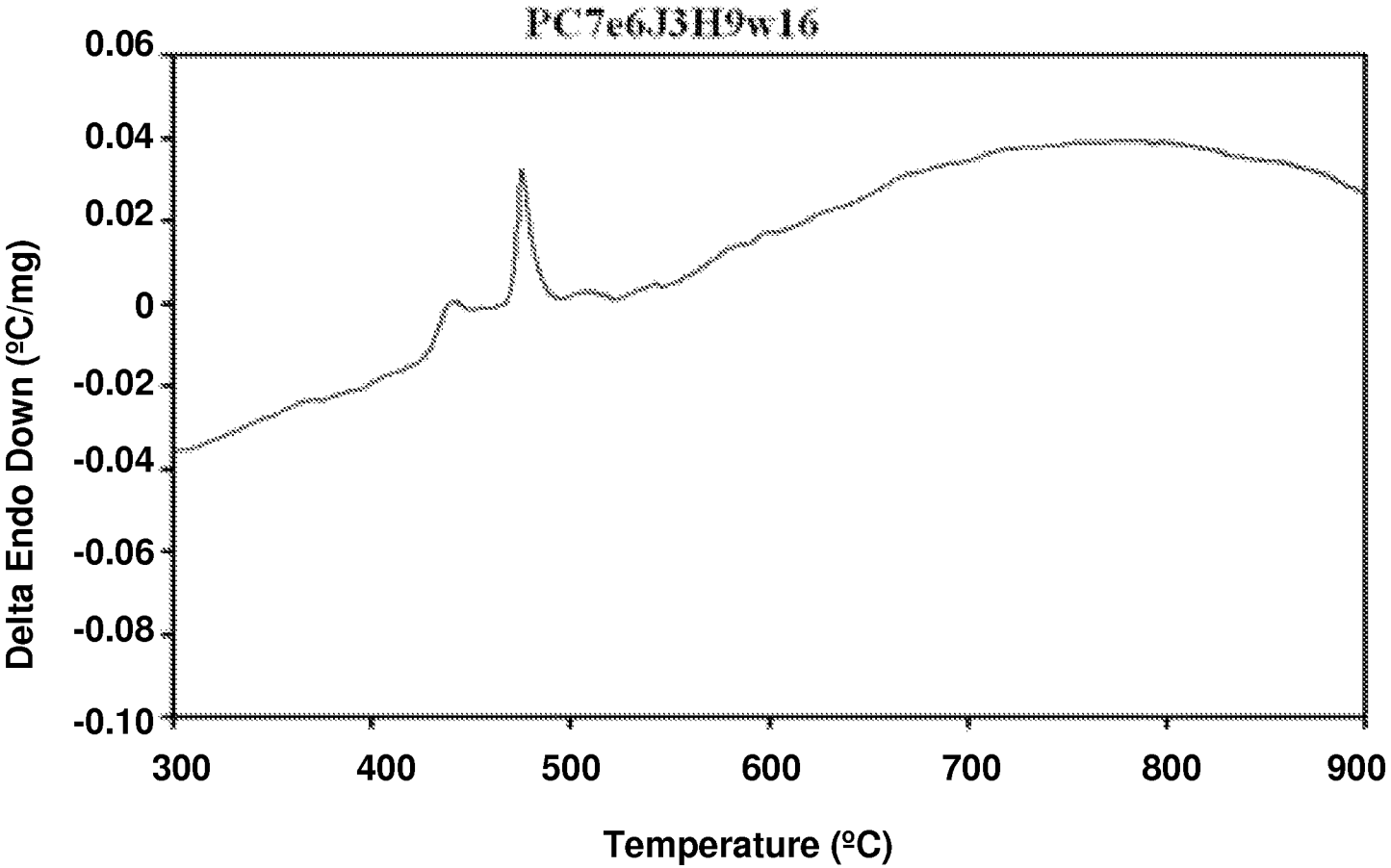
Figure 3F:
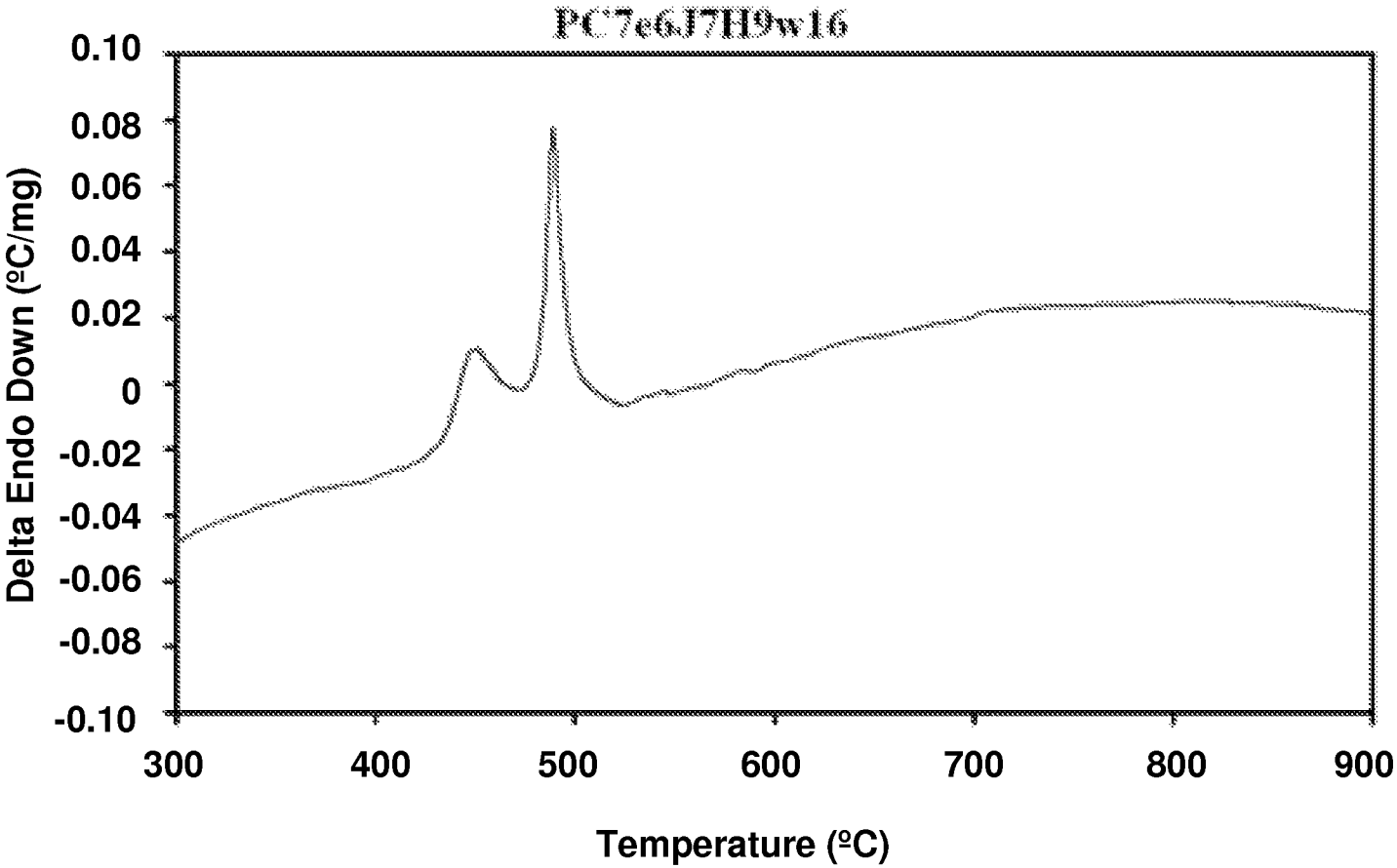
Figure 4A:
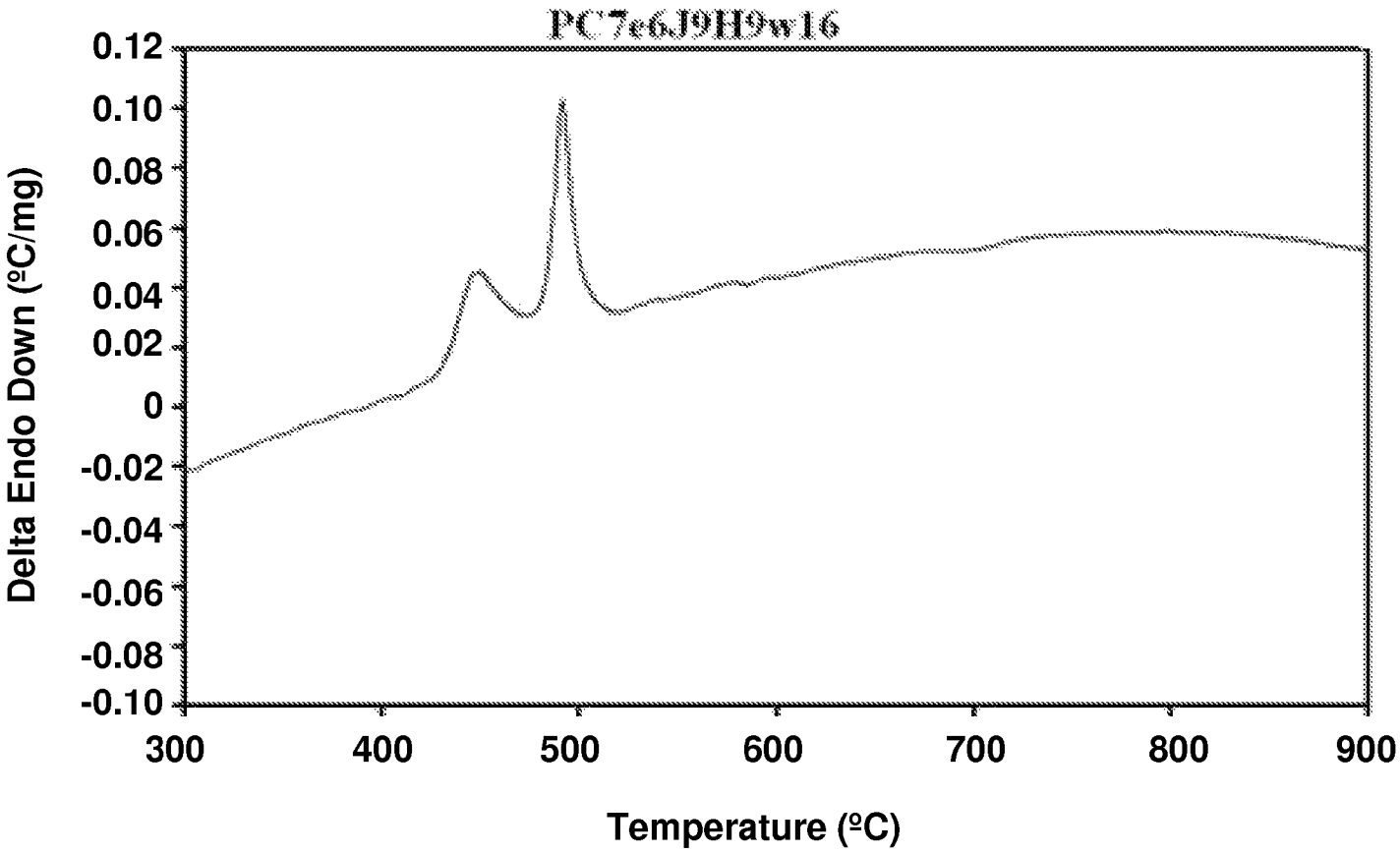
FIGS. 4*a* through 4*f* illustrate examples of DTA curves of the PC7E6 series alloys showing the presence of glass to crystalline transformation peak(s) and/or melting peak(s); a) PC7E6J9H9 melt-spun at 16 m/s, b) PC7E6J1HA melt-spun at 16 m/s, c) PC7E6J3HA melt-spun at 16 m/s, d) PC7E6J7HA melt-spun at 16 m/s, e) PC7E6J9HA melt-spun at 16 m/s, and f) PC7E6J1HB melt-spun at 16 m/s.
Figure 4B:
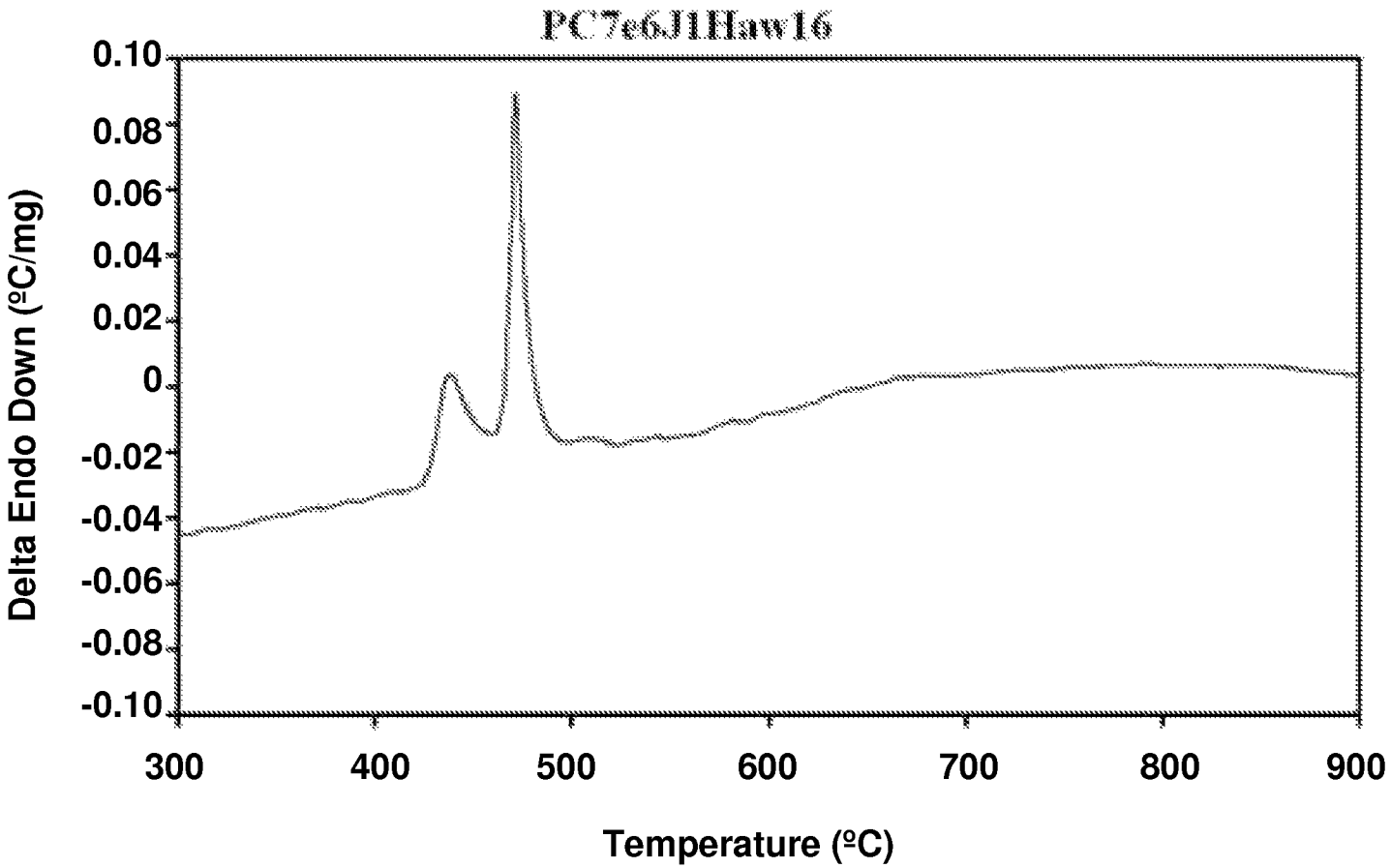
Figure 4C:
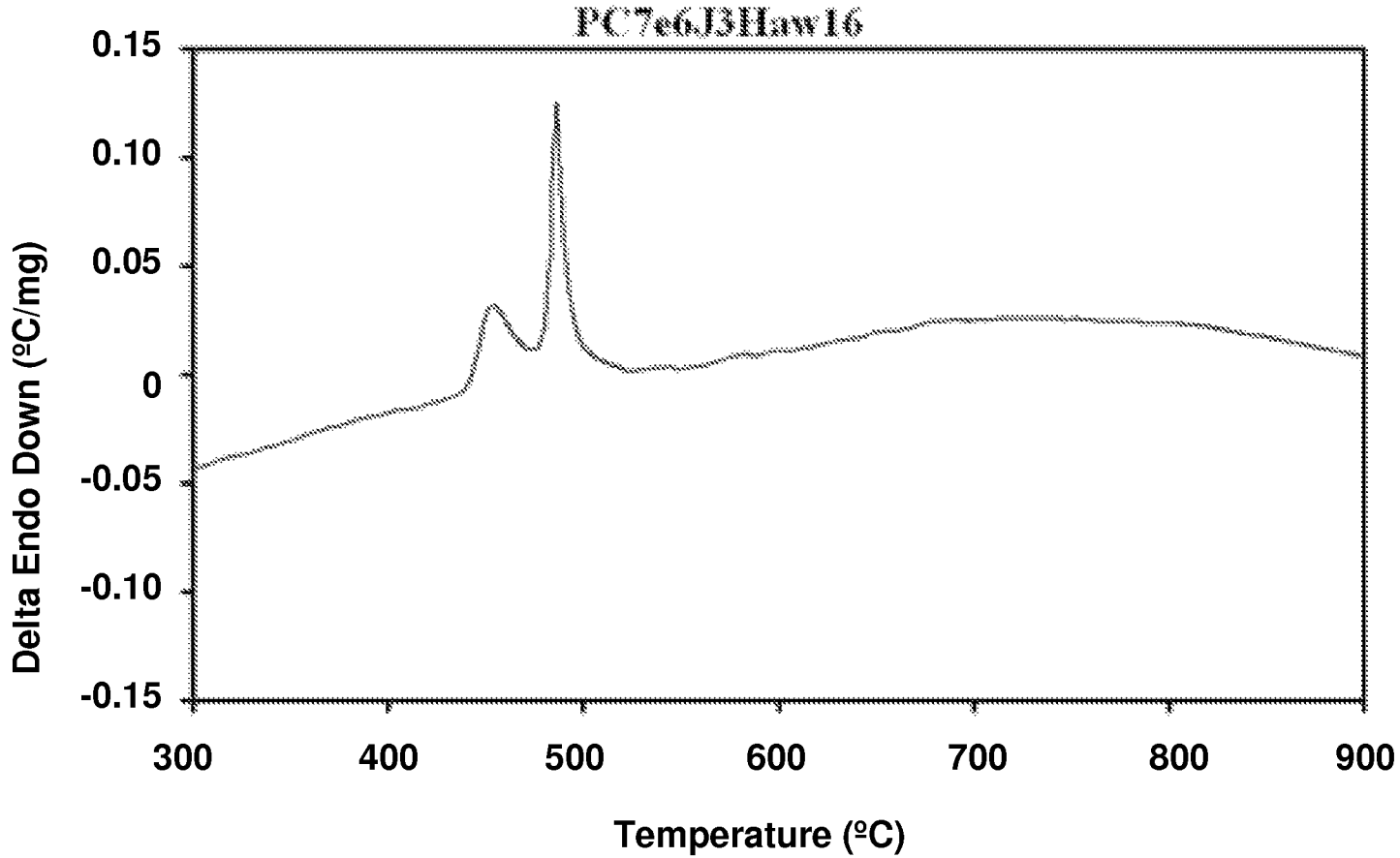
Figure 4D:
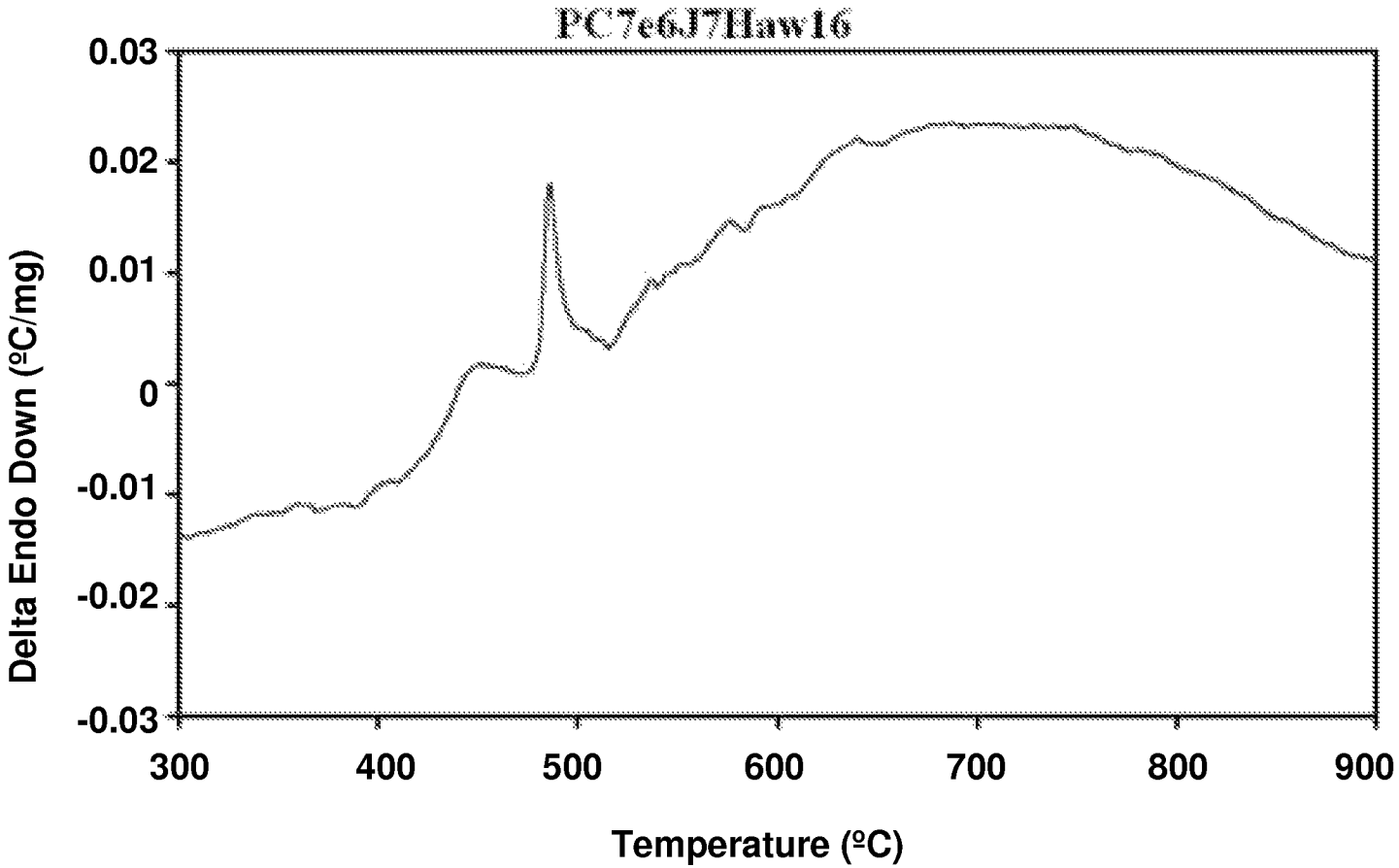
Figure 4E:
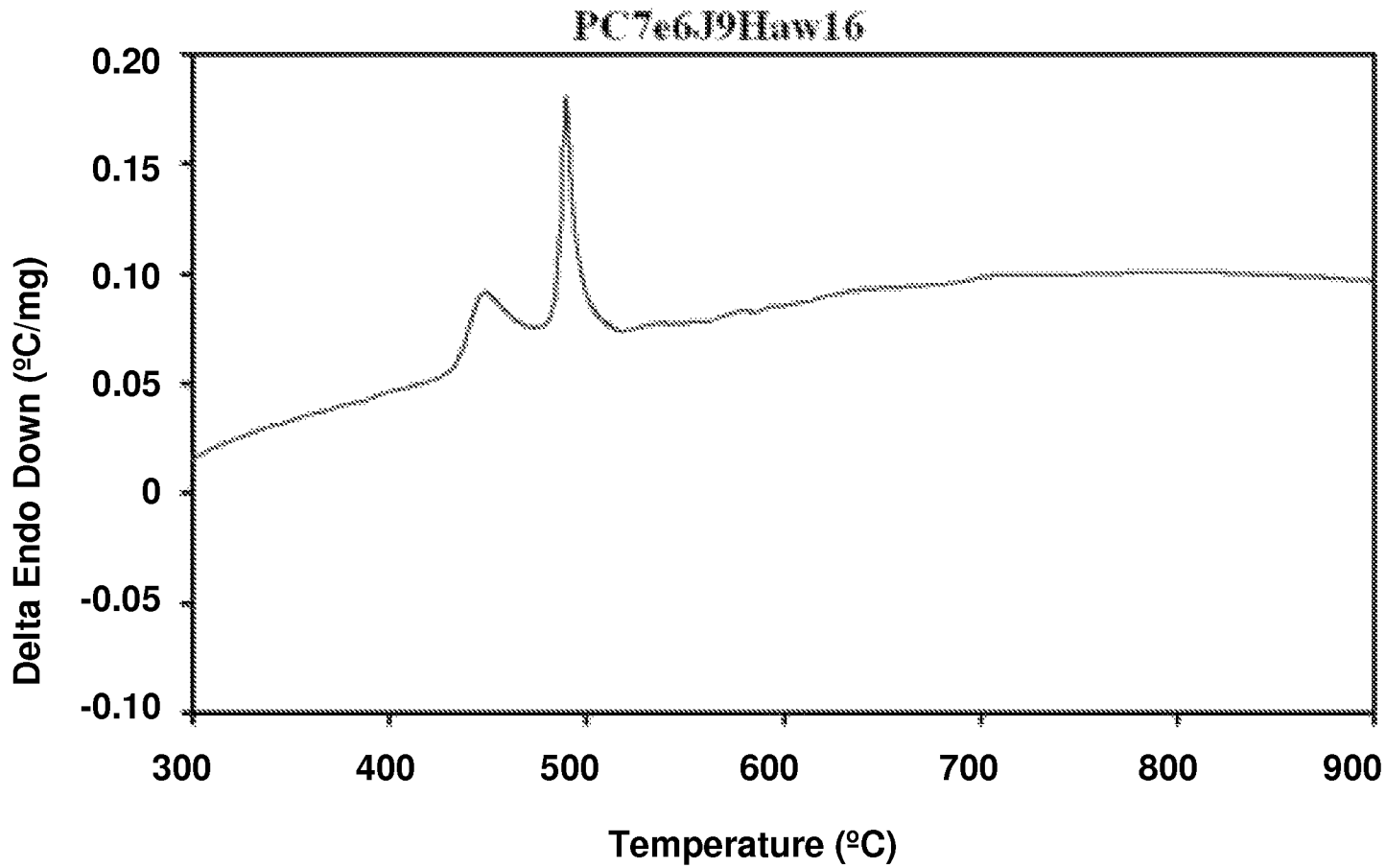
Figure 4F:
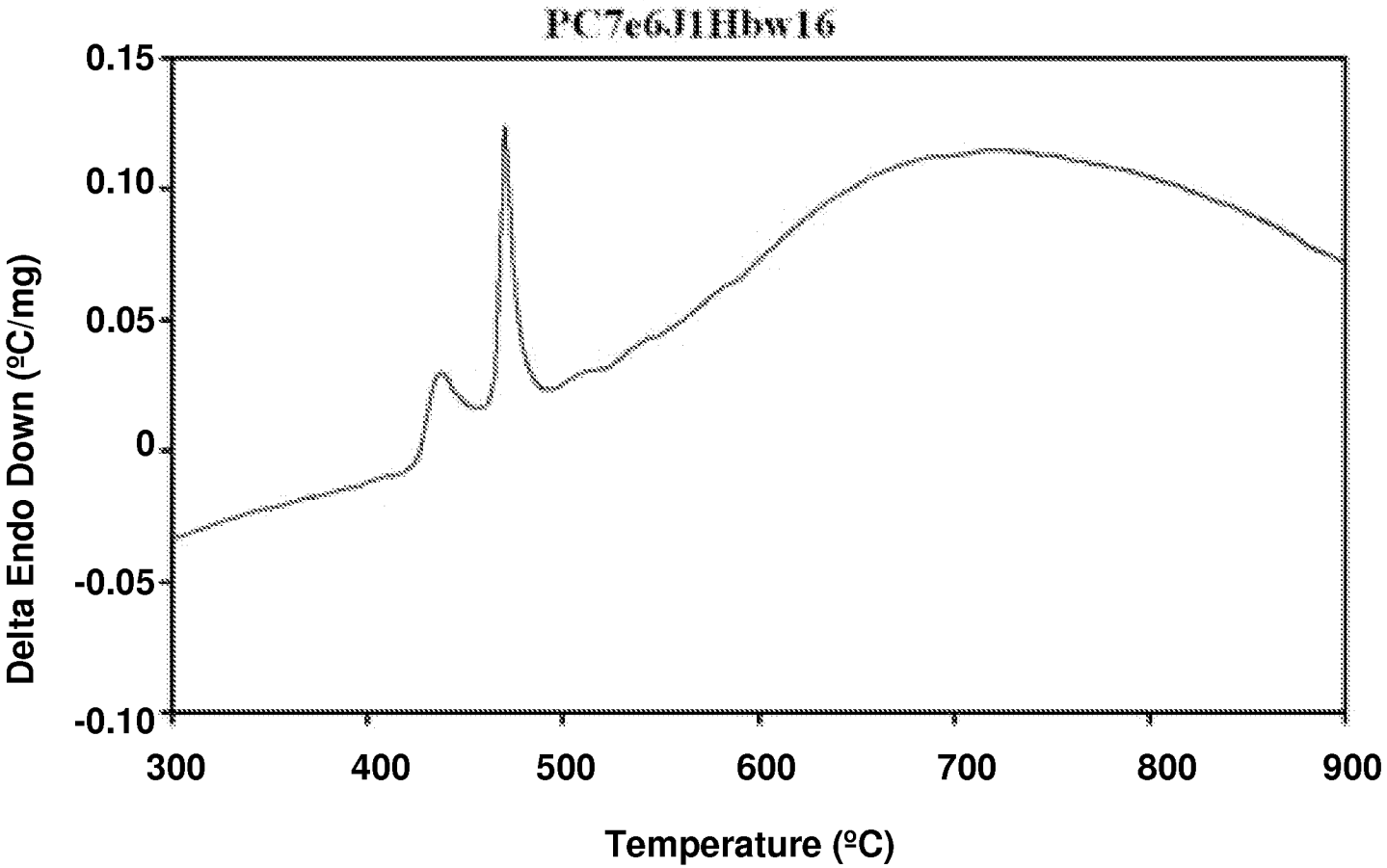
Figure 5A:
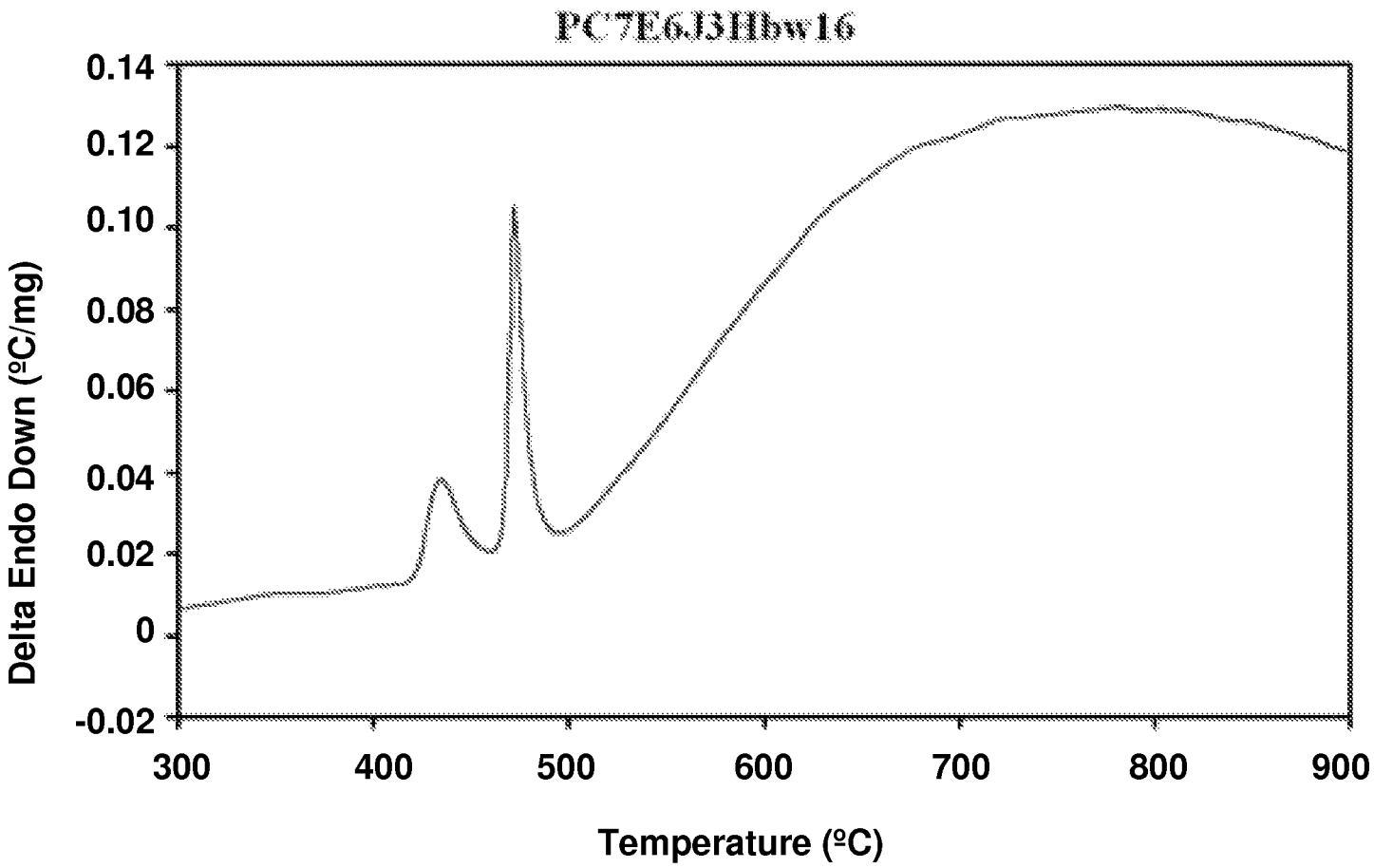
FIGS. 5*a* through 5*f* illustrate examples of DTA curves of the PC7E6 series alloys showing the presence of glass to crystalline transformation peak(s) and/or melting peak(s); a) PC7E6J3HB melt-spun at 16 m/s, b) PC7E6J7HB melt-spun at 16 m/s, c) PC7E6J1HC melt-spun at 16 m/s, d) PC7E7 melt-spun at 16 m/s.
Figure 5B:
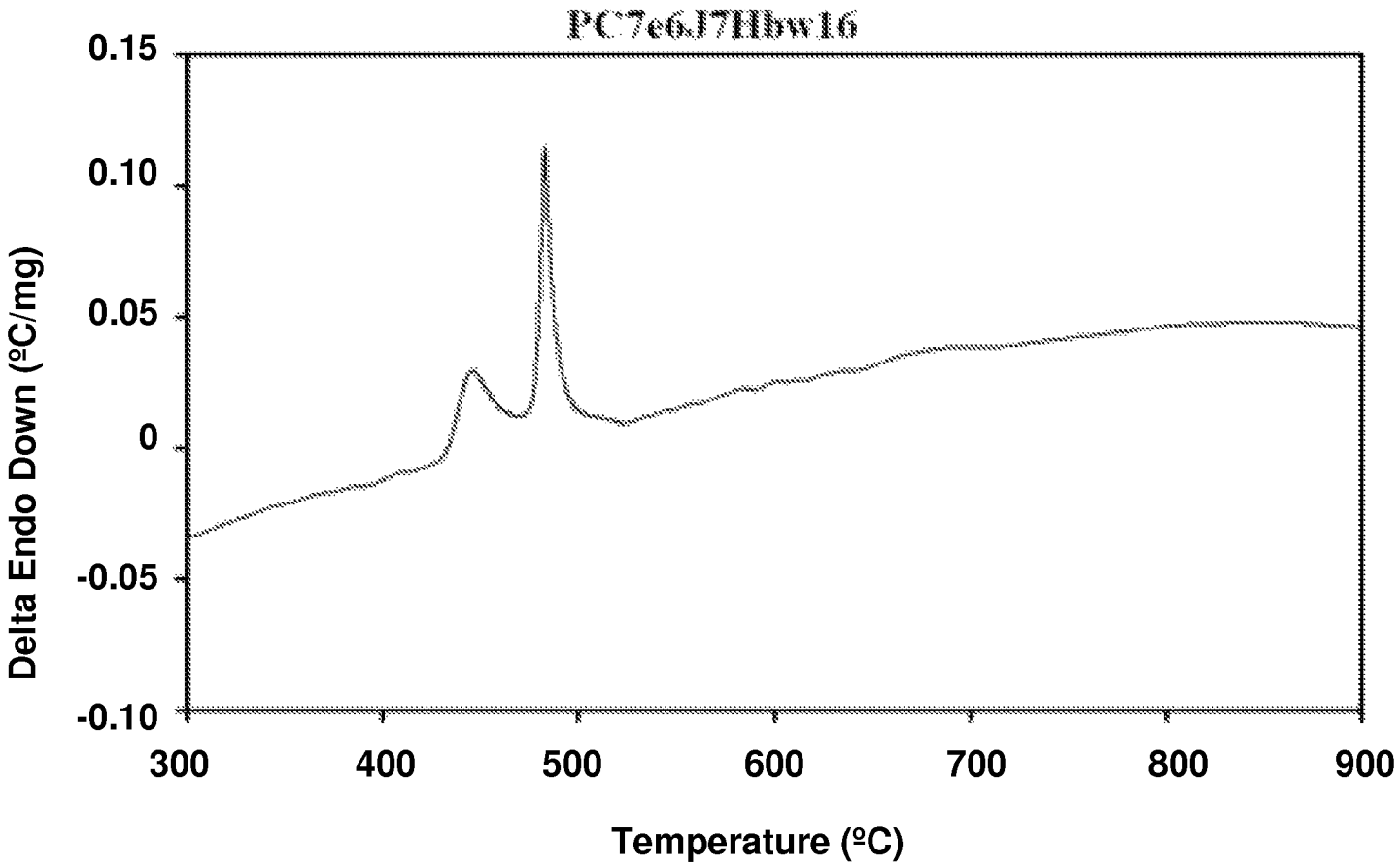
Figure 5C:
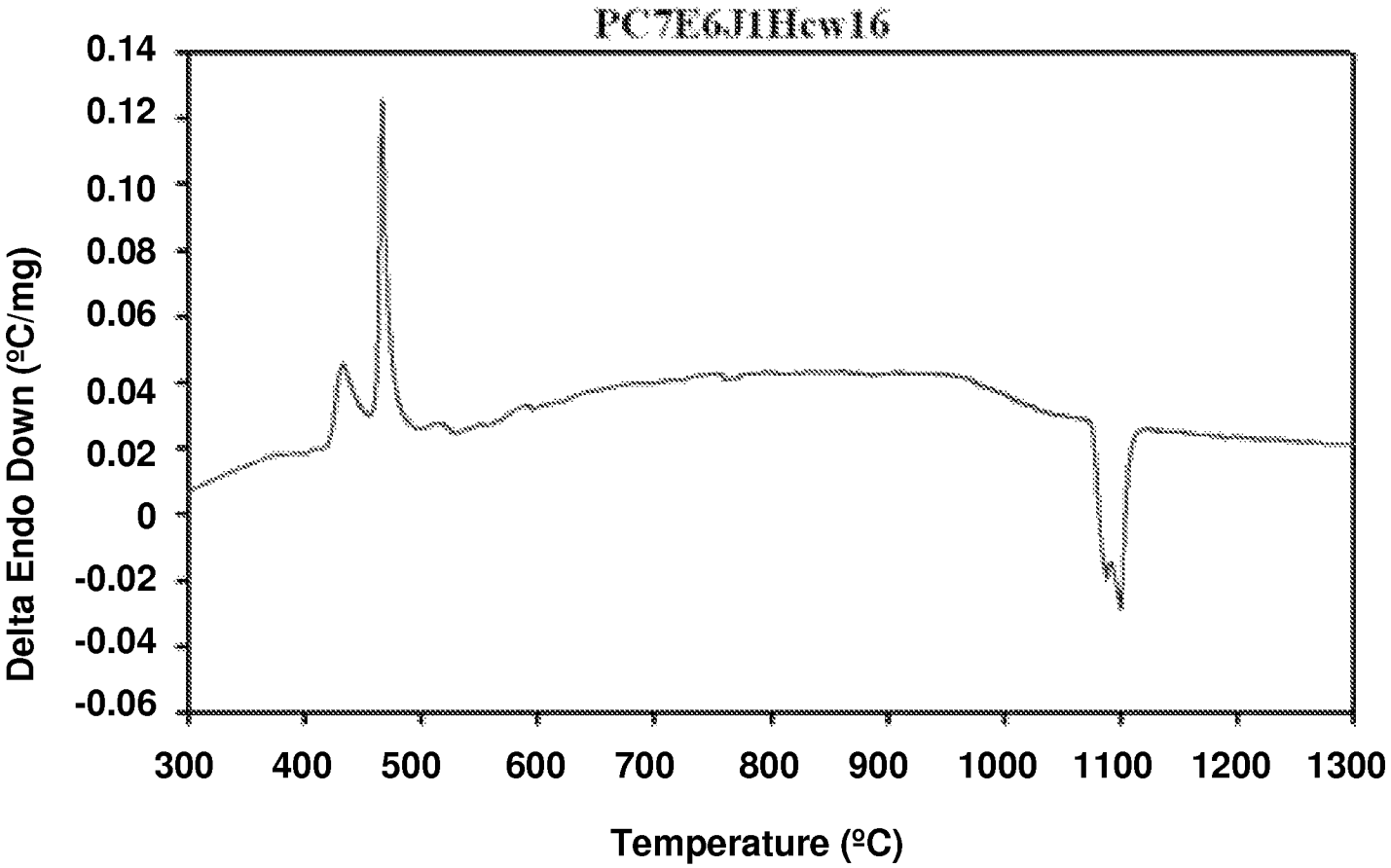
Figure 5D:
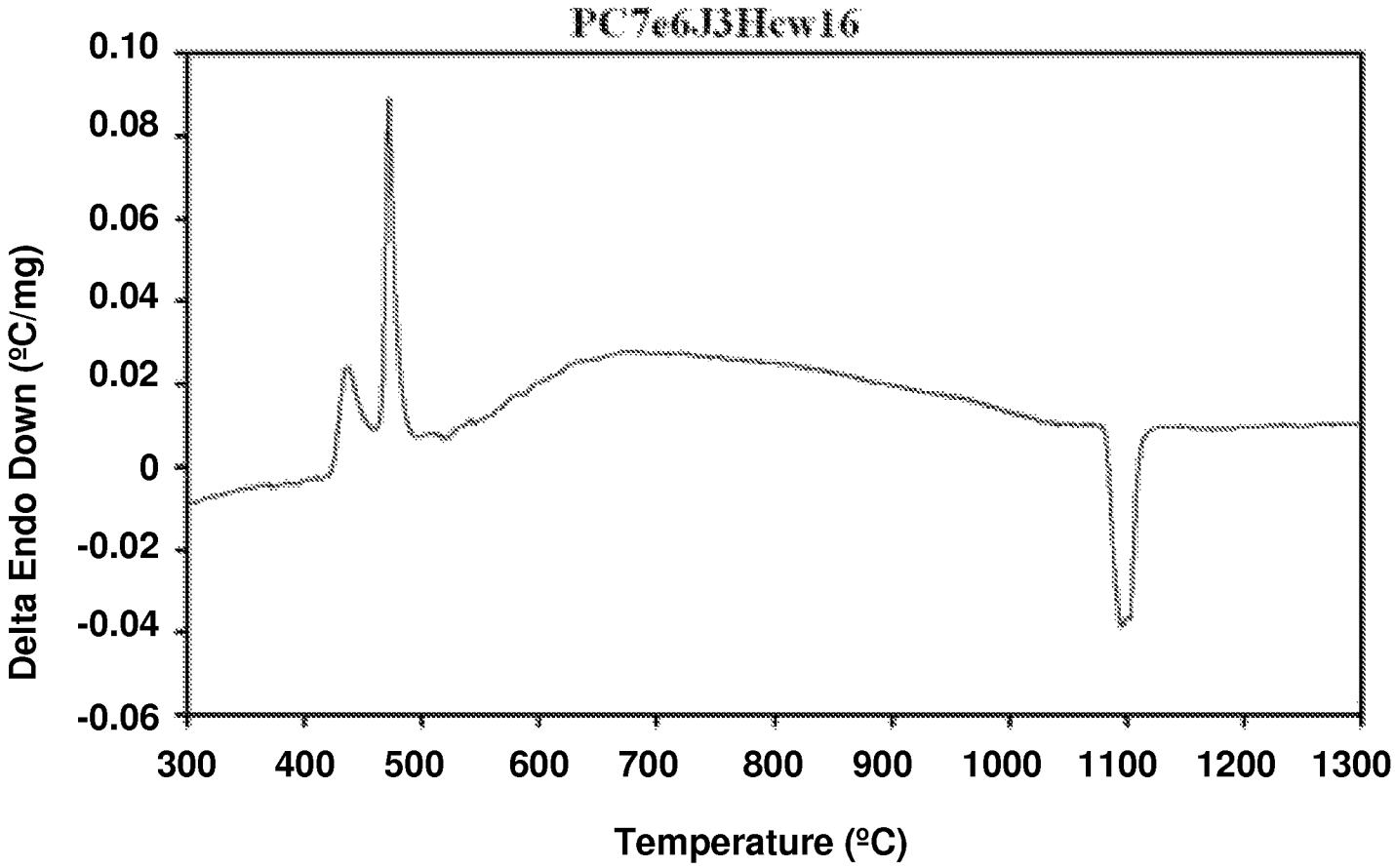
Figure 5E:
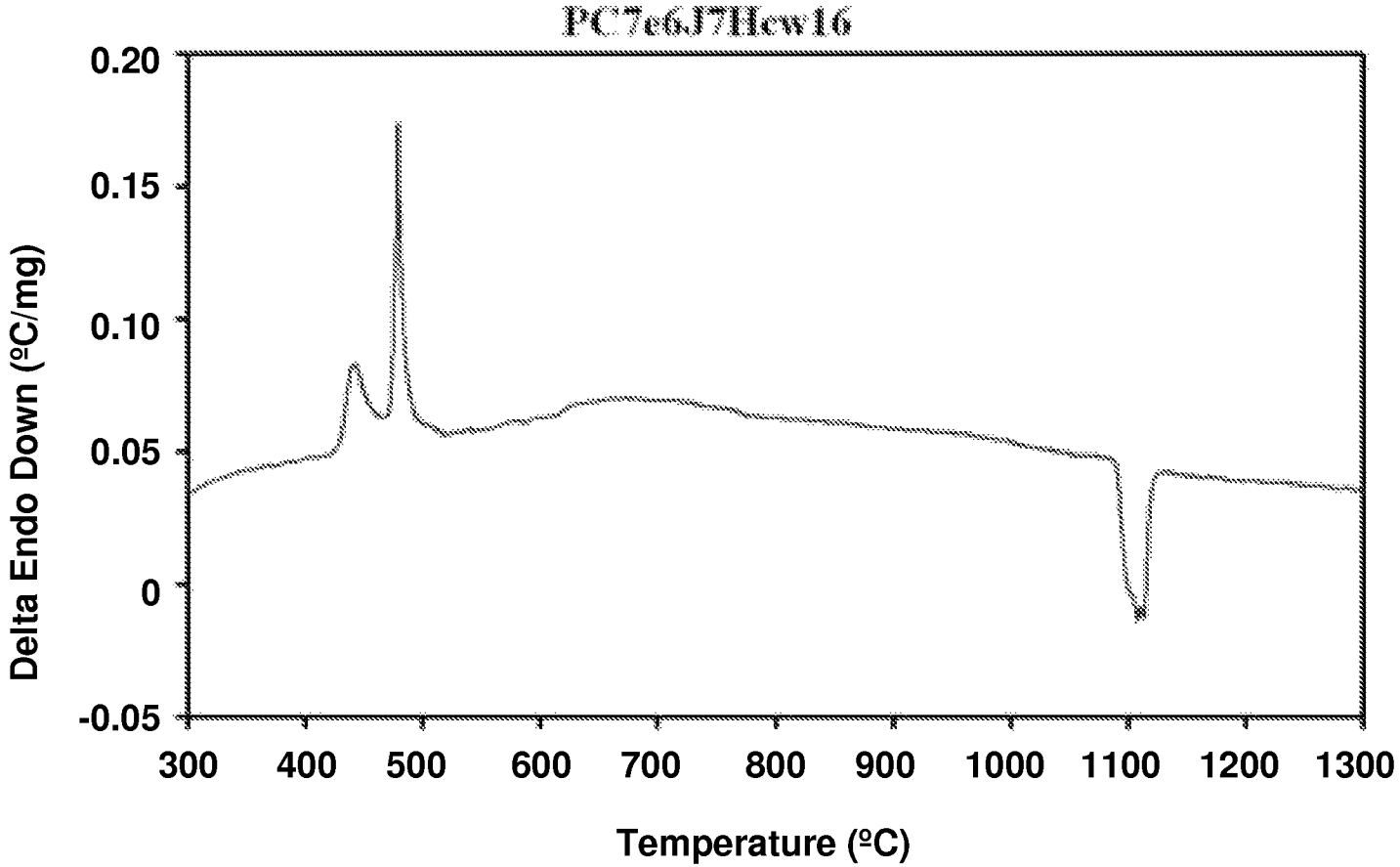
Figure 5F:
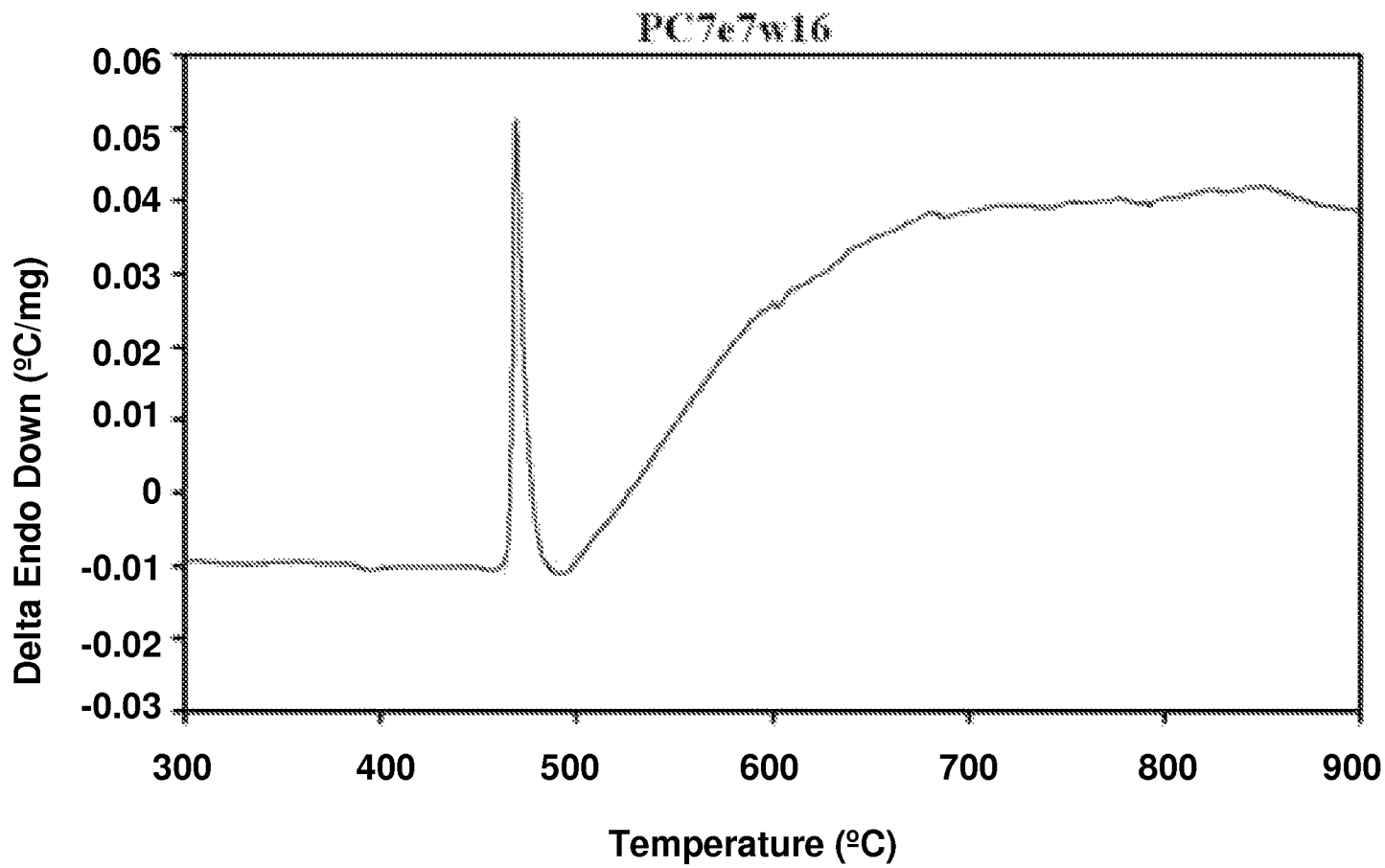
Figure 6A:
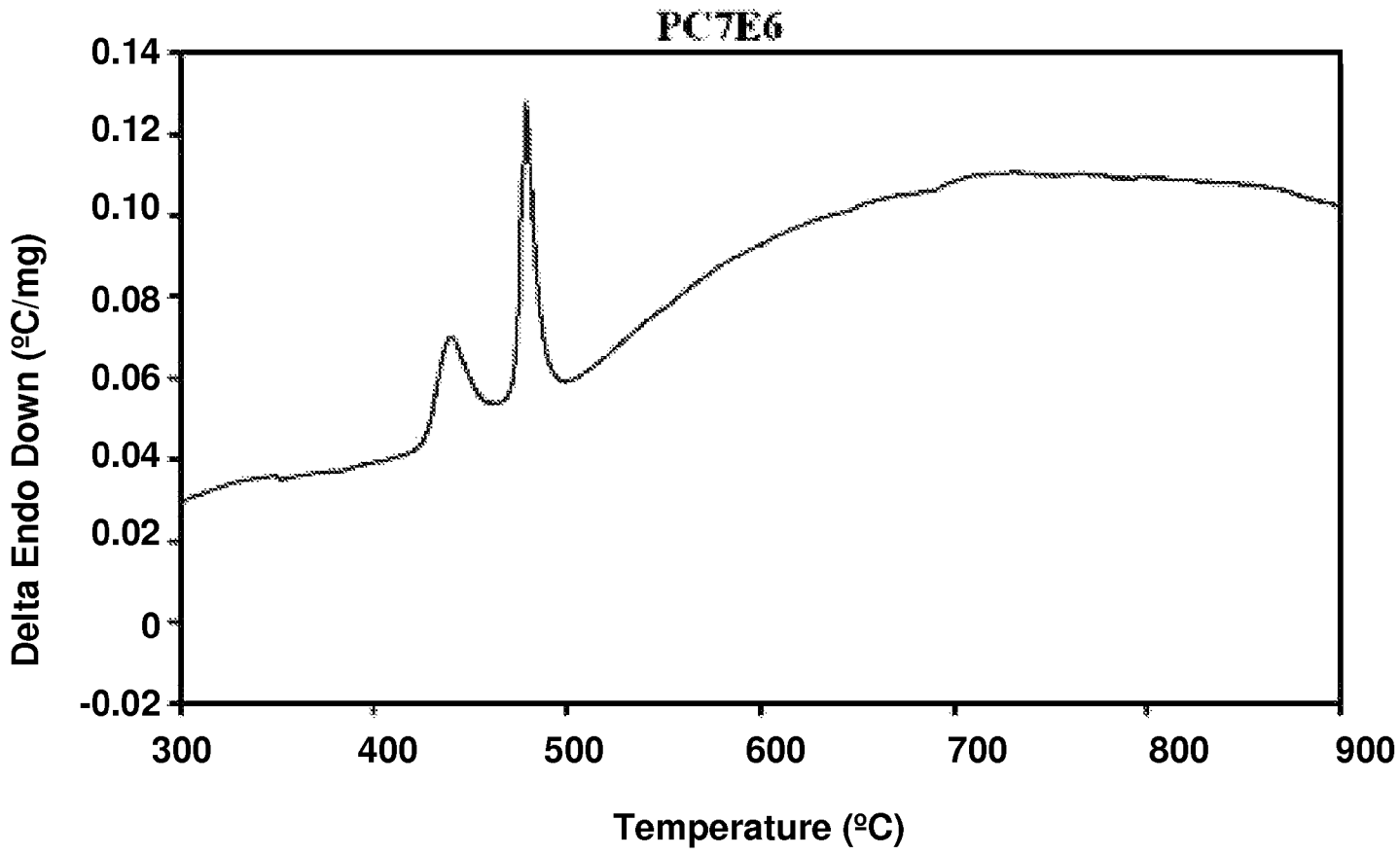
FIGS. 6*a* through 6*f* illustrate examples of DTA curves of the PC7E6 series alloys showing the presence of glass to crystalline transformation peak(s) and/or melting peak(s); a) PC7E6 melt-spun at 10.5 m/s, b) PC7E6JC melt-spun at 10.5 m/s, c) PC7E6JB melt-spun at 10.5 m/s, d) PC7E6JA melt-spun at 10.5 m/s, e) PC7E6J1 melt-spun at 10.5 m/s, and f) PC7E6J3 melt-spun at 10.5 m/s.
Figure 6B:
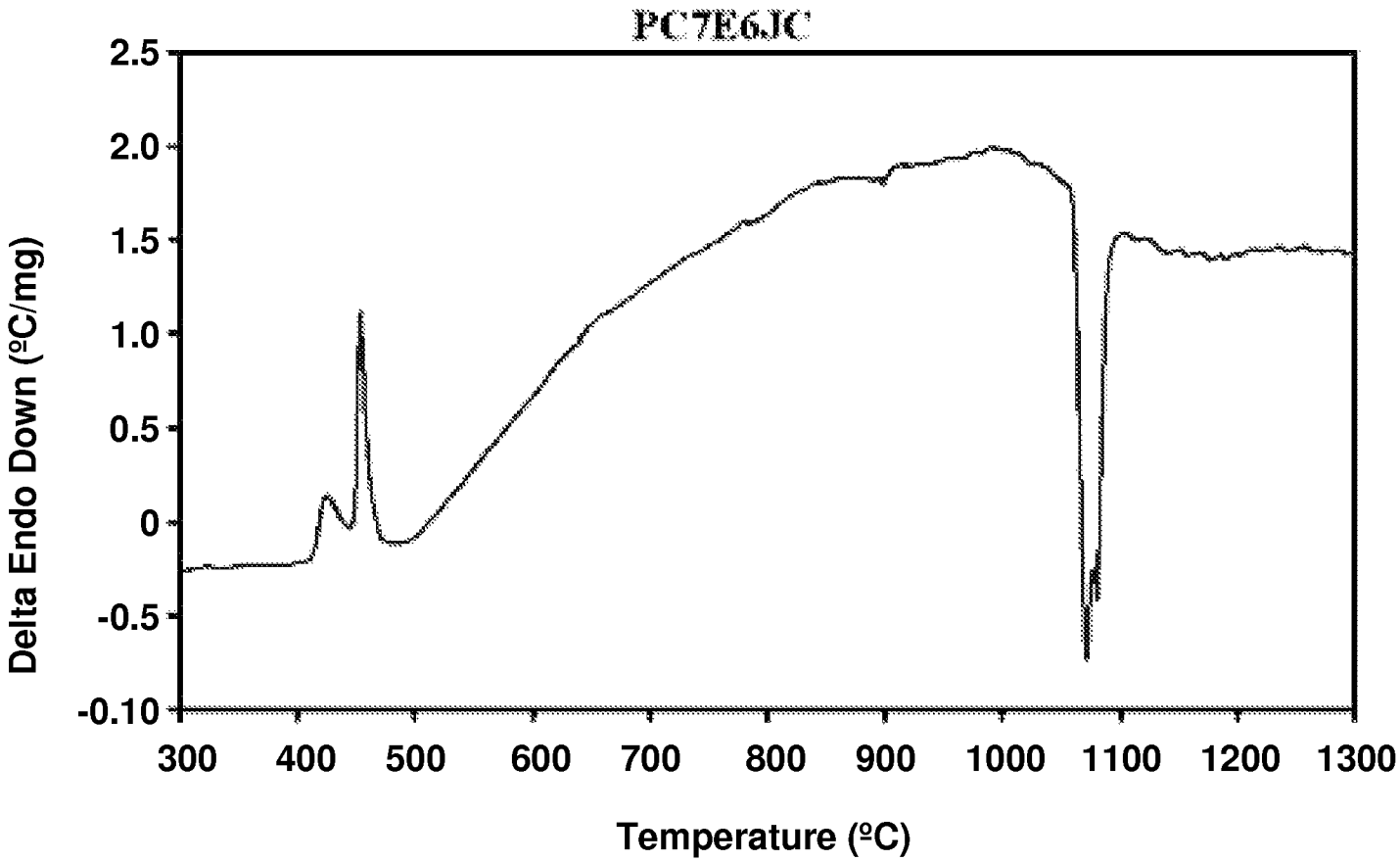
Figure 6C:
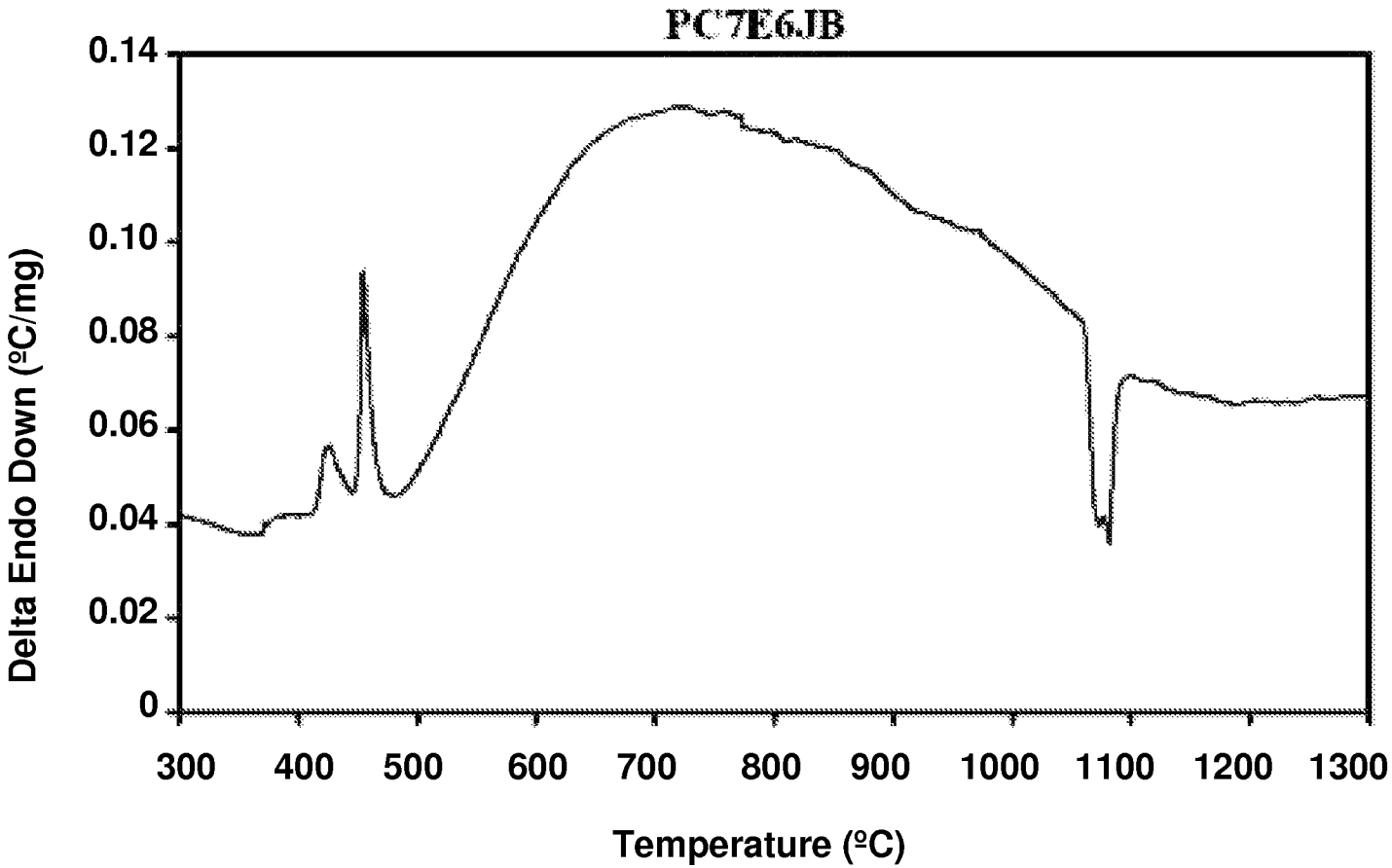
Figure 6D:
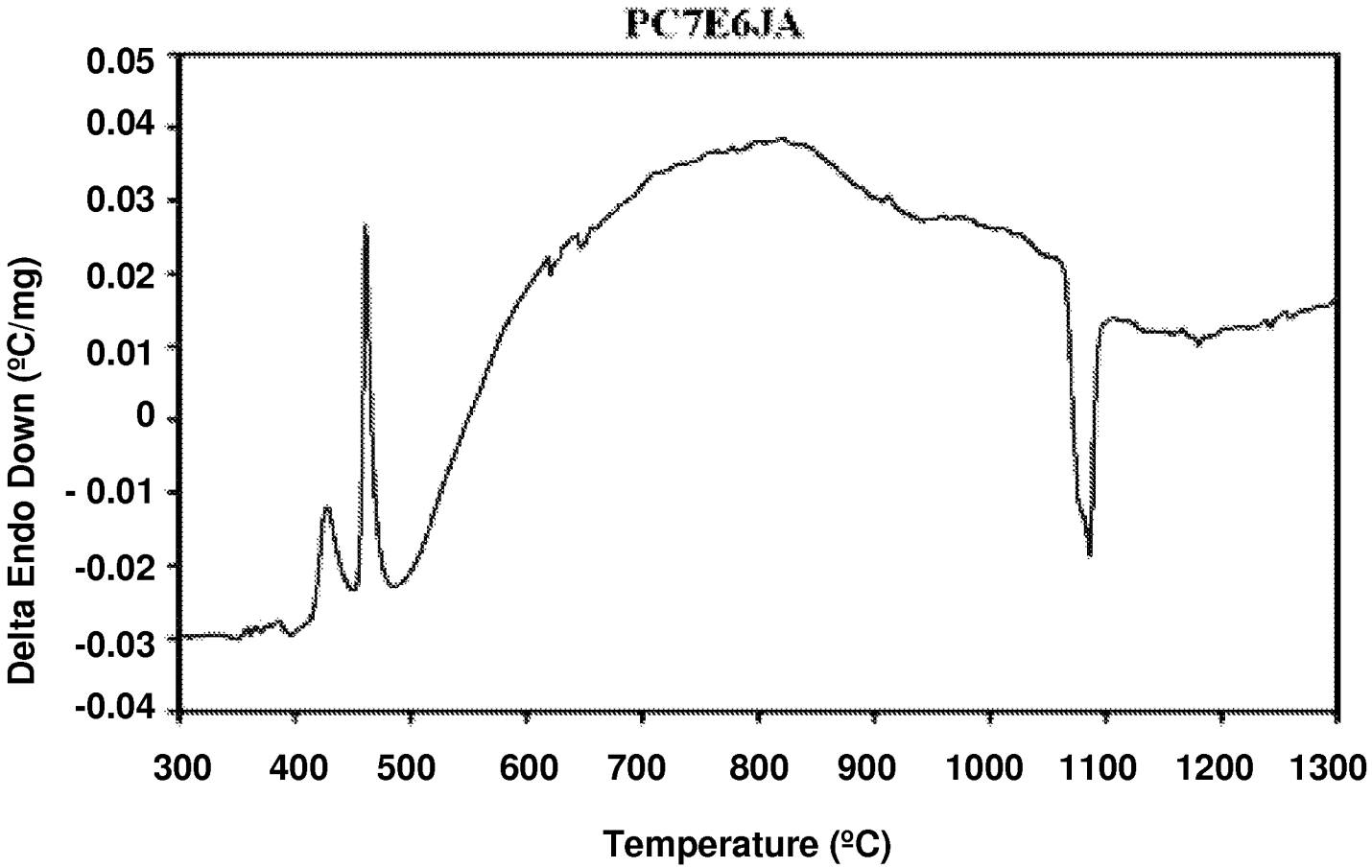
Figure 6E:
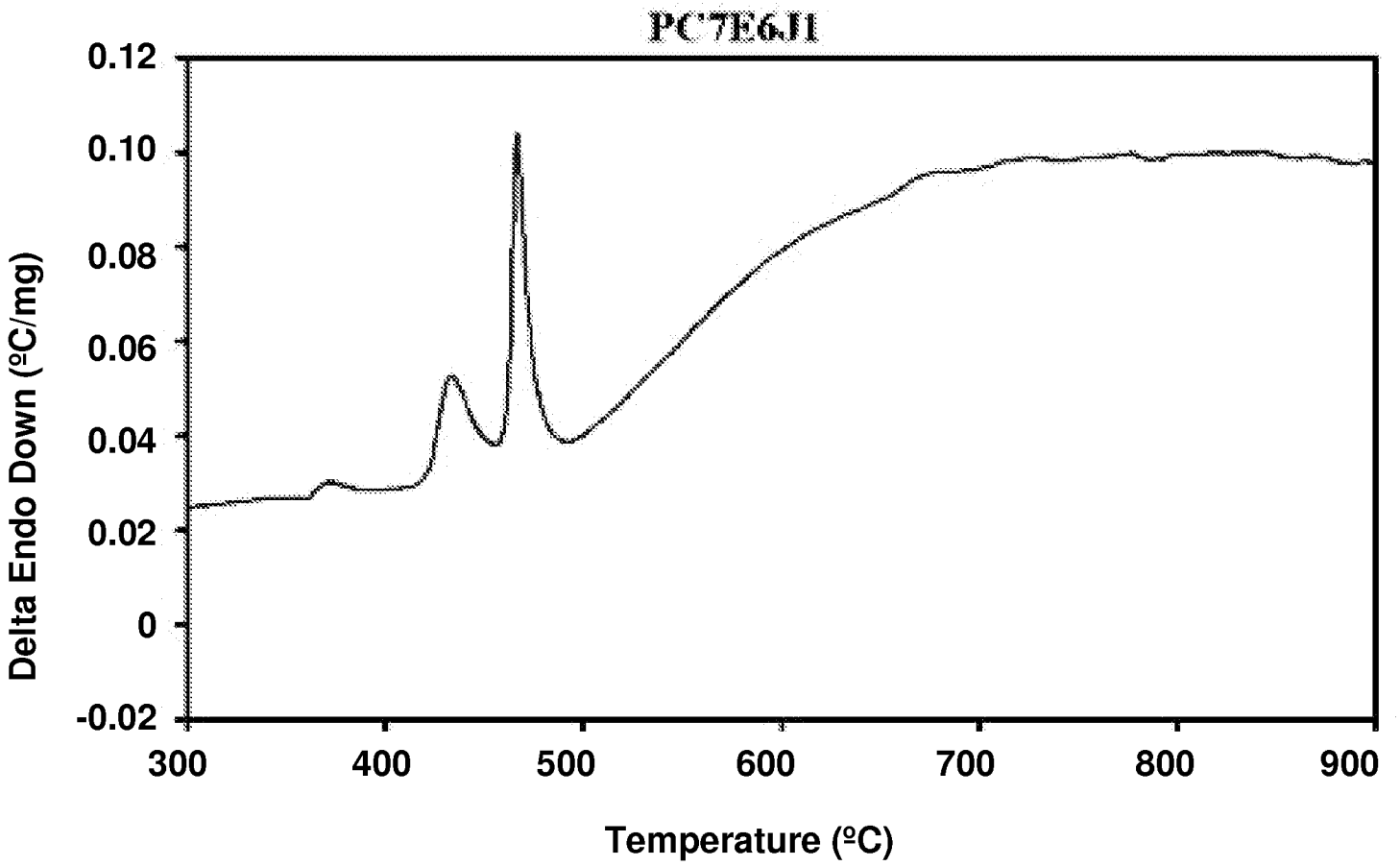
Figure 6F:
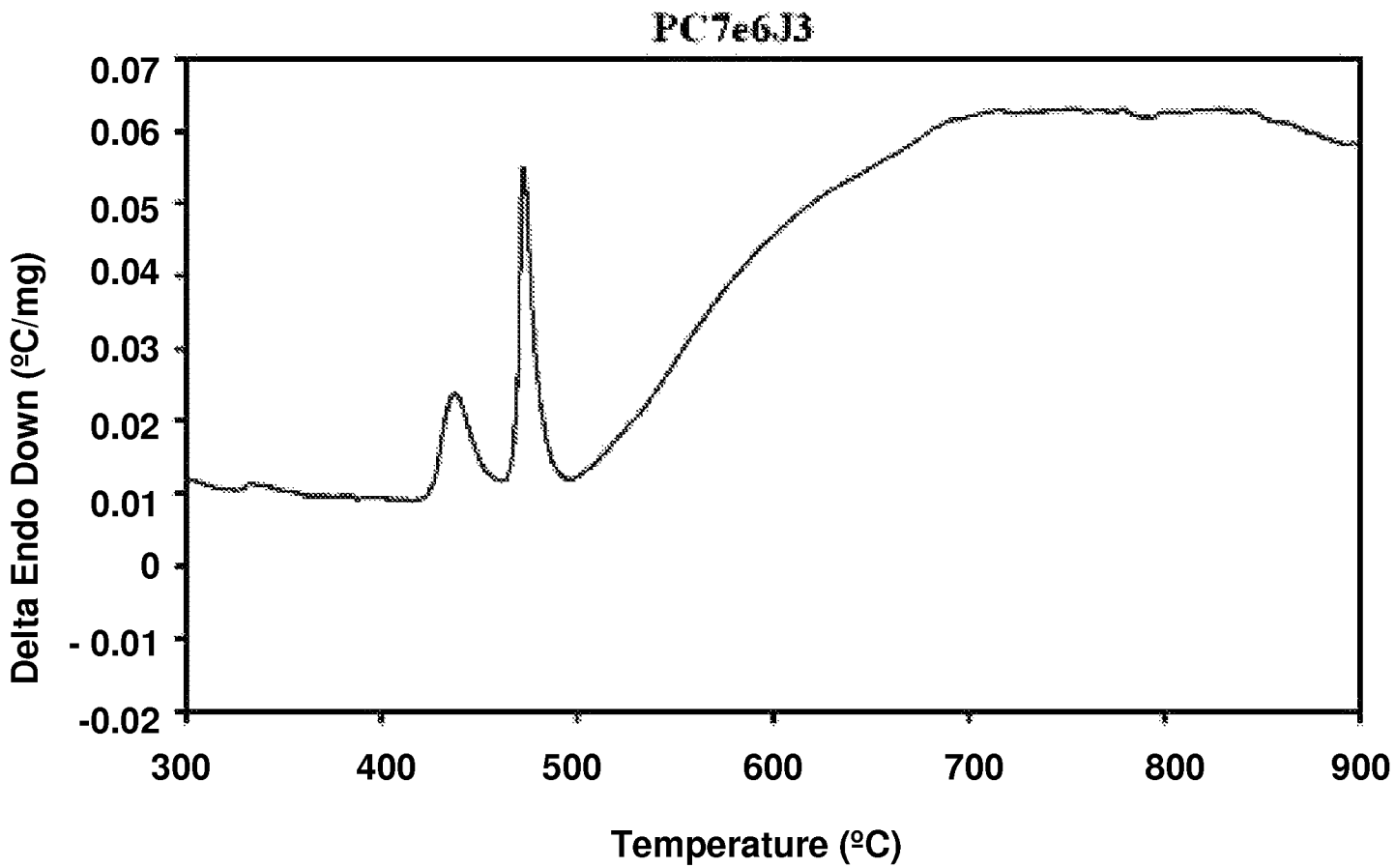
Figure 7A:
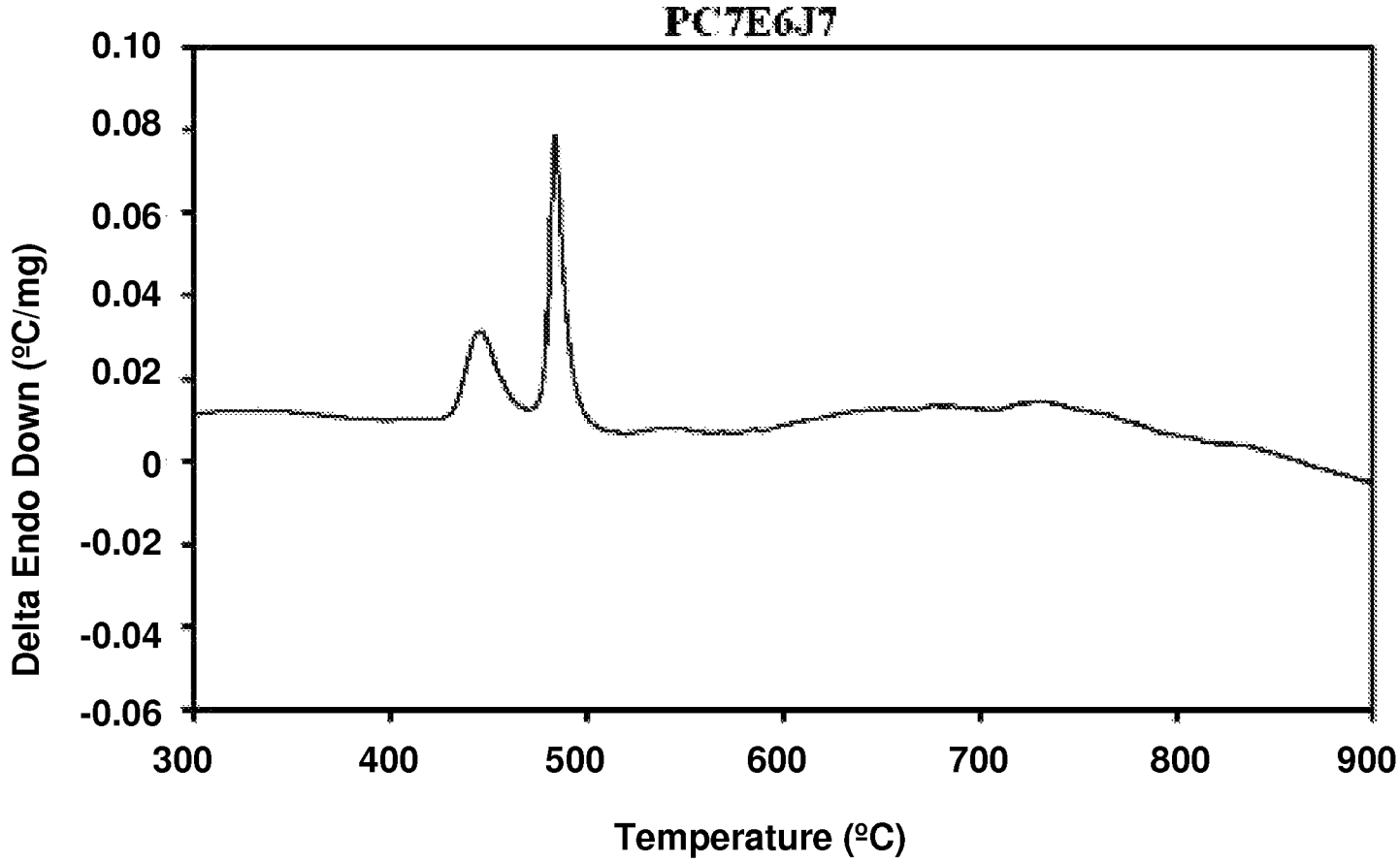
FIGS. 7*a* through 7*f* illustrate examples of DTA curves of the PC7E6 series alloys showing the presence of glass to crystalline transformation peak(s) and/or melting peak(s); a) PC7E6J7 melt-spun at 10.5 m/s, b) PC7E6J9 melt-spun at 10.5 m/s, c) PC7E6H1 melt-spun at 10.5 m/s, d) PC7E6H3 melt-spun at 10.5 m/s, e) PC7E6H7 melt-spun at 10.5 m/s, and f) PC7E6H9 melt-spun at 10.5 m/s.
Figure 7B:
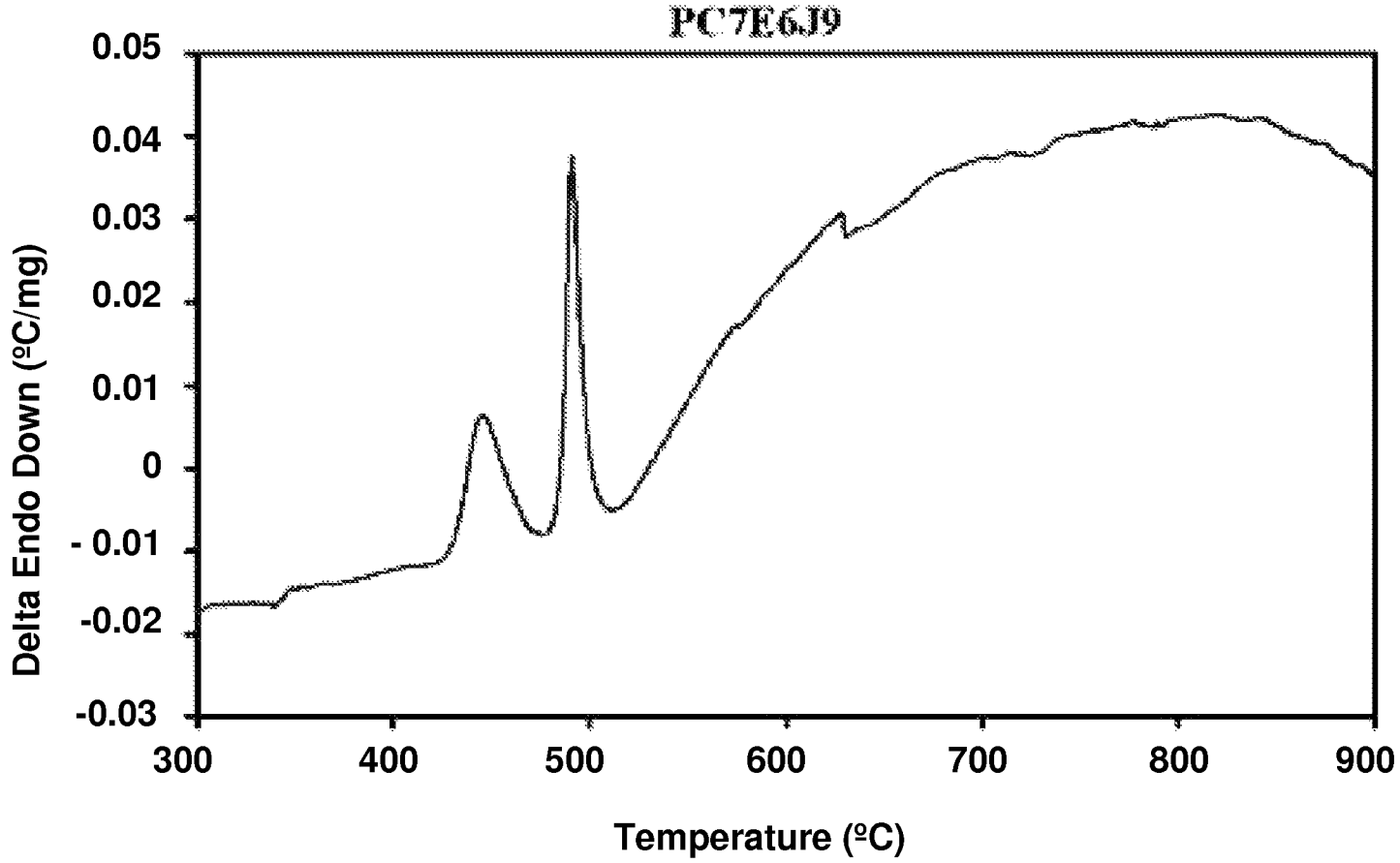
Figure 7C:
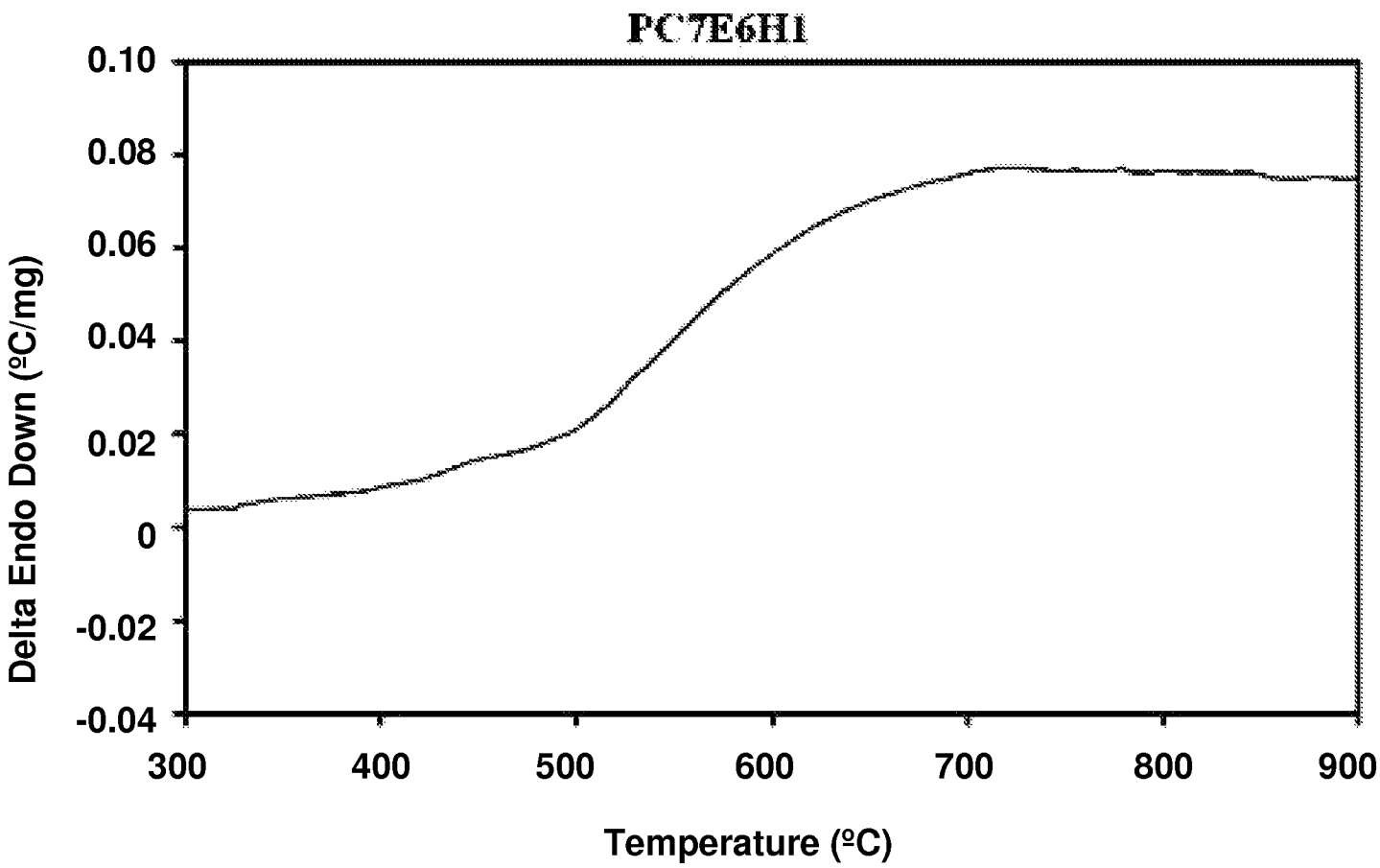
Figure 7D:
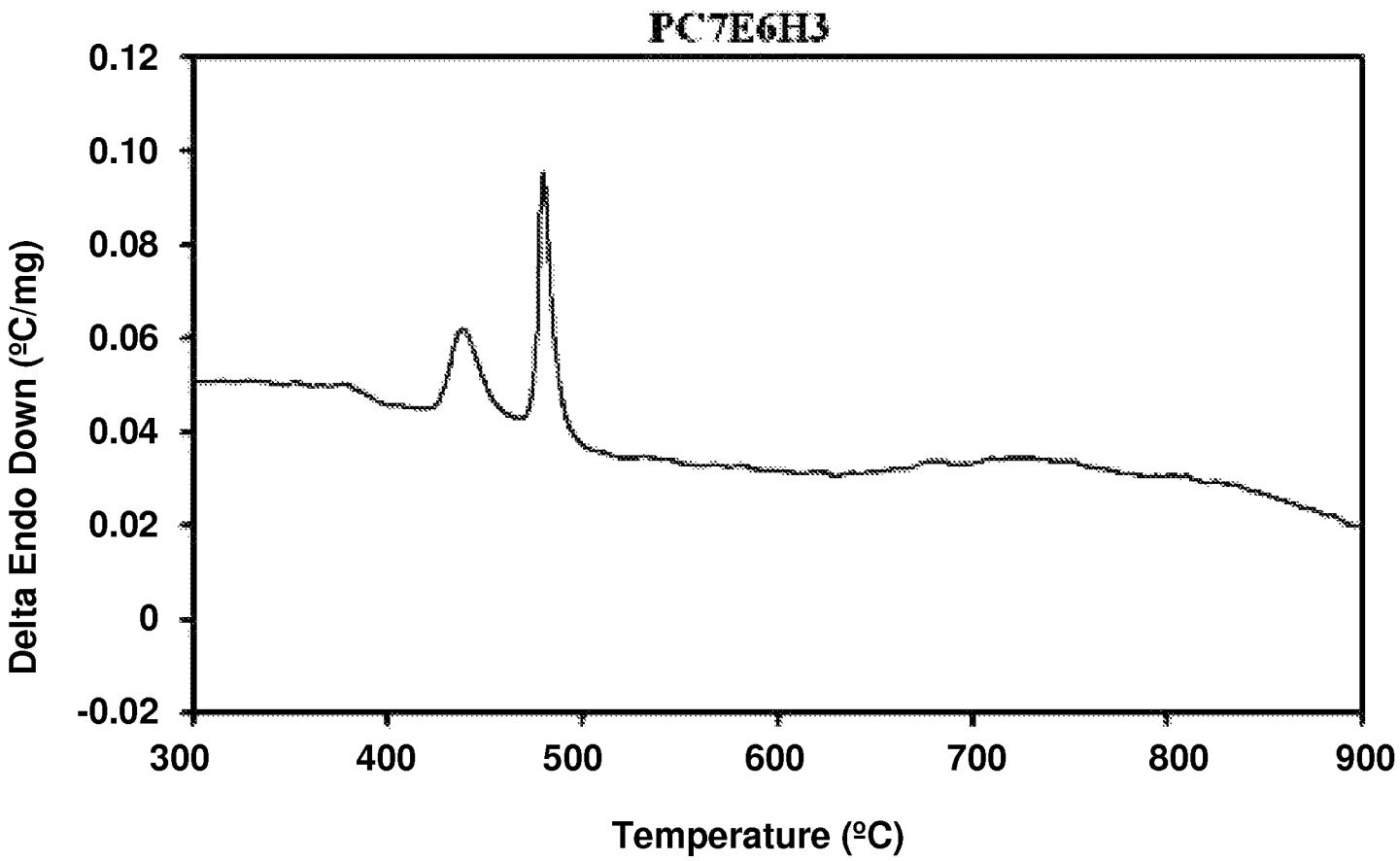
Figure 7E:
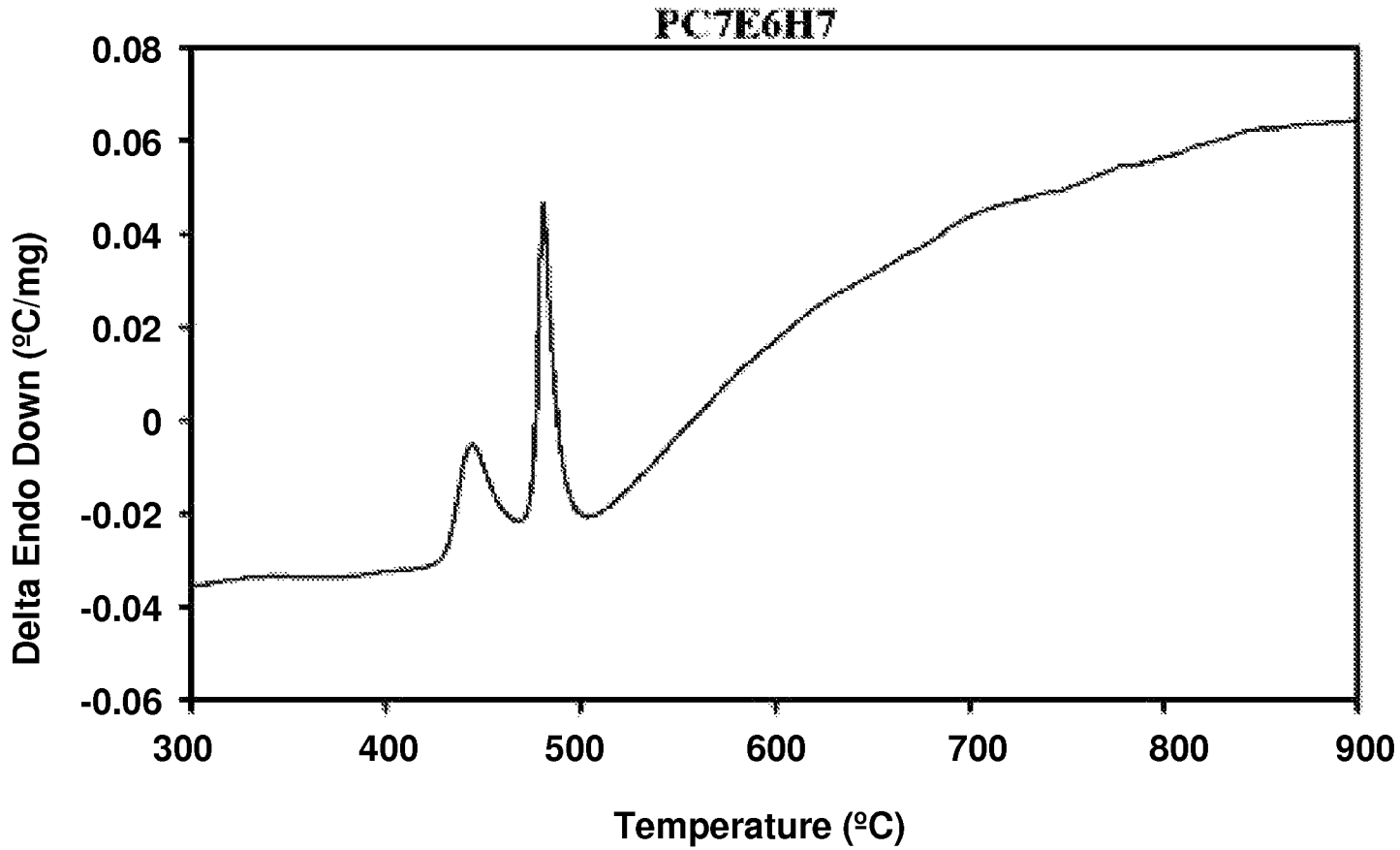
Figure 7F:
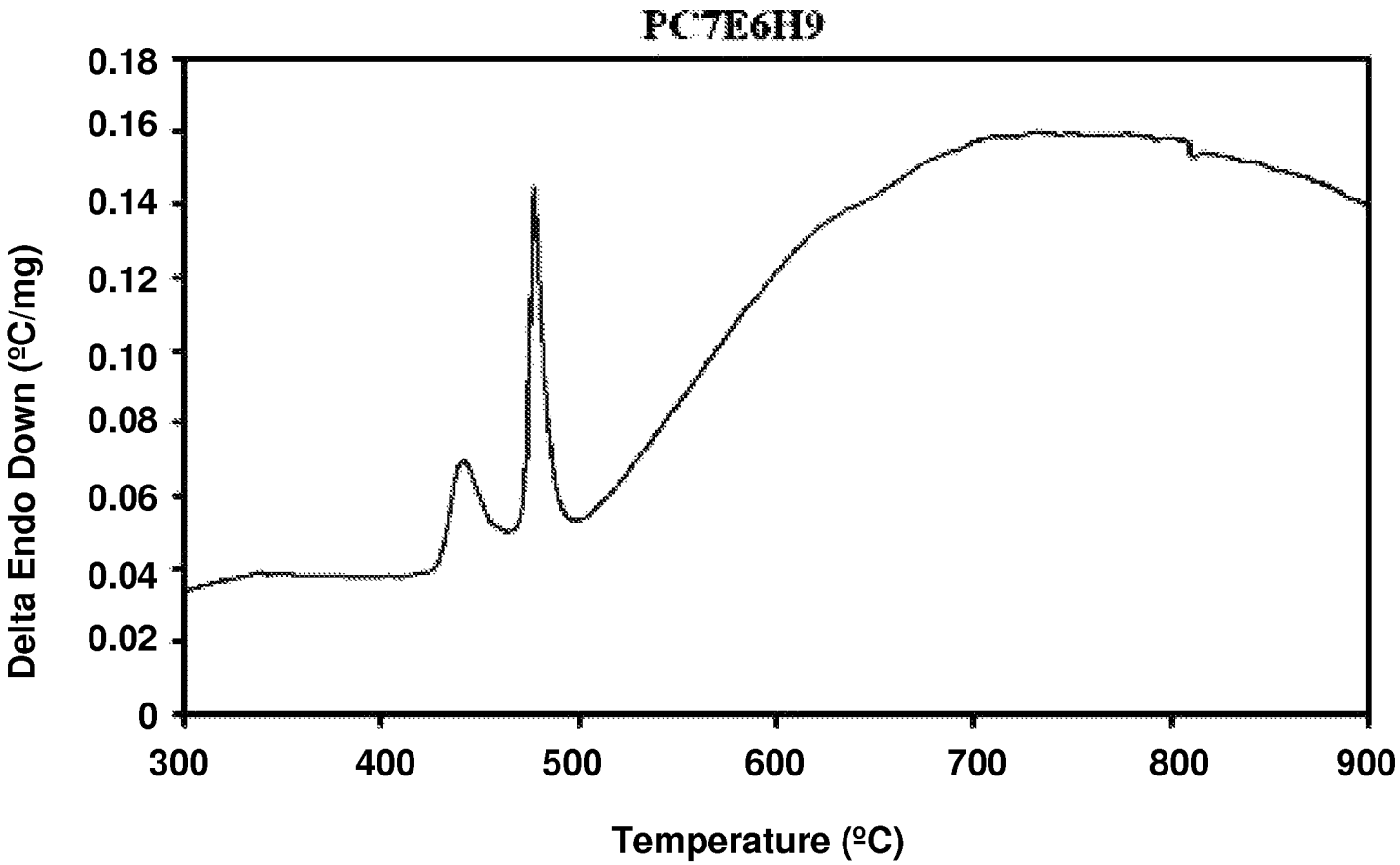
Figure 8A:
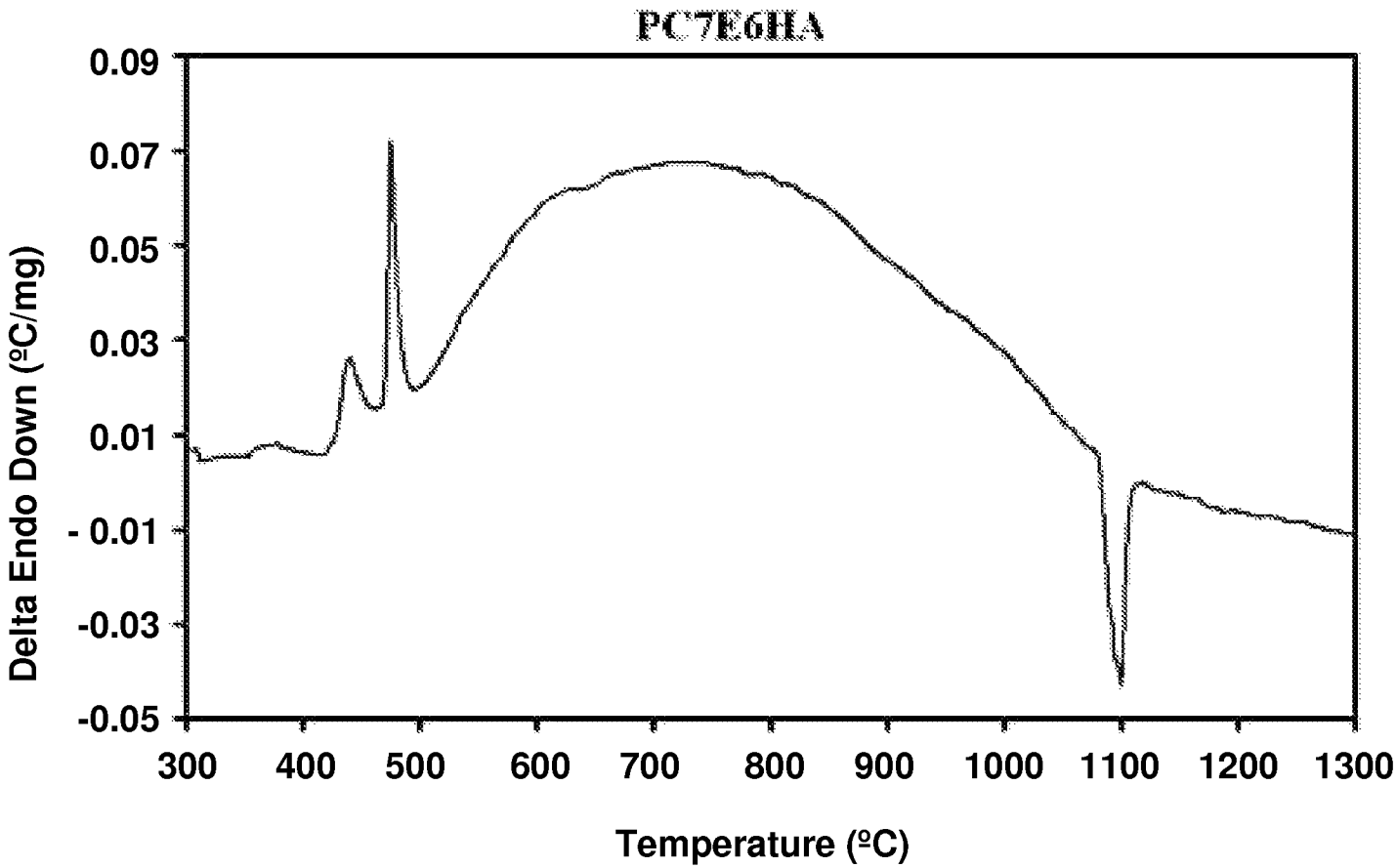
FIGS. 8*a* through 8*f* illustrate examples of DTA curves of the PC7E6 series alloys showing the presence of glass to crystalline transformation peak(s) and/or melting peak(s); a) PC7E6HA melt-spun at 10.5 m/s, b) PC7E6HB melt-spun at 10.5 m/s, c) PC7E6HC melt-spun at 10.5 m/s, d) PC7E6J1H9 melt-spun at 10.5 m/s, e) PC7E6J3H9 melt-spun at 10.5 m/s, and f) PC7E6J7H9 melt-spun at 10.5 m/s.
Figure 8B:
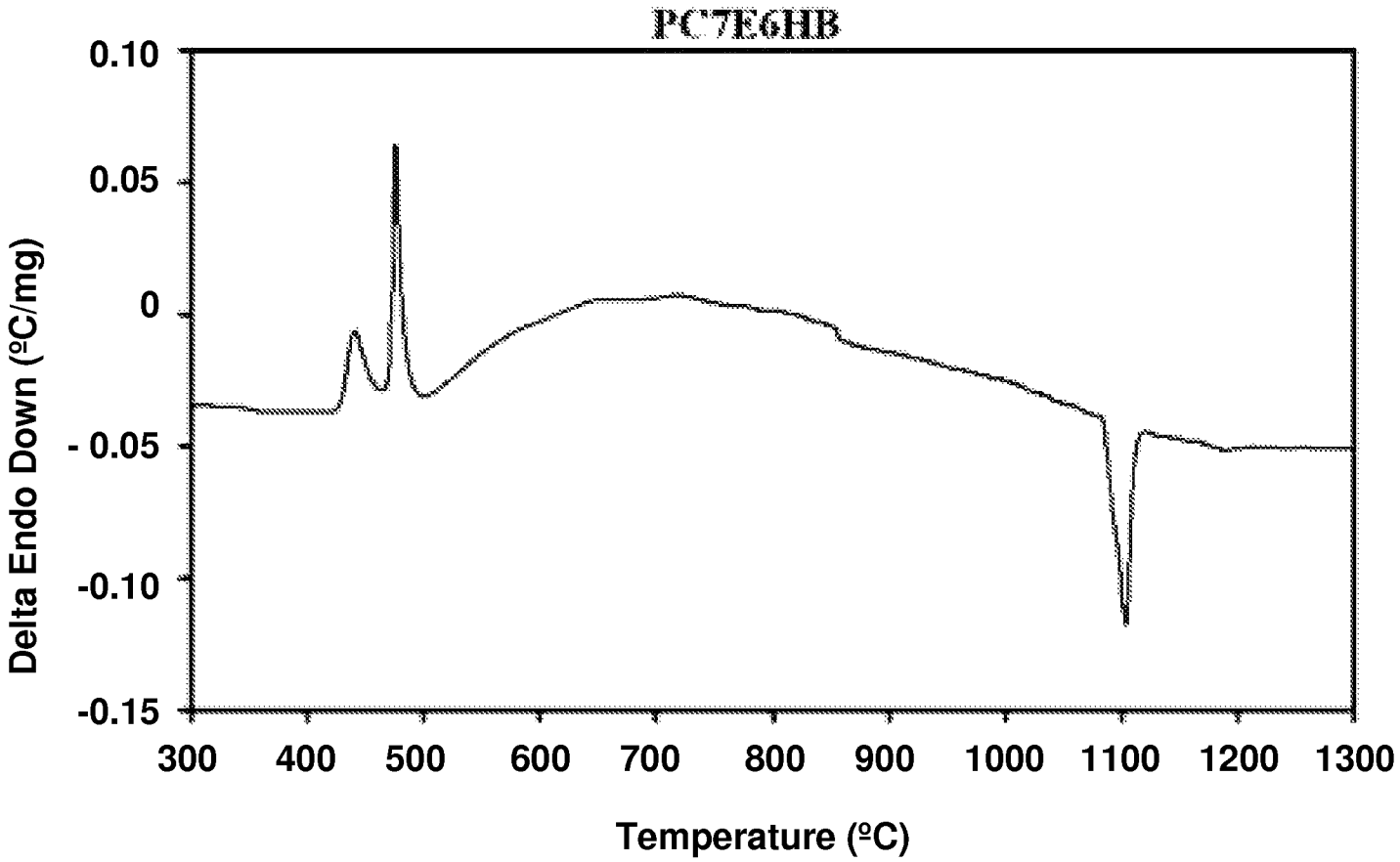
Figure 8C:
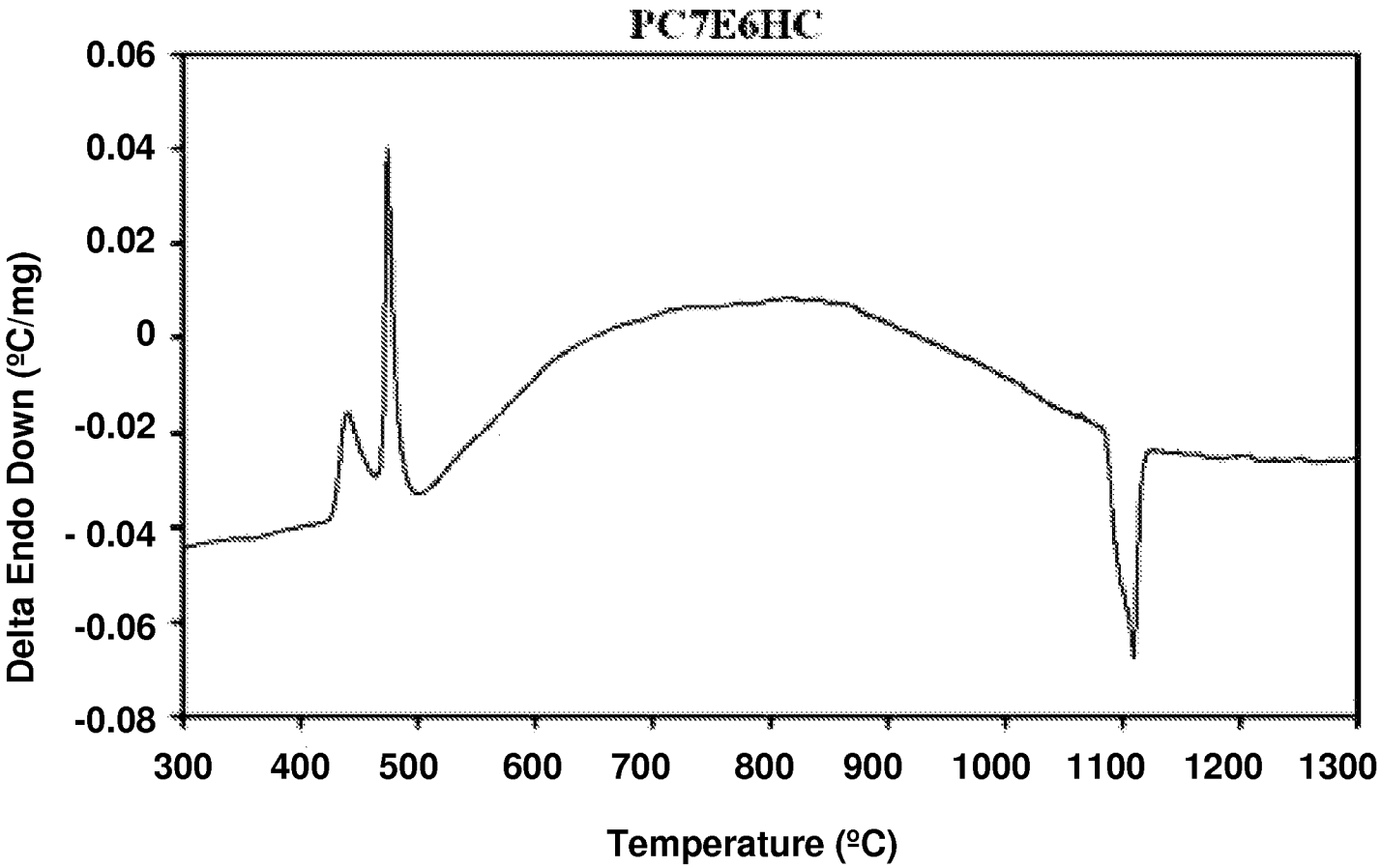
Figure 8D:
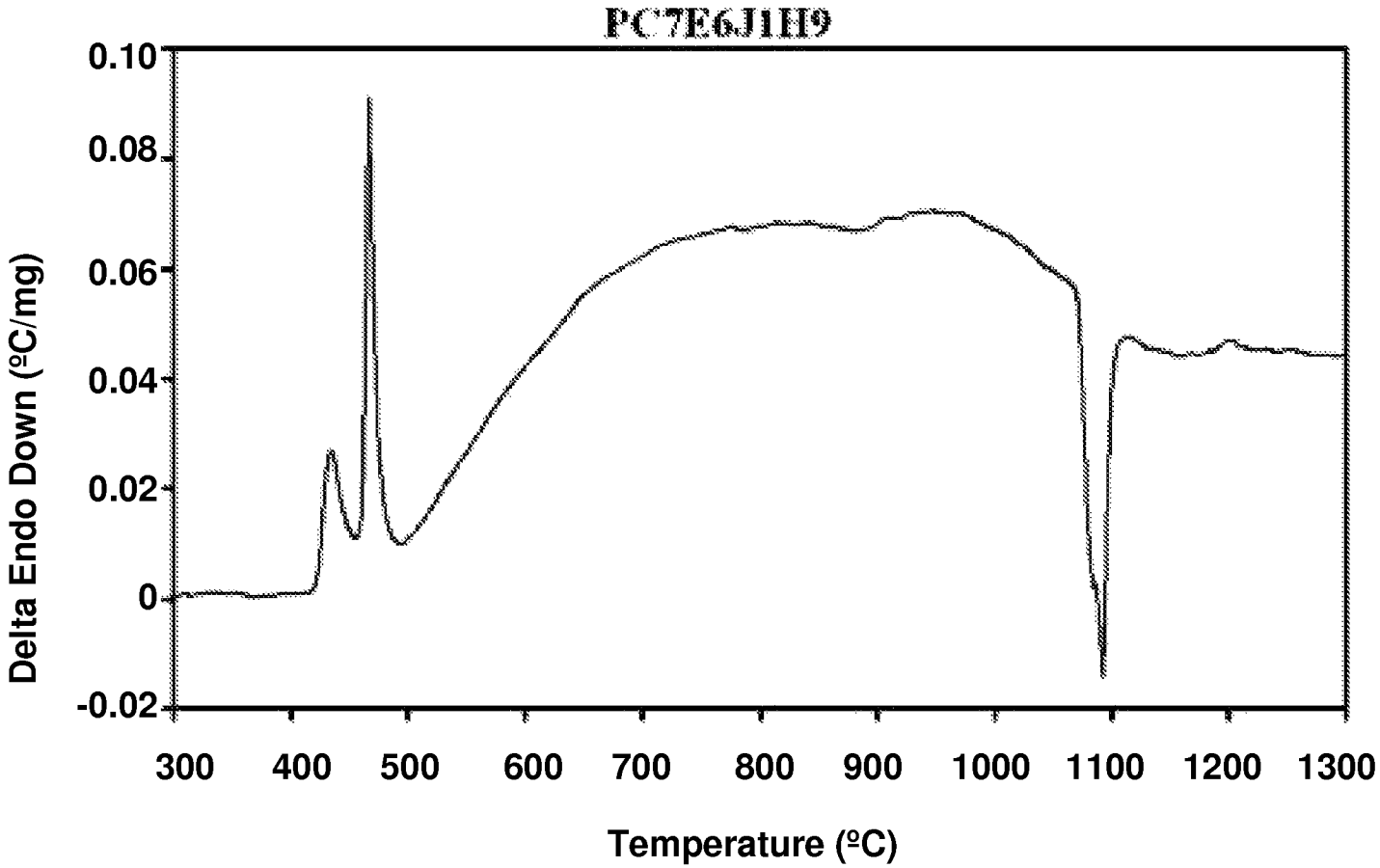
Figure 8E:
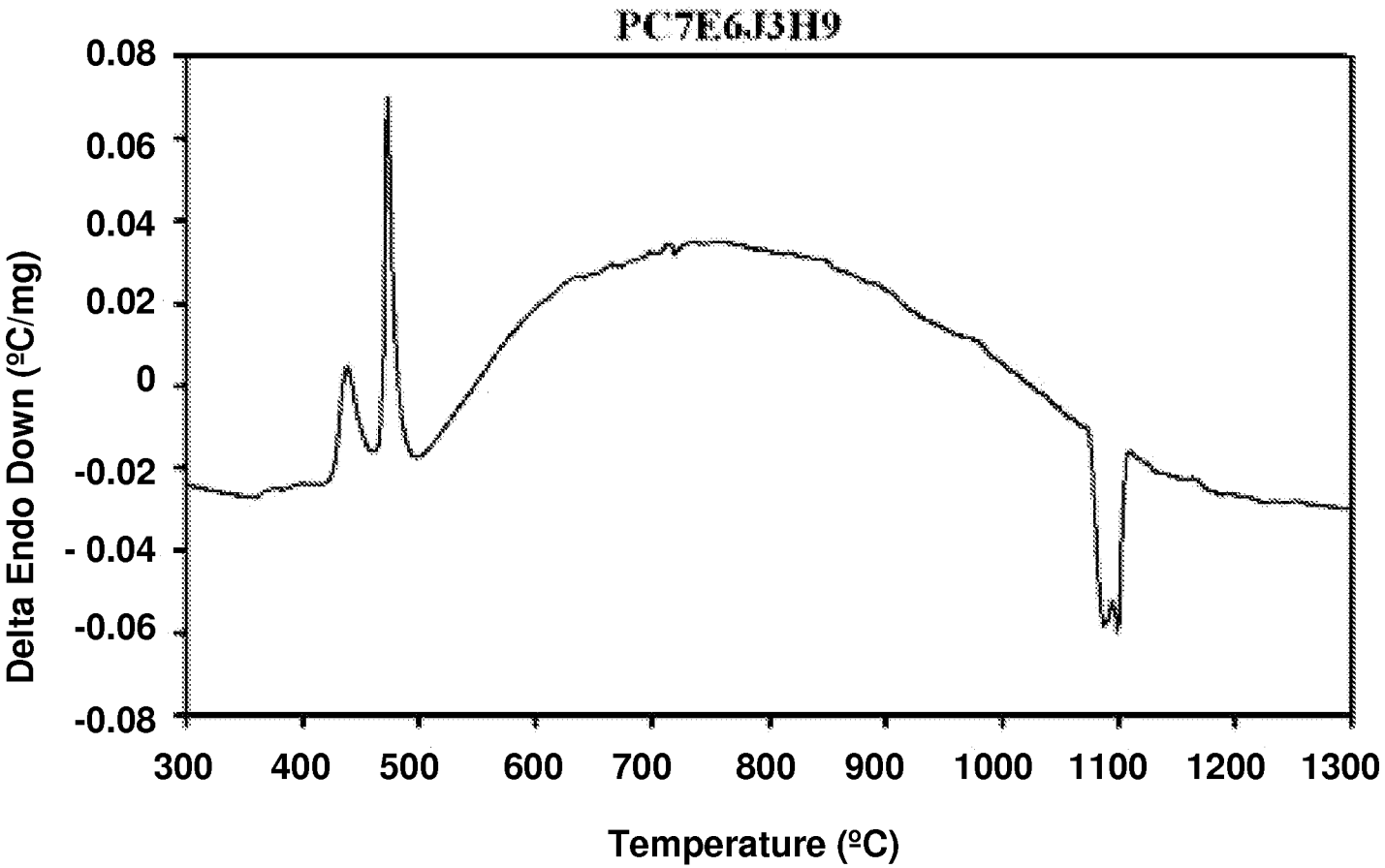
Figure 8F:
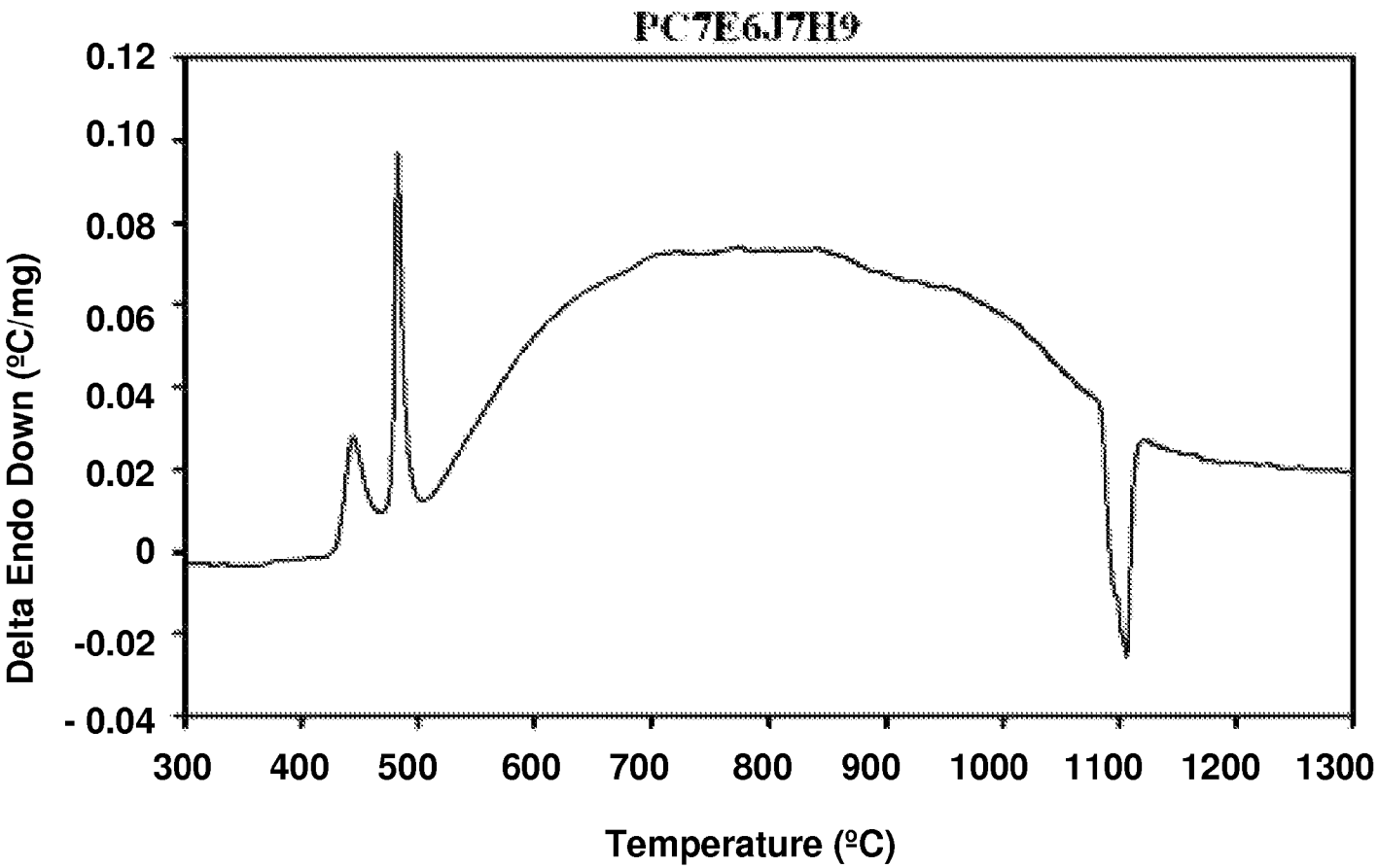
Figure 9A:
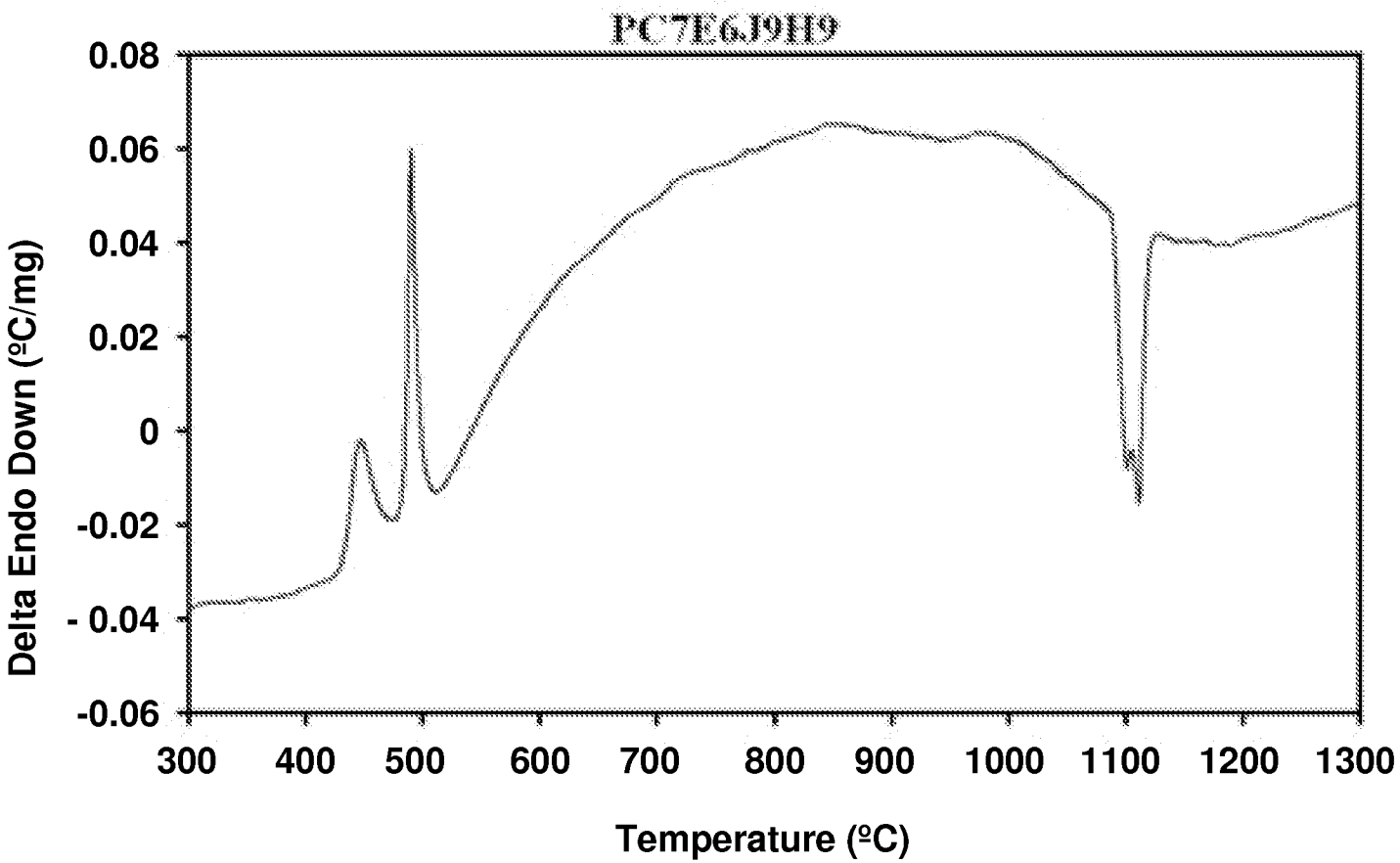
FIGS. 9*a* through 9*f* illustrate examples of DTA curves of the PC7E6 series alloys showing the presence of glass to crystalline transformation peak(s) and/or melting peak(s); a) PC7E6J9H9 melt-spun at 10.5 m/s, b) PC7E6J1HA melt-spun at 10.5 m/s, c) PC7E6J3HA melt-spun at 10.5 m/s, d) PC7E6J7HA melt-spun at 10.5 m/s, e) PC7E6J9HA melt-spun at 10.5 m/s, and f) PC7E6J1HB melt-spun at 10.5 m/s.
Figure 9B:
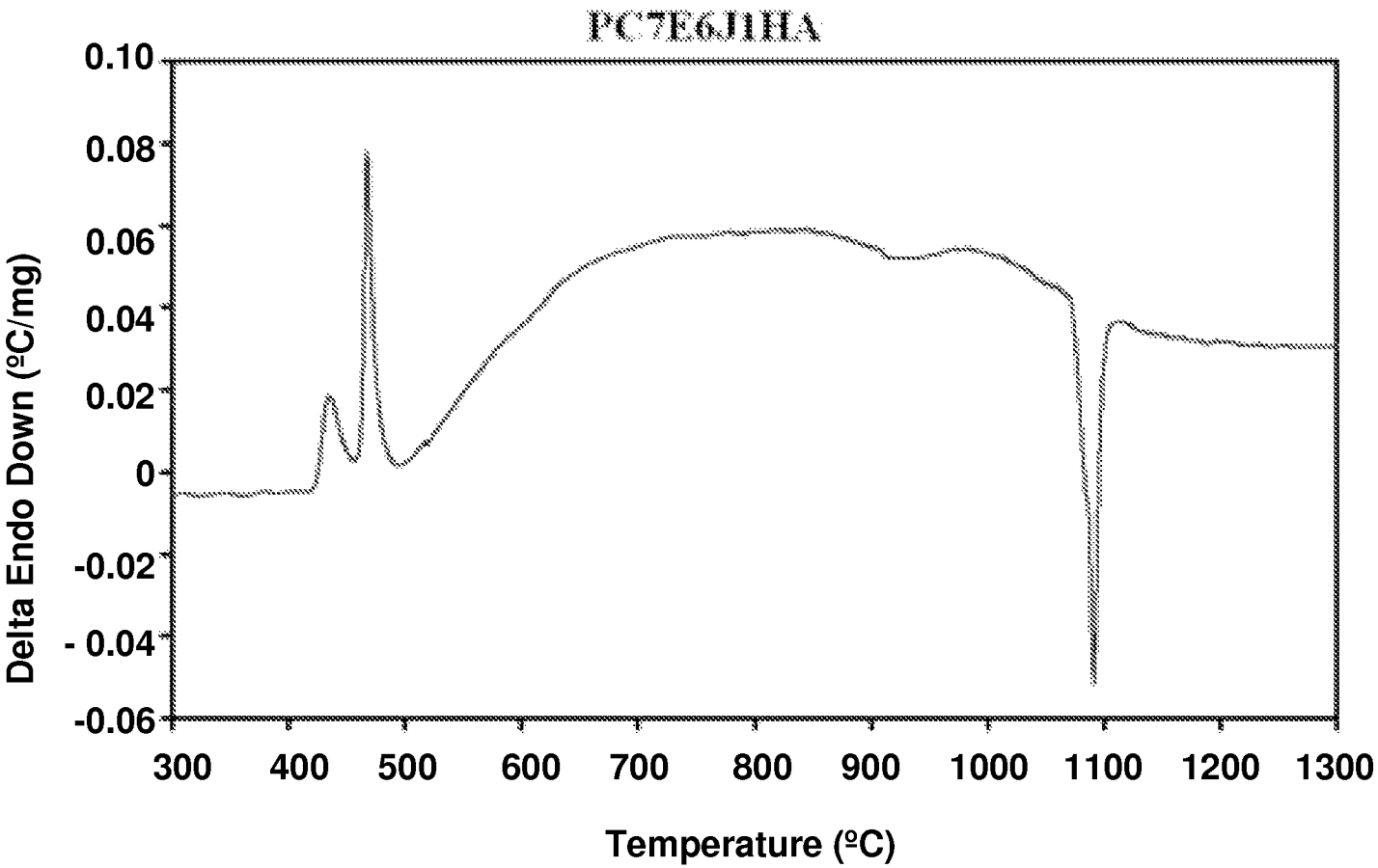
Figure 9C:
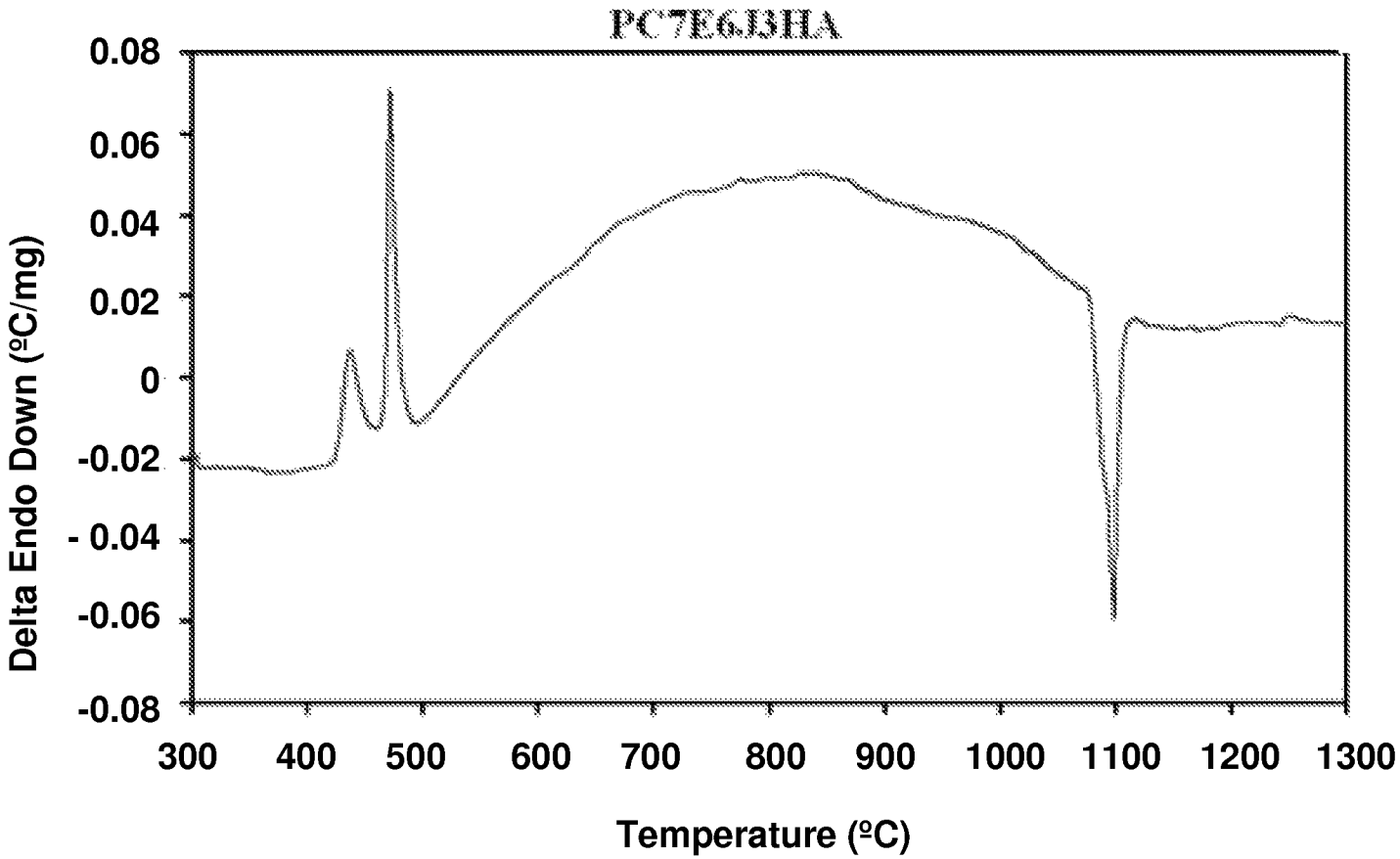
Figure 9D:
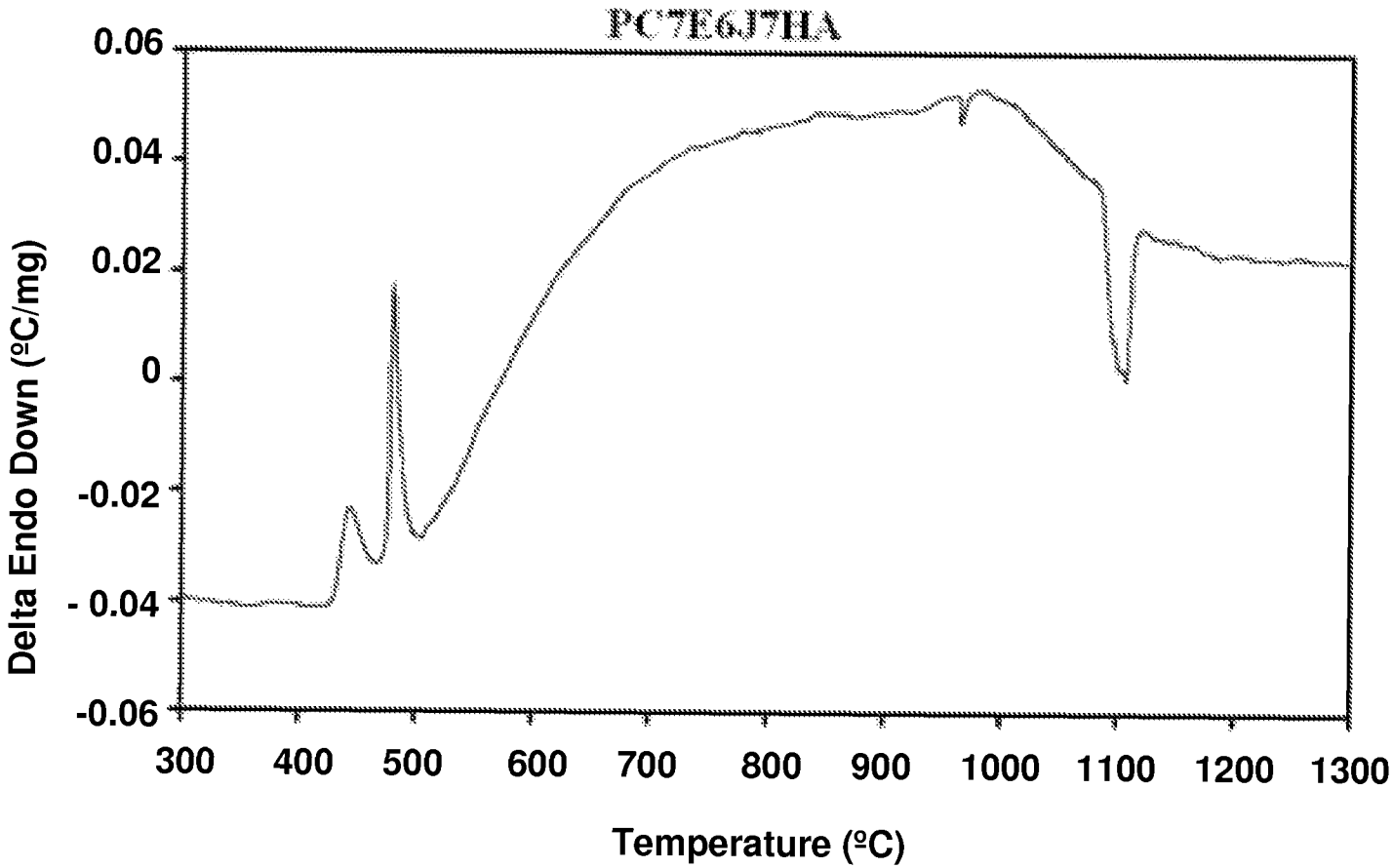
Figure 9E:
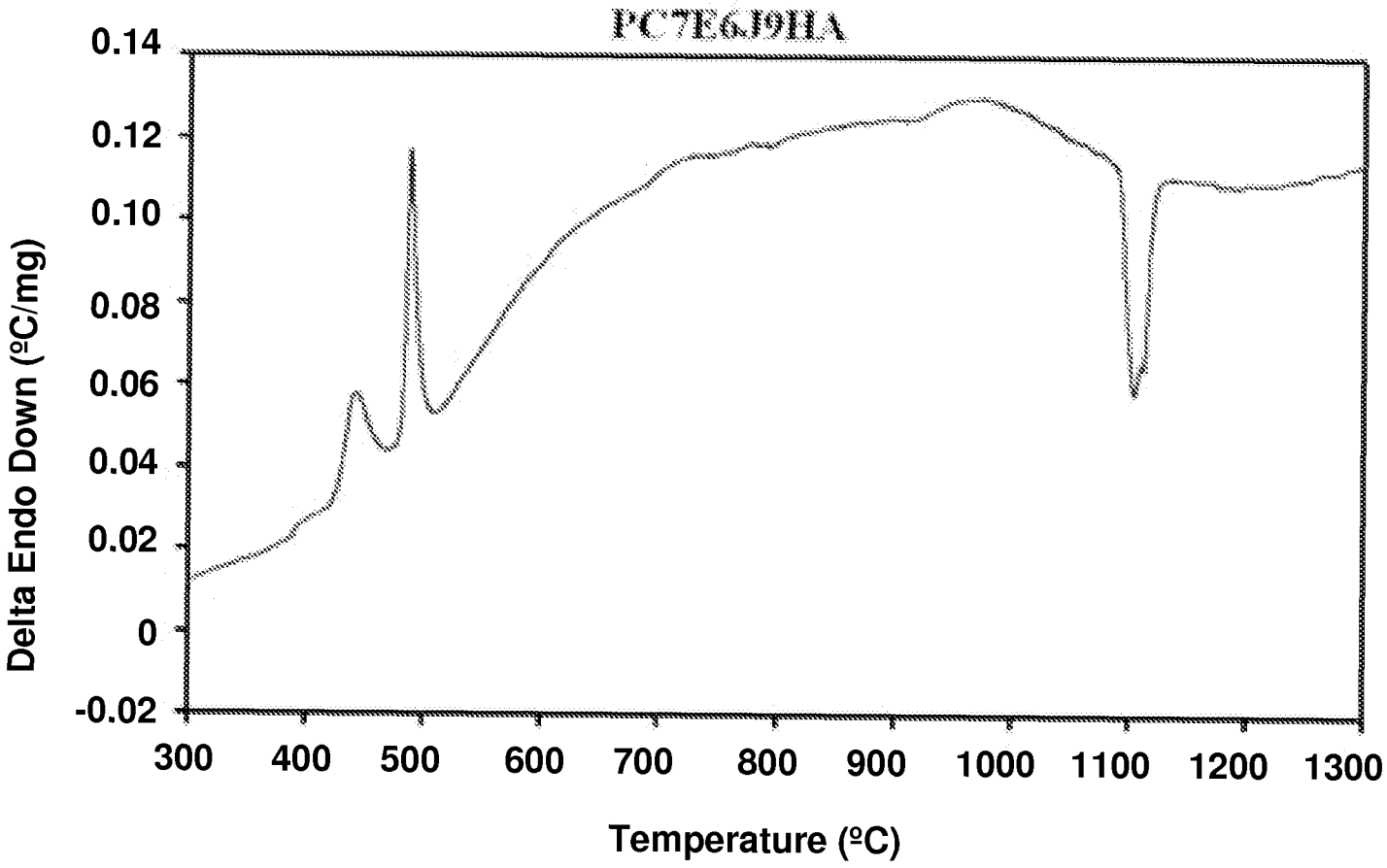
Figure 9F:
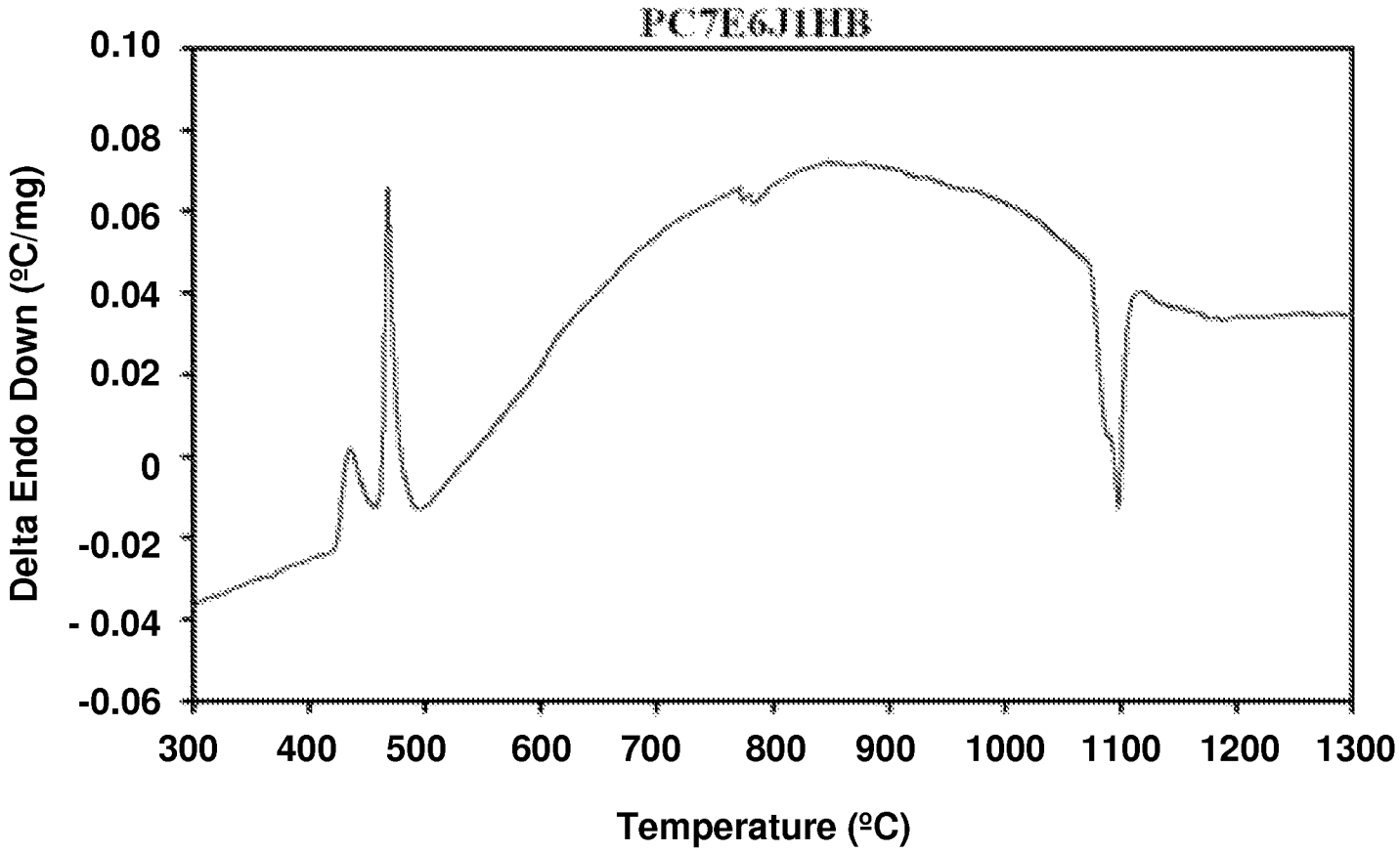
Figure 10A:
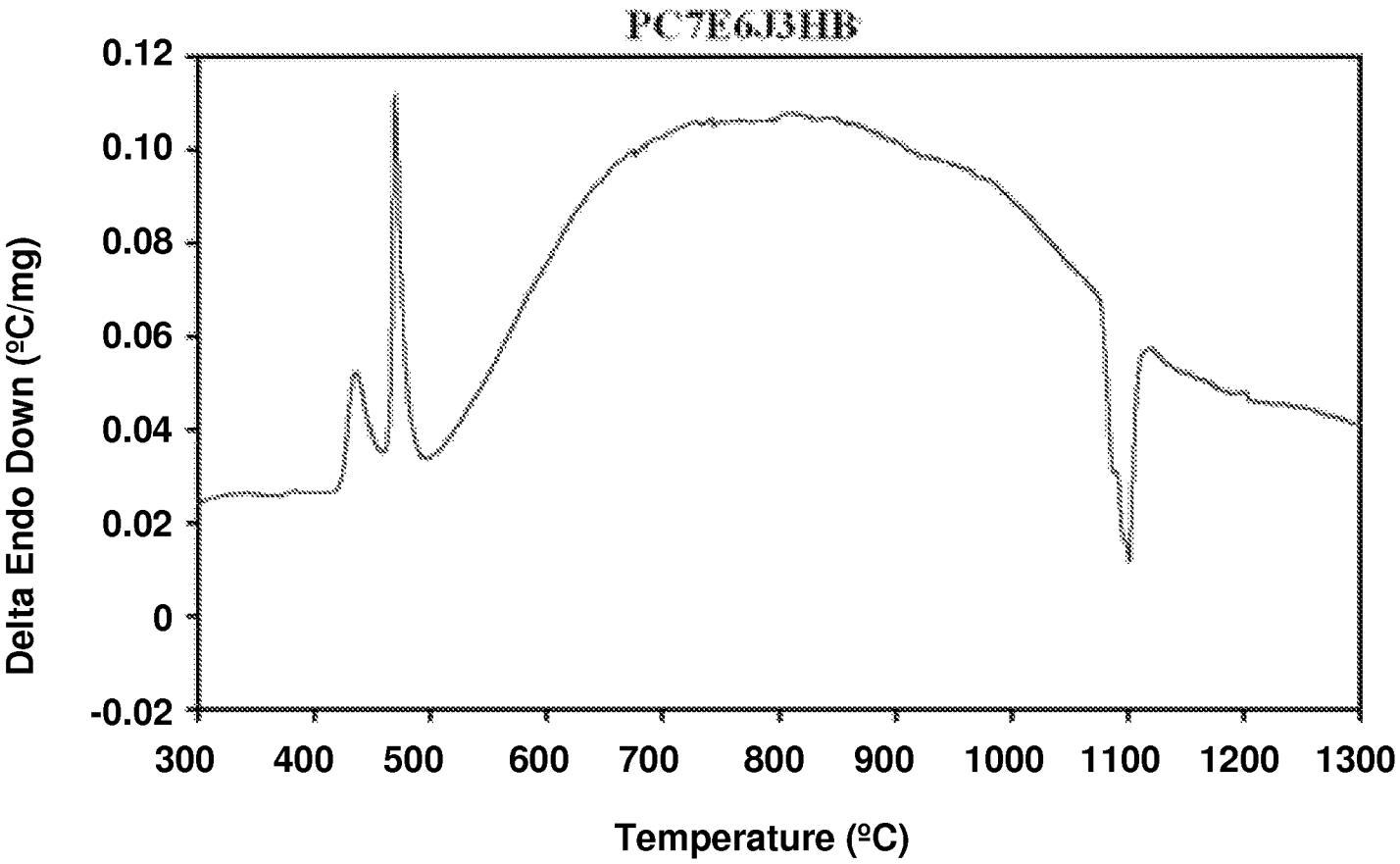
FIGS. 10*a* through 10*f* illustrate examples of DTA curves of the PC7E6 series alloys showing the presence of glass to crystalline transformation peak(s) and/or melting peak(s); a) PC7E6J3HB melt-spun at 10.5 m/s, b) PC7E6J7HB melt-spun at 10.5 m/s, c) PC7E6J1HC melt-spun at 10.5 m/s, d) PC7E7 melt-spun at 10.5 m/s.
Figure 10B:
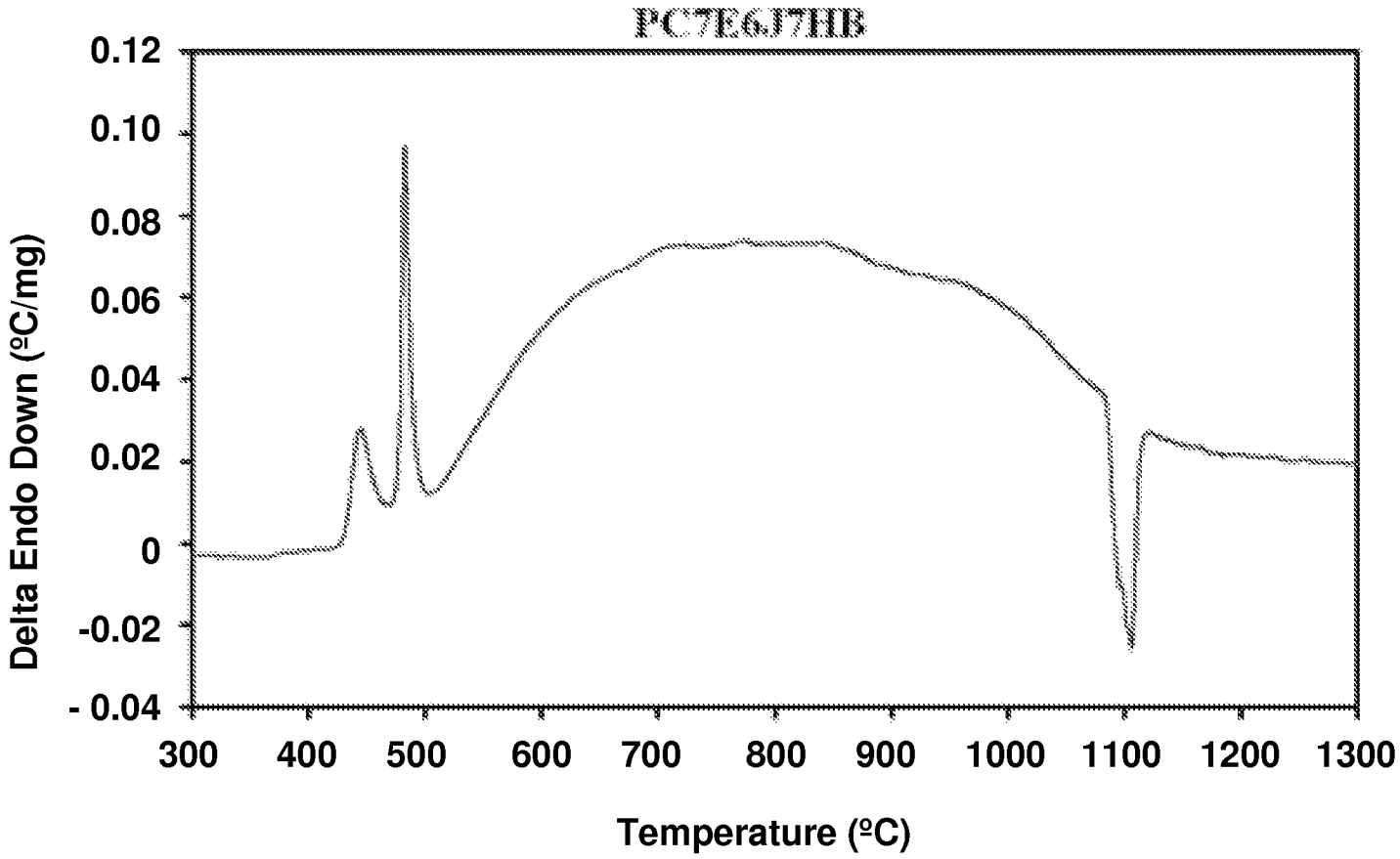
Figure 10C:
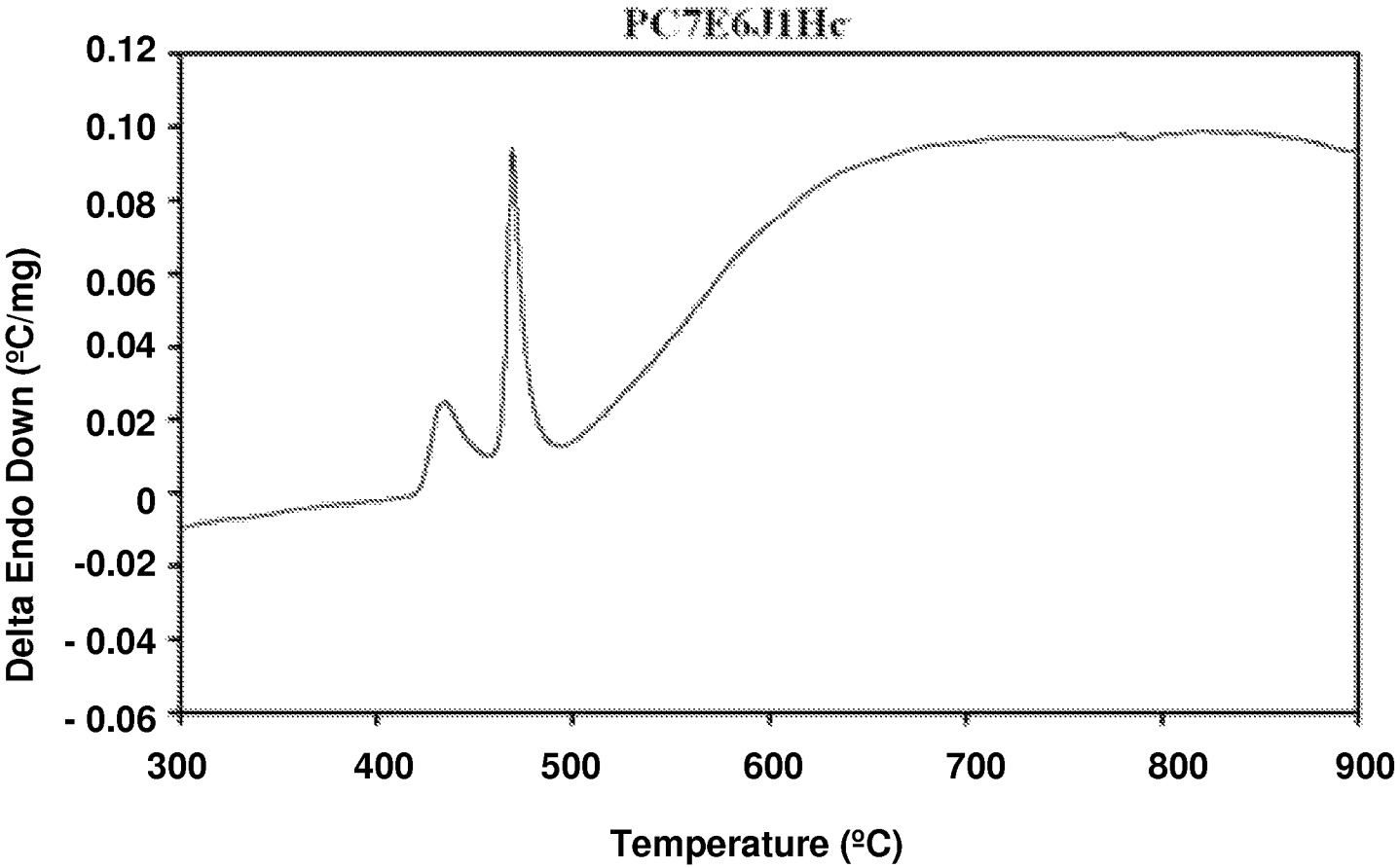
Figure 10D:
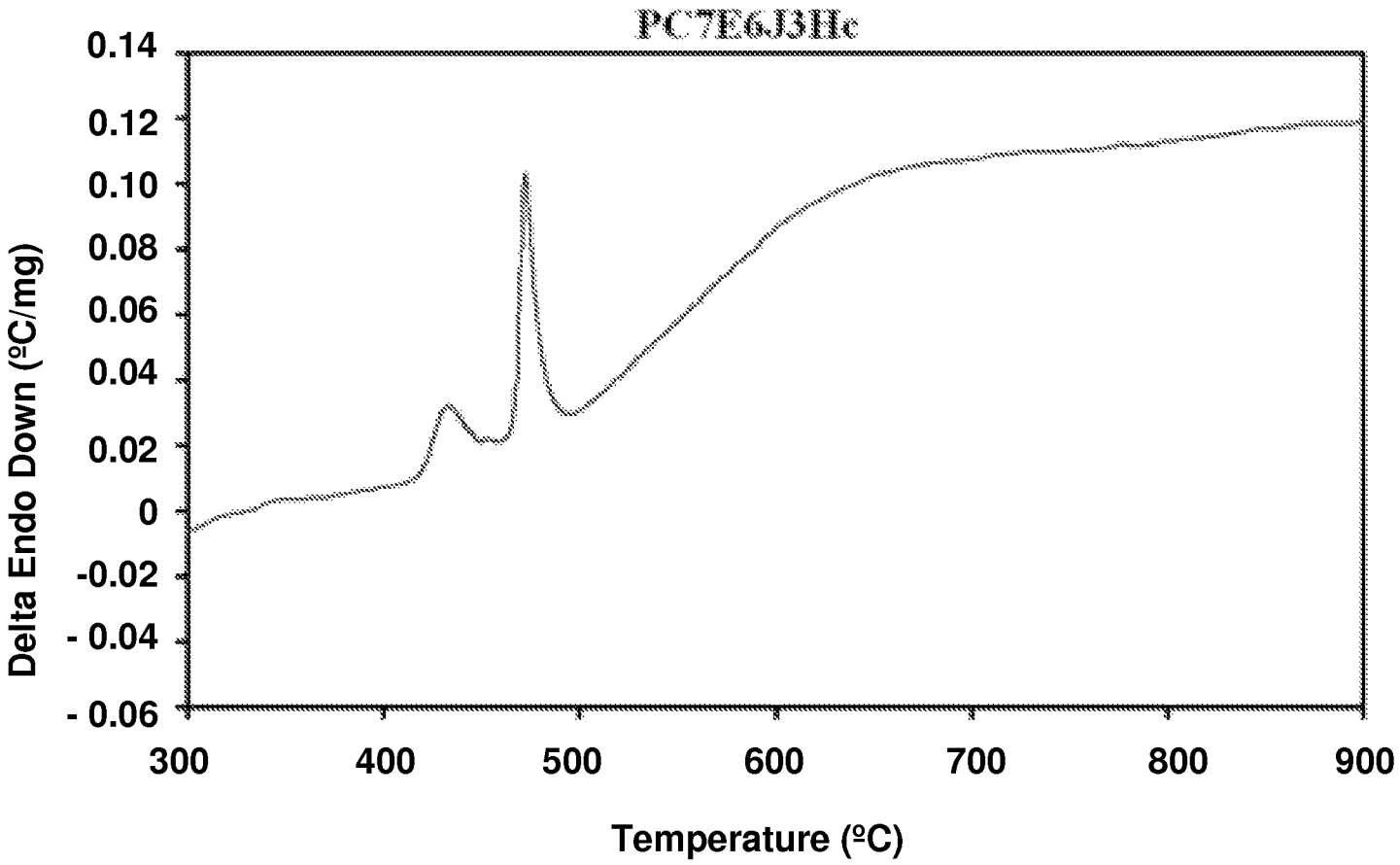
Figure 10E:
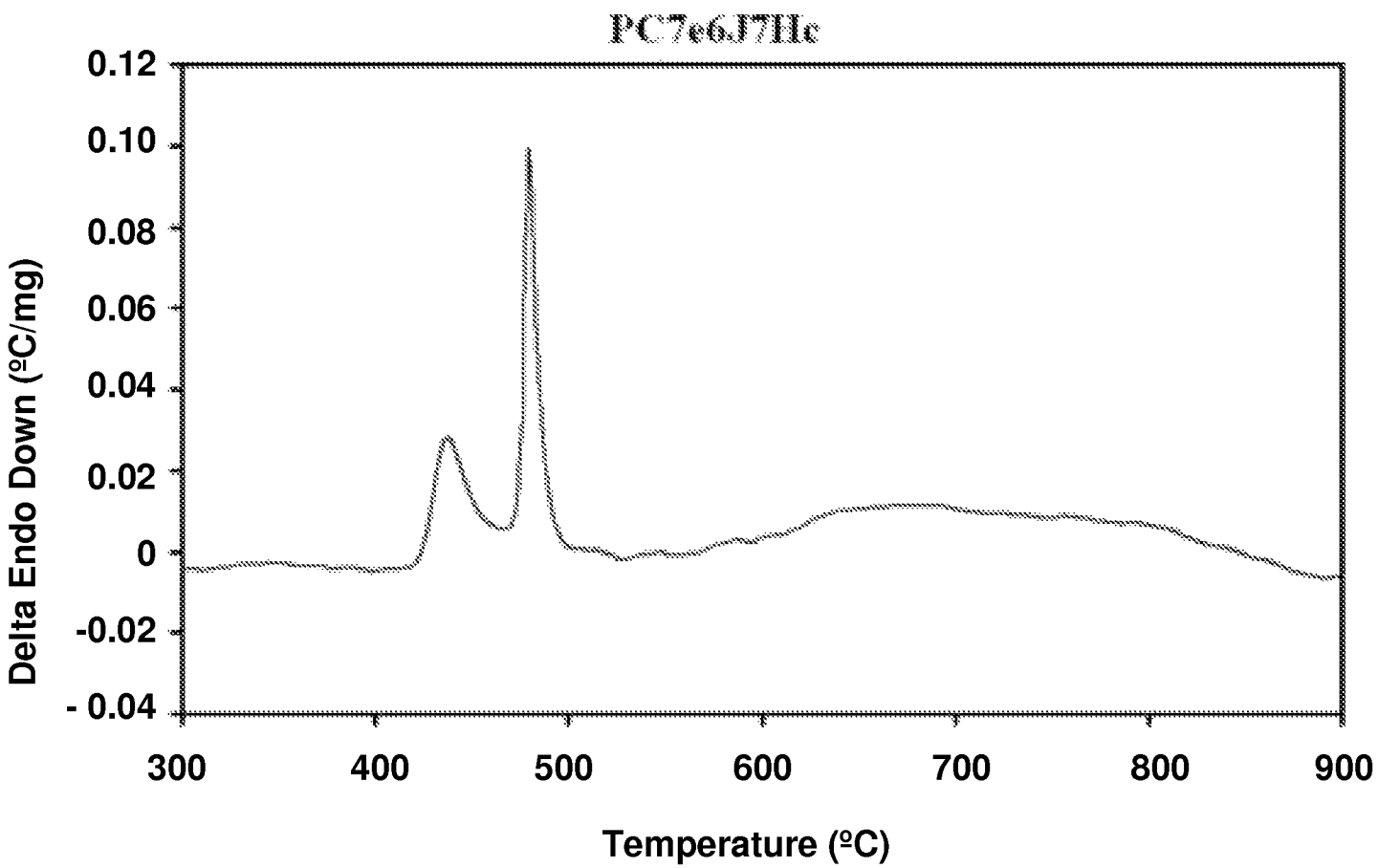
Figure 10F:
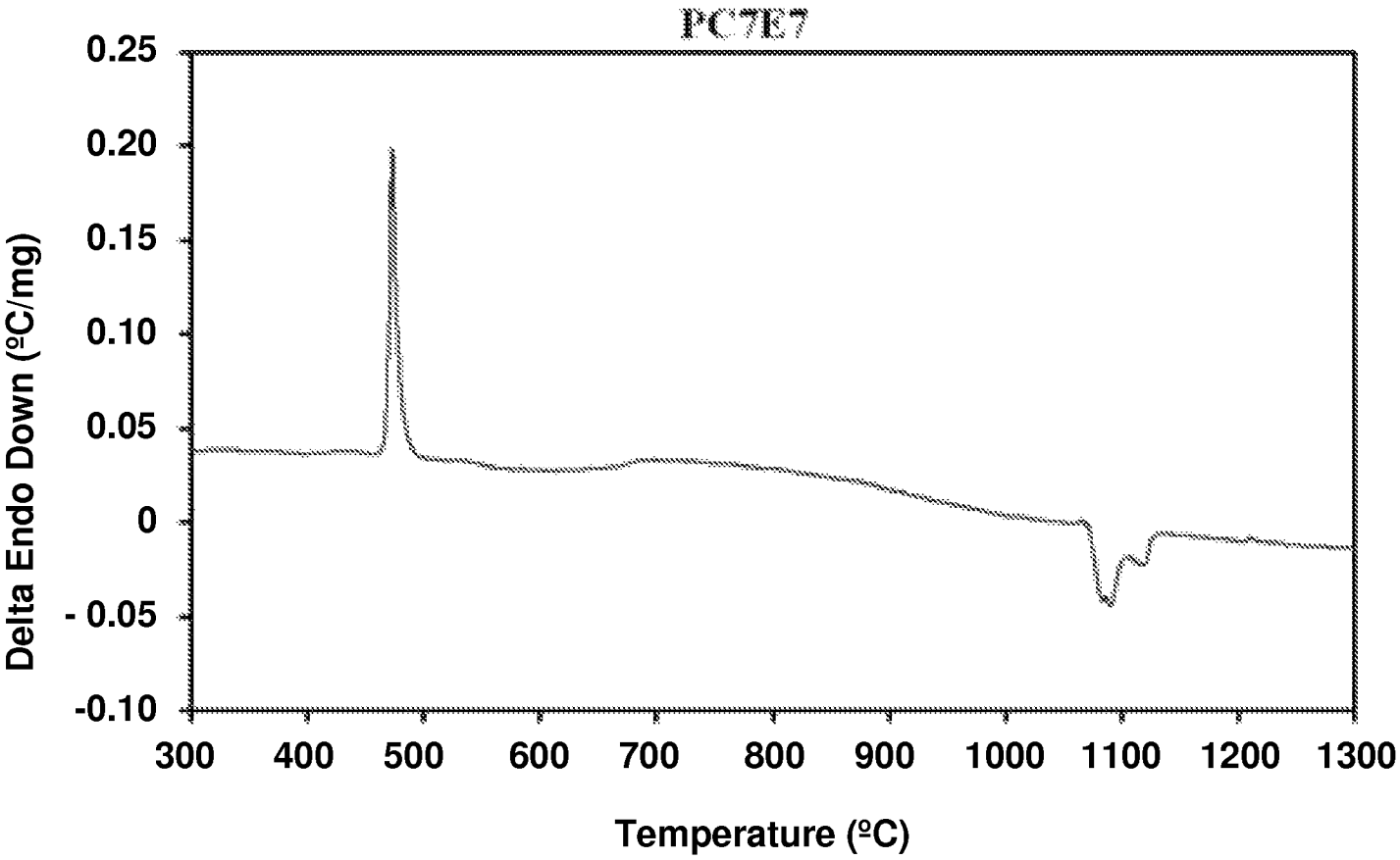

The present disclosure relates to an iron based alloy, wherein the iron based glass forming alloy may include, consist essentially of, or consist of about 45 to 70 atomic percent (at %) Fe, 10 to 30 at % Ni, 0 to 15 at % Co, 7 to 25 at % B, 0 to 6 at % C, and 0 to 2 at % Si. For example, the level of iron may be 45, 46, 47, 48, 49, 50, 51, 52, 53, 54, 55, 56, 57, 58, 59, 60, 61, 62, 63, 64, 65, 66, 67, 68, 69, and 70 atomic percent. The level of nickel may be 10, 11, 12, 13, 14, 15, 16, 17, 18, 19, 20, 21, 22, 23, 24, 25, 26, 27, 28, 29 and 30 atomic percent. The level of cobalt may be 0, 1, 2, 3, 4, 5, 6, 7, 8, 9, 10, 11, 12, 13, 14, and 15 atomic percent. The level of boron may be 7, 8, 9, 10, 11, 12, 13 14, 15, 16, 17, 18, 19, 20, 21, 22, 23, 24 and 25 atomic percent. The level of carbon may be 0, 1, 2, 3, 4, 5 and 6 atomic percent. The level of silicon may be 0, 1 and 2 atomic percent.

The glass forming chemistries may exhibit critical cooling rates for metallic glass formation of less than 100,000 K/s, including all values and increments in the range of $10^3$ K/s to $10^5$ K/s. Critical cooling rate may be understood as a cooling rate that provides for formation of glassy fractions within the alloy composition. The iron based glass forming alloy may result in a structure that may consist primarily of metallic glass. That is at least 50% or more of the metallic structure, including all values and increments in the range of 50% to 99%, in 1.0% increments, may be glassy. Accordingly, it may be appreciated that little ordering on the near atomic scale may be present, i.e., any ordering that may occur may be less than 50 nm. In another example, the iron based alloy may exhibit a structure that includes, consists essentially of, or consists of metallic glass and crystalline phases wherein the crystalline phases may be less than 500 nm in size, including all values and increments between 1 nm and 500 nm in 1 nm increments.

In some examples, the alloys may include, consist essentially of, or consist of iron present in the range of 46 at % to 69 at %; nickel present in the range of 12 at % to 27 at %; optionally cobalt, which if present, may be present in the range of 2 at % to 15 at %; boron present in the range of 12 at % to 16 at %; optionally carbon, which if present, may be present in the range of 4 at % to 5 at %; optionally silicon, which if present, may be present in the range of 0.4 at % to 0.5 at %. It may be appreciated that the alloys may include the above alloying elements at 100 at % and impurities may be present in a range of 0.1 at % to 5.0 at %, including all values and increments therein. Impurities may be introduced by, among other mechanisms, feedstock compositions, processing equipment, reactivity with the environment during processing, etc.

The alloys may be produced by melting one or more feedstock compositions, which may include individual elements or elemental combinations. The feedstocks may be provided as powders or in other forms as well. The feedstocks may be melted by radio frequency (rf) induction, electric arc furnaces, plasma arc furnaces, or other furnaces or apparatus using a shielding gas, such as an argon or helium gas. Once the feedstocks have been melted, they may be formed into ingots shielded in an inert gas environment. The ingots may be flipped and remelted to increase and/or improve homogeneity. The alloys may then be meltspun into ribbon having widths up to about 1.25 mm. Melt spinning, may be performed at, for example, tangential velocities in the range of 5 to 25 meter per second, including all values and increments therein. The ribbon may have a thickness in the range of 0.02 mm to 0.15 mm, including all values and increments therein. Other processes may be used as well, such as twin roll casting or other relatively rapid cooling processes capable of cooling the alloys at a rate of 100,000 K/s or less.

The above alloys may exhibit a density in the range of 7.70 grams per cubic centimeter to 7.89 grams per cubic centimeter, +/−0.01 grams per cubic centimeter, including all values and increments therein. In addition, the alloys may exhibit one or more glass to crystalline transition temperatures in the range of 410° C. to 500° C., including all values and increments therein, measured using DSC (Differential Scanning calorimetry) at a rate of 10° C. per minute. Glass to crystalline transition temperature may be understood as a temperature in which crystal structures begin formation and growth out of the glassy alloy. The primary onset glass to crystalline transition temperature may be in the range of 415° C. to 474° C. and the secondary onset glass to crystalline transition temperature may be in the range of 450° C. to 488° C., including all values and increments therein, again measured by DSC at a rate of 10° C. per minute. The primary peak glass to crystalline transition temperature may be in the range of 425° C. to 479° C. and the secondary peak glass to crystalline transition temperature may be in the range of 454° C. to 494° C., including all values and increment therein, again measured by DSC at a rate of 10° C. per minute. Furthermore, the enthalpy of transformation may be in the range of −40.6 J/g to −210 J/g, including all values and increments therein. DSC may be performed under an inert gas to prevent oxidation of the samples, such as high purity argon gas.

Furthermore, the above alloys may exhibit initial melting temperatures in the range of 1060° C. to 1120° C. Melting temperature may be understood as the temperature at which the state of the alloy changes from solid to liquid. The alloys may exhibit a primary onset melting temperature in the range of 1062° C. to 1093° C. and a secondary onset melting temperature in the range of 1073° C. to 1105° C., including all values and increments therein, as measured by DSC at a rate of 10° C. per minute. The primary peak melting temperature may be in the range of 1072° C. to 1105° C. and the secondary peak melting temperature may be in the range of 1081° C. to 1113° C., including all values and increments therein, measured by DSC at a rate of 10° C. per minute. Again, DSC may be performed under an inert gas to prevent oxidation of the samples, such as high purity argon gas.

In a further aspect, the iron based glass forming alloys may result in a structure that exhibits a Young's Modulus in the range of 119 to 134 GPa, including all values and increments therein. Young's Modulus may be understood as the ratio of unit stress to unit strain within the proportional limit of a material in tension or compression. The alloys may also exhibit an ultimate or failure strength in the range of greater than 1 GPa, such as in the range of 1 GPa to 5 GPa, such as 2.7 GPa to 4.20 GPa, including all values and increments therein. Failure strength may be understood as the maximum stress value. The alloys may exhibit an elastic strain 0.5% or greater, including all values and increments in the range of 0.5 to 4.0%. Elastic strain may be understood as the change in a dimension of a body under a load divided by the initial dimension in the elastic region. In addition, the alloy may also exhibit a tensile or bending strain greater than 2% and up to 97%, including all values and increments therein. The tensile or bending strain may be understood as the maximum change in a dimension of a body under a load divided by the initial dimension. The alloy may also exhibit a combination of the above properties, such as a failure strength greater than 1 GPa and a tensile or bending strain greater than 2%.

The resulting alloys may also exhibit amorphous fractions, nanocrystalline structures and/or microcrystalline structures. It may be appreciated that microcrystalline may be understood to include structures that exhibit a mean grain size of 500 nm or less, including all values and increments in the range of 100 nm to 500 nm. Nanocrystalline may be understood to include structures that exhibit a mean grain size of below 100 nm, such as in the range of 50 nm to 100 nm, including all values and increments therein. Amorphous may be understood as including structures that exhibit relatively little to no order, exhibiting a mean grain size, if grains are present, in the range of less than 50 nm.

EXAMPLES

The following examples are provided herein for purposes of illustration only and are not meant to limit the scope of the description and claims appended hereto.

Sample Preparation

Using high purity elements, 15 g alloy feedstocks of PC7E6 series alloys were weighed out according to the atomic ratio's provided in Table 1. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a ⅓ atm helium atmosphere using RF induction and then ejected onto a 245 mm diameter copper wheel which was traveling at tangential velocities which varied from 5 to 25 m/s. The resulting PC7E6 series ribbon that was produced had widths which were typically up to ~1.25 mm and thickness from 0.02 to 0.15 mm.

TABLE 1

Atomic Ratio's for PC7E6 Series Elements

| | Fe | Ni | Co | B | C | Si |
|---|---|---|---|---|---|---|
| PC7E6 | 56.00 | 16.11 | 10.39 | 12.49 | 4.54 | 0.47 |
| PC7E6JC | 46.00 | 26.11 | 10.39 | 12.49 | 4.54 | 0.47 |
| PC7E6JB | 48.00 | 24.11 | 10.39 | 12.49 | 4.54 | 0.47 |
| PC7E6JA | 50.00 | 22.11 | 10.39 | 12.49 | 4.54 | 0.47 |
| PC7E6J1 | 52.00 | 20.11 | 10.39 | 12.49 | 4.54 | 0.47 |
| PC7E6J3 | 54.00 | 18.11 | 10.39 | 12.49 | 4.54 | 0.47 |
| PC7E6J7 | 58.00 | 14.11 | 10.39 | 12.49 | 4.54 | 0.47 |
| PC7E6J9 | 60.00 | 12.11 | 10.39 | 12.49 | 4.54 | 0.47 |
| PC7E6H1 | 52.00 | 16.11 | 14.39 | 12.49 | 4.54 | 0.47 |
| PC7E6H3 | 54.00 | 16.11 | 12.39 | 12.49 | 4.54 | 0.47 |
| PC7E6H7 | 58.00 | 16.11 | 8.39 | 12.49 | 4.54 | 0.47 |
| PC7E6H9 | 60.00 | 16.11 | 6.39 | 12.49 | 4.54 | 0.47 |
| PC7E6HA | 62.00 | 16.11 | 4.39 | 12.49 | 4.54 | 0.47 |
| PC7E6HB | 64.00 | 16.11 | 2.39 | 12.49 | 4.54 | 0.47 |
| PC7E6HC | 66.39 | 16.11 | 0.00 | 12.49 | 4.54 | 0.47 |
| PC7E6J1H9 | 56.00 | 20.11 | 6.39 | 12.49 | 4.54 | 0.47 |
| PC7E6J3H9 | 58.00 | 18.11 | 6.39 | 12.49 | 4.54 | 0.47 |
| PC7E6J7H9 | 62.00 | 14.11 | 6.39 | 12.49 | 4.54 | 0.47 |
| PC7E6J9H9 | 64.00 | 12.11 | 6.39 | 12.49 | 4.54 | 0.47 |
| PC7E6J1HA | 58.00 | 20.11 | 4.39 | 12.49 | 4.54 | 0.47 |
| PC7E6J3HA | 60.00 | 18.11 | 4.39 | 12.49 | 4.54 | 0.47 |
| PC7E6J7HA | 64.00 | 14.11 | 4.39 | 12.49 | 4.54 | 0.47 |
| PC7E6J9HA | 66.00 | 12.11 | 4.39 | 12.49 | 4.54 | 0.47 |
| PC7E6J1HB | 60.00 | 20.11 | 2.39 | 12.49 | 4.54 | 0.47 |
| PC7E6J3HB | 62.00 | 18.11 | 2.39 | 12.49 | 4.54 | 0.47 |
| PC7E6J7HB | 66.00 | 14.11 | 2.39 | 12.49 | 4.54 | 0.47 |
| PC7E6J1HC | 62.39 | 20.11 | 0.00 | 12.49 | 4.54 | 0.47 |
| PC7E6J3HC | 64.39 | 18.11 | 0.00 | 12.49 | 4.54 | 0.47 |
| PC7E6J7HC | 68.39 | 14.11 | 0.00 | 12.49 | 4.54 | 0.47 |
| PC7E7 | 53.50 | 15.50 | 10.00 | 16.00 | 4.50 | 0.50 |

Density

The density of the alloys in ingot form was measured using the Archimedes method in a specially constructed balance allowing weighing in both air and distilled water. The density of the arc-melted 15 gram ingots for each alloy is tabulated in Table 2 and was found to vary from 7.70 g/cm$^3$ to 7.89 g/cm$^3$. Experimental results have revealed that the accuracy of this technique is +−0.01 g/cm$^3$.

TABLE 2

Density of Alloys

| Alloy | Density, g/cm$^3$ |
|---|---|
| PC7E6 | 7.80 |
| PC7E6JC | 7.89 |
| PC7E6JB | 7.86 |
| PC7E6JA | 7.84 |
| PC7E6J1 | 7.83 |
| PC7E6J3 | 7.81 |
| PC7E6J7 | 7.78 |
| PC7E6J9 | 7.75 |
| PC7E6H1 | 7.82 |
| PC7E6H3 | 7.81 |
| PC7E6H7 | 7.79 |
| PC7E6H9 | 7.77 |
| PC7E6HA | 7.75 |
| PC7E6HB | 7.73 |
| PC7E6HC | 7.72 |
| PC7E6J1H9 | 7.79 |
| PC7E6J3H9 | 7.78 |
| PC7E6J7H9 | 7.75 |
| PC7E6J9H9 | 7.72 |
| PC7E6J1HA | 7.78 |
| PC7E6J3HA | 7.77 |
| PC7E6J7HA | 7.74 |
| PC7E6J9HA | 7.70 |

TABLE 2-continued

| Density of Alloys | |
|---|---|
| Alloy | Density, g/cm$^3$ |
| PC7E6J1HB | 7.77 |
| PC7E6J3HB | 7.75 |
| PC7E6J7HB | 7.73 |
| PC7E6J1HC | 7.75 |
| PC7E6J3HC | 7.74 |
| PC7E6J7HC | 7.72 |
| PC7E7 | 7.73 |

As-Solidified Structure

Thermal analysis was performed on the as-solidified ribbon structure on a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. Note that the cooling rate increases with increases in wheel tangential velocity. Typical ribbon thickness of the alloys melt-spun at 16 m/s and 10.5 m/s is 0.04 to 0.05 mm and 0.06 to 0.08 mm, respectively. In Table 3, the DSC data related to the glass to crystalline transformation is shown for the PC7E6 series alloys that have been melt-spun at 16 m/s. In FIGS. 1 through 5, the corresponding DTA plots are shown for each PC7E6 series sample melt-spun at 16 m/s. As can be seen, the majority of samples (all but two) exhibit glass to crystalline transformations verifying that the as-spun state contains fractions of metallic glass (e.g greater than about 50% by volume). The glass to crystalline transformation occurs in either one stage, two stage, or three stages in the range of temperature from 415 to 500° C. and with enthalpies of transformation from −40.6 to −210 J/g. In Table 4, the DSC data related to the glass to crystalline transformation is shown for the PC7E6 series alloys that have been melt-spun at 10.5 m/s. In FIGS. 6 through 10, the corresponding DTA plots are shown for each PC7E6 series sample melt-spun at 10.5 m/s. As can be seen, the majority of samples (all but two) exhibit glass to crystalline transformations verifying that the as-spun state contains significant fractions of metallic glass (e.g greater than about 50% by volume). The glass to crystalline transformation occurs in either one stage, two stage, or three stages in the range of temperature from 415 to 500° C. and with enthalpies of transformation from 50.7 to 173 J/g.

TABLE 3

DSC Data for Glass to Crystalline Transformations for Alloys Melt-Spun at 16 m/s

| Alloy | Glass | Peak #1 Onset (° C.) | Peak #1 Peak (° C.) | ΔH (−J/g) | Peak #2 Onset (° C.) | Peak #2 Peak (° C.) | ΔH (−J/g) |
|---|---|---|---|---|---|---|---|
| PC7e6 | Yes | 431 | 443 | 36.7 | 477 | 482 | 58.1 |
| PC7E6JC | Yes | 418 | 427 | ~45.2 | 453 | 458 | ~101.4 |
| PC7E6JB | Yes | 425 | 434 | ~34.1 | 457 | 463 | ~84.3 |
| PC7E6JA | Yes | 424 | 433 | ~34.0 | 460 | 466 | ~62.8 |
| PC7E6J1 | Yes | 421 | 432 | 35.4 | 465 | 469 | 63.0 |
| PC7E6J3 | Yes | 426 | 437 | 36.0 | 469 | 474 | 60.2 |
| PC7E6J7 | Yes | 430 | 443 | 41.4 | 481 | 486 | 61.8 |
| PC7E6J9 | Yes | 436 | 449 | ~65.5 | 488 | 494 | ~97.4 |
| PC7E6H1 | Yes | 428 | 441 | 37.4 | 477 | 482 | 54.8 |
| PC7E6H3 | Yes | 430 | 442 | 39.2 | 477 | 483 | 59.5 |
| PC7E6H7 | Yes | 431 | 443 | 37.4 | 477 | 481 | 65.1 |
| PC7E6H9 | Yes | 422 | 435 | 38.7 | 474 | 479 | 62.3 |
| PC7E6HA | Yes | 439 | 450 | 30.2 | 477 | 483 | 65.3 |
| PC7E6HB | Yes | 431 | 443 | 34.2 | 473 | 478 | 68.1 |

TABLE 3-continued

DSC Data for Glass to Crystalline Transformations for Alloys Melt-Spun at 16 m/s

| Alloy | Glass | Peak #1 Onset (° C.) | Peak #1 Peak (° C.) | ΔH (−J/g) | Peak #2 Onset (° C.) | Peak #2 Peak (° C.) | ΔH (−J/g) |
|---|---|---|---|---|---|---|---|
| PC7E6HC | Yes | 423 | 433 | ~40.4 | 463 | 467 | ~81.9 |
| PC7E6J1H9 | Yes | 426 | 436 | ~49.2 | 465 | 471 | ~88.8 |
| PC7E6J3H9 | Yes | 430 | 439 | 6.0 | 471 | 476 | 24.6 |
| PC7E6J7H9 | Yes | 436 | 449 | ~73.7 | 483 | 489 | ~108.4 |
| PC7E6J9H9 | Yes | 433 | 448 | ~67.7 | 483 | 492 | ~100.1 |
| PC7E6J1HA | Yes | 428 | 437 | ~50.9 | 467 | 472 | ~98.1 |
| PC7E6J3HA | Yes | 443 | 453 | ~79.4 | 481 | 487 | ~130.2 |
| PC7E6J7HA | Yes | 429 | 448 | 9.6 | 481 | 486 | 11.9 |
| PC7E6J9HA | Yes | 435 | 448 | ~66.9 | 485 | 490 | ~110.1 |
| PC7E6J1HB | Yes | 428 | 437 | ~50.9 | 467 | 472 | ~98.1 |
| PC7E6J3HB | Yes | 423 | 435 | 34.9 | 468 | 473 | 70.0 |
| PC7E6J7HB | Yes | 434 | 445 | ~57.0 | 479 | 483 | ~83.5 |
| PC7E6J1HC | Yes | 423 | 433 | ~40.4 | 463 | 467 | ~81.9 |
| PC7E6J3HC | Yes | 426 | 437 | 32.5 | 467 | 472 | 67.8 |
| PC7E6J7HC | Yes | 431 | 442 | ~54.7 | 475 | 479 | ~86.9 |
| PC7E7 | Yes | 466 | 469 | 40.6 | | | |

TABLE 4

DSC Data for Glass to Crystalline Transformations for Alloys Melt-Spun at 10.5 m/s

| Alloy | Glass | Peak #1 Onset (° C.) | Peak #1 Peak (° C.) | ΔH (−J/g) | Peak #2 Onset (° C.) | Peak #2 Peak (° C.) | ΔH (−J/g) |
|---|---|---|---|---|---|---|---|
| PC7E6 | Yes | 428 | 439 | 30.9 | 474 | 479 | 56.8 |
| PC7E6JC | Yes | 415 | 425 | 37.1 | 450 | 454 | 72.8 |
| PC7E6JB | Yes | 416 | 425 | 21.2 | 451 | 456 | 42.2 |
| PC7E6JA | Yes | 417 | 427 | 19.6 | 457 | 461 | 37.6 |
| PC7E6J1 | Yes | 420 | 430 | 17.5 | 462 | 467 | 33.2 |
| PC7E6J3 | Yes | 426 | 437 | 45.3 | 469 | 474 | 69.9 |
| PC7E6J7 | Yes | 433 | 446 | 39.9 | 479 | 484 | 65.3 |
| PC7E6J9 | Yes | 431 | 446 | 31.5 | 486 | 492 | 40.0 |
| PC7E6H1 | No | | | | | | |
| PC7E6H3 | Yes | 427 | 439 | 32.2 | 475 | 480 | 81.7 |
| PC7E6H7 | Yes | 474 | 479 | 3.9 | | | |
| PC7E6H9 | Yes | 429 | 441 | 47.0 | 474 | 478 | 82.8 |
| PC7E6HA | Yes | 430 | 440 | 22.5 | 472 | 476 | 43.4 |
| PC7E6HB | Yes | 430 | 441 | 47.3 | 472 | 476 | 81.2 |
| PC7E6HC | Yes | 430 | 440 | 41.1 | 470 | 475 | 67.4 |
| PC7E6J1H9 | Yes | 424 | 434 | 38.6 | 462 | 467 | 73.4 |
| PC7E6J3H9 | Yes | 428 | 438 | 41.7 | 469 | 473 | 67.4 |
| PC7E6J7H9 | Yes | 433 | 444 | 37.6 | 478 | 483 | 68.6 |
| PC7E6J9H9 | Yes | 433 | 447 | 42.7 | 486 | 491 | 68.8 |
| PC7E6J1HA | Yes | 425 | 435 | 34.8 | 464 | 468 | 68.8 |
| PC7E6J3HA | Yes | 427 | 437 | 33.2 | 468 | 472 | 64.3 |
| PC7E6J7HA | Yes | 433 | 444 | 22.9 | 477 | 481 | 69.0 |
| PC7E6J9HA | Yes | 427 | 442 | 41.9 | 483 | 489 | 64.9 |
| PC7E6J1HB | Yes | 425 | 435 | 38.7 | 464 | 468 | 78.0 |
| PC7E6J3HB | Yes | 425 | 436 | 39.9 | 466 | 470 | 72.6 |
| PC7E6J7HB | Yes | 430 | 442 | 37.6 | 475 | 479 | 64.8 |
| PC7E6J1HC | Yes | 424 | 434 | 31.7 | 465 | 470 | 69.6 |
| PC7E6J3HC | Yes | 421 | 433 | 23.3 | 468 | 473 | 68.2 |
| PC7E6J7HC | Yes | 425 | 437 | 71.6 | 475 | 480 | 101.3 |
| PC7E7 | Yes | 468 | 473 | 127.2 | | | |

In Table 5, elevated temperature DTA results are shown indicating the melting behavior for the PC7E6 series alloys. As can be seen, the melting occurs in 1 to 3 stages with initial melting (i.e. solidus) observed from 1062 to 1120° C.

TABLE 5

Differential Thermal Analysis Data for Melting Behavior

| Alloy | Peak #1 Onset (° C.) | Peak #1 Peak (° C.) | Peak #2 Onset (° C.) | Peak #2 Peak (° C.) | Peak #3 Onset (° C.) | Peak #3 Peak (° C.) |
|---|---|---|---|---|---|---|
| PC7E6 | 1078 | 1086 | ~1084 | 1096 | | |
| PC7E6JC | 1062 | 1072 | ~1074 | 1081 | | |
| PC7E6JB | 1062 | 1074 | ~1073 | 1082 | | |
| PC7E6JA | 1067 | ~1078 | ~1077 | 1087 | | |
| PC7E6J1 | 1070 | 1078 | ~1079 | 1085 | | |
| PC7E6J3 | 1075 | 1082 | ~1086 | 1093 | | |
| PC7E6J7 | 1082 | 1090 | ~1091 | 1099 | | |
| PC7E6J9 | 1086 | 1096 | ~1097 | 1104 | | |
| PC7E6H1 | 1077 | 1088 | ~1085 | ~1089 | | |
| PC7E6H3 | 1078 | ~1087 | ~1085 | 1094 | | |
| PC7E6H7 | 1082 | 1088 | ~1091 | 1097 | | |
| PC7E6H9 | 1085 | ~1092 | ~1090 | 1098 | | |
| PC7E6HA | 1082 | ~1096 | ~1091 | 1100 | | |
| PC7E6HB | 1090 | ~1103 | ~1094 | 1105 | | |
| PC7E6HC | 1087 | ~1101 | ~1092 | ~1106 | ~1095 | 1110 |
| PC7E6J1H9 | 1073 | 1085 | ~1082 | 1093 | | |
| PC7E6J3H9 | 1077 | 1088 | ~1084 | 1091 | ~1093 | 1100 |
| PC7E6J7H9 | 1086 | 1098 | ~1092 | 1104 | ~1096 | 1107 |
| PC7E6J9H9 | 1090 | 1102 | ~1102 | 1112 | | |
| PC7E6J1HA | 1073 | ~1086 | 1083 | 1092 | | |
| PC7E6J3HA | 1080 | ~1090 | 1087 | 1099 | | |
| PC7E6J7HA | 1088 | 1097 | ~1094 | 1103 | ~1098 | 1108 |
| PC7E6J9HA | 1093 | 1105 | ~1105 | 1113 | | |
| PC7E6J1HB | 1076 | 1089 | ~1082 | 1099 | | |
| PC7E6J3HB | 1079 | 1089 | ~1087 | 1097 | ~1093 | 1102 |
| PC7E6J7HB | 1089 | ~1101 | 1092 | 1105 | ~1099 | 1110 |
| PC7E6J1HC | 1077 | 1088 | ~1090 | 1101 | | |
| PC7E6J3HC | 1083 | 1097 | ~1091 | 1103 | | |
| PC7E6J7HC | 1091 | ~1104 | ~1098 | 1108 | ~1104 | 1114 |
| PC7E7 | 1073 | 1084 | ~1079 | 1091 | ~1112 | 1118 |

Mechanical Property Testing

Mechanical property testing was done primarily through using nanoindentor testing to measure Young's modulus and bend testing to measure breaking strength and elongation. Additionally, limited tensile test measurements were all performed on selected samples. The following sections will detail the technical approach and measured data.

Two-Point Bend Testing

Figure 11:
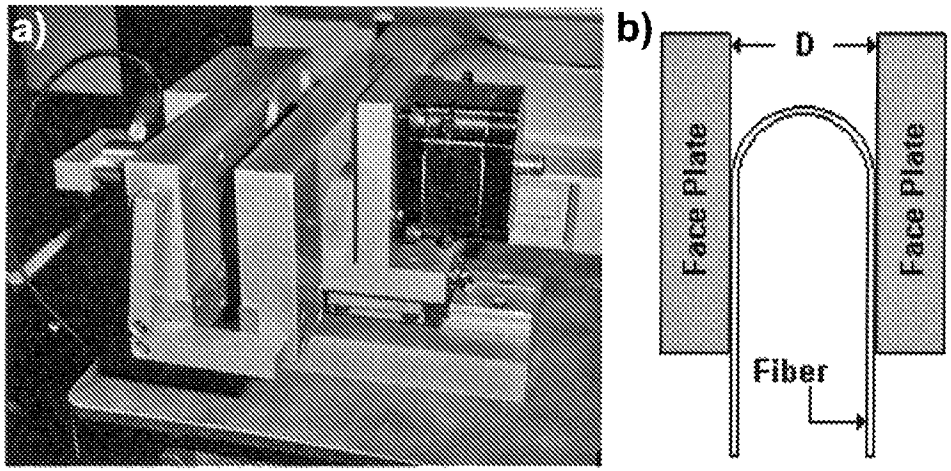
FIGS. 11*a* and 11*b* are images of an example of a two point bend test system; a) image of bend tester, b) close-up schematic of bending process.

The two-point bending method for strength measurement was developed for thin, highly flexible specimens, such as optical fibers and ribbons. The method involves bending a length of tape (fiber, ribbon, etc.) into a "U" shape and inserting it between two flat and parallel faceplates. One faceplate is stationary while the second is moved by a computer controlled stepper motor so that the gap between the faceplates can be controlled to a precision of better than ~5 μm with an ~10 μm systematic uncertainty due to the zero separation position of the faceplates (FIG. 11). The stepper motor moves the faceplates together at a precisely controlled specified speed at any speed up to 10,000 μm/s. Fracture of the tape is detected using an acoustic sensor which stops the stepper motor. Since for measurements on the tapes, the faceplate separation at failure varied between 2 and 11 mm, the precision of the equipment does not influence the results.

The strength of the specimens was calculated from the faceplate separation at failure. The faceplates constrain the tape to a particular deformation so that the measurement directly gives the strain to failure. The Young's modulus of the material is used to calculate the failure stress according to the following formulas (Equation #1,2):

$$\varepsilon_f = 1.198\left(\frac{d}{D-d}\right) \tag{1}$$

$$\sigma_f = 1.198E\left(\frac{d}{D-d}\right) \tag{2}$$

where d is the tape thickness and D is the faceplate separation at failure. Young's modulus was measured from nanoindentation testing and was found to vary from 119 to 134 GPa for the PC7E6 series alloys. As indicated earlier, for the samples not measured, Young's Modulus was estimated to be 125 GPa. The shape of the tape between the faceplates is an elastica which is similar to an ellipse with an aspect ratio of ~2:1. The equation assumes elastic deformation of the tape. When tapes shatter on failure and the broken ends do not show any permanent deformation, there is not extensive plastic deformation at the failure site and the equations appear to be accurate. Note that even if plastic deformation occurs as shown in a number of the PC7E6 series alloys, the bending measurements would still provide a relative measure of strength.

The strength data for materials is typically fitted to a Weibull distribution as shown in Equation #3:

$$P_f = 1 - \exp\left\{-\left(\frac{\varepsilon}{\varepsilon_0}\right)^m\right\} \tag{3}$$

where in is the Weibull modulus (an inverse measure of distribution width) and $\epsilon_0$ is the Weibull scale parameter (a measure of centrality, actually the 63% failure probability). In general, in is a dimensionless number corresponding to the variability in measured strength and reflects the distribution of flaws. This distribution is widely used because it is simple to incorporate Weibull's weakest link theory which describes how the strength of specimens depends on their size.

Figure 12:
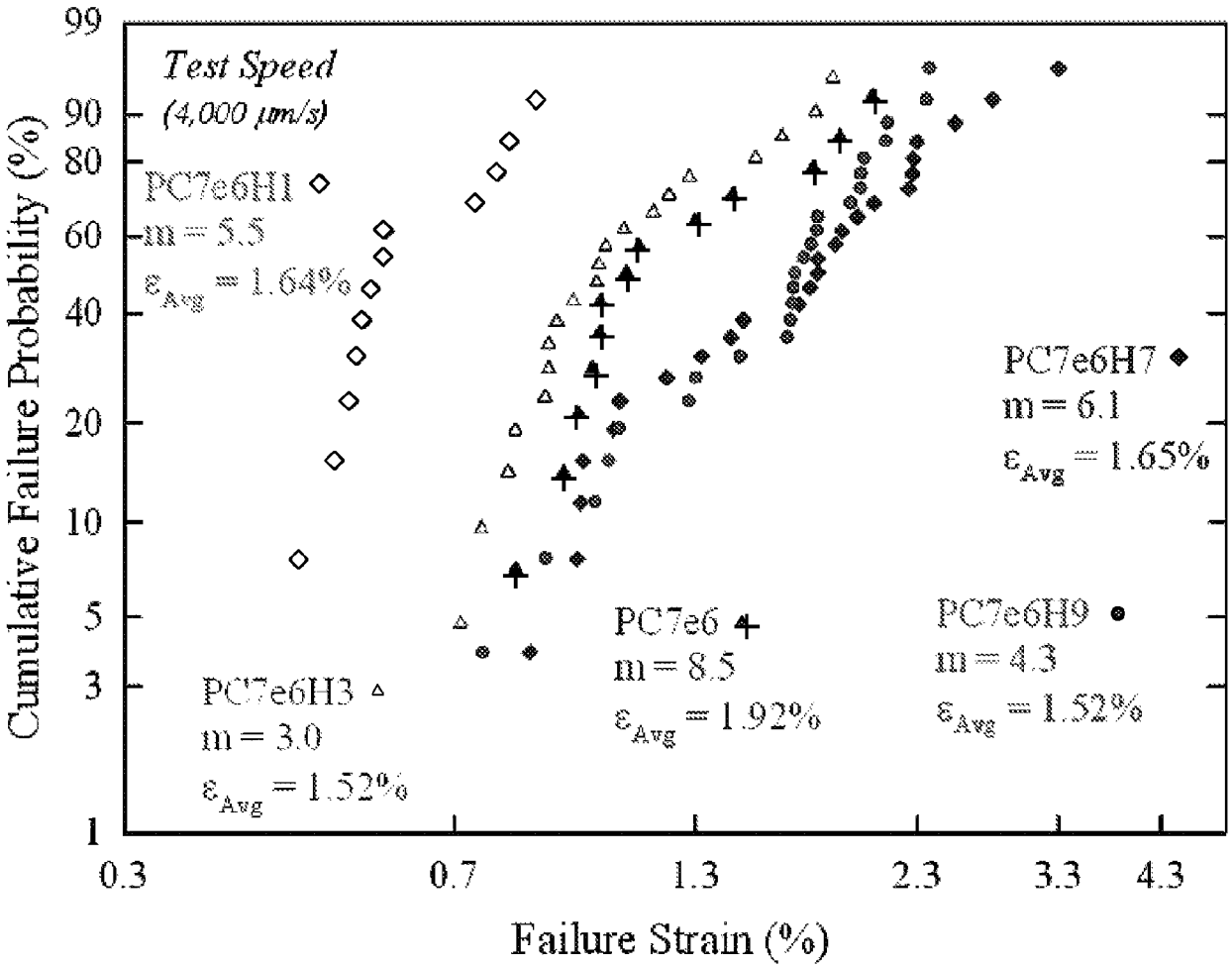
FIG. 12 illustrates bend test data showing the cumulative failure probability as a function of failure strain for the PC7E6H series alloys melt-spun at 10.5 m/s.
Figure 13:
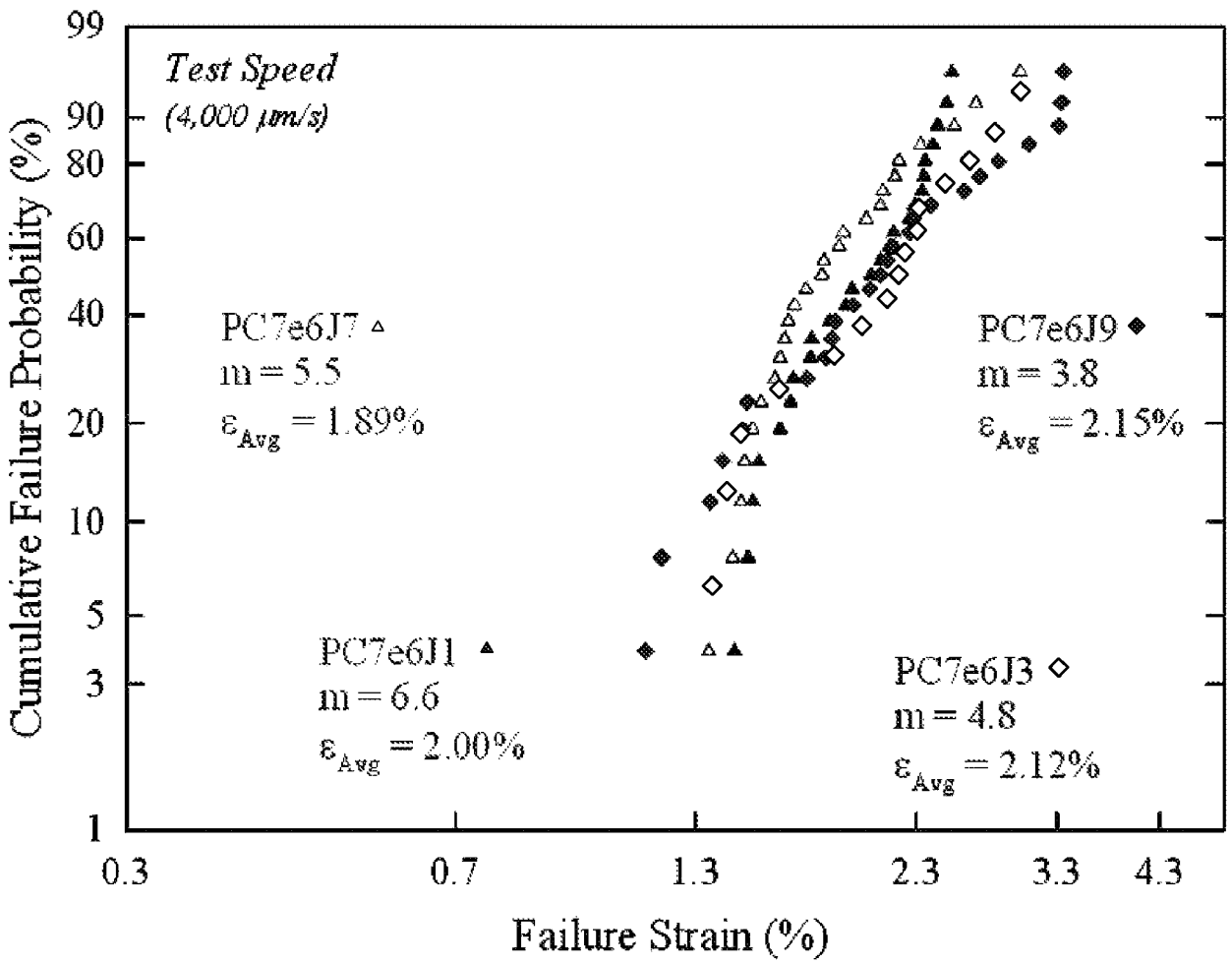
FIG. 13 illustrates bend test data showing the cumulative failure probability as a function of failure strain for the PC7E6J series alloys melt-spun at 10.5 m/s.

In FIGS. 12 and 13, two point bend results are shown giving the cumulative failure probability as a function of failure strain for the PC7E6H and PC7E6J series alloys, respectively, which have been melt-spun at 10.5 m/s. Note that every data point in these Figures represents a separate bend test and for each sample, 17 to 25 measurements were done. In Table 6, the results on these 10.5 m/s bend test measurements are tabulated including Young's Modulus (GPA and psi), failure strength (GPA and psi), Weibull Modulus, average strain (%), and maximum strain (%). The Young's modulus of 125 GPa was used for bend testing calculations of strength which is an average value for such types of alloys. The Weibull Modulus was found to vary from 2.97 to 8.49 indicating the presence of macrodefects in some of the ribbons causing premature failure. The average strain in percent was calculated based on the sample set that broke during two-point bend testing. The average strain ranged from 1.52 to 2.15%. The maximum strain in percent during bending was found to vary from 2.3% to 3.36%. Failure strength values were calculated from 2.87 to 4.20 GPa.

TABLE 6

Results of Bend Testing on Ribbons (10.5 m/s)

| Alloy | Youngs Modulus* (GPa) | Youngs Modulus (psi) | Failure Strength (GPa) | Failure Strength (psi) | Weibull Modulus | Avg Strain (%) | Max Strain (%) |
|---|---|---|---|---|---|---|---|
| PC7e6 | 125 | 18,695,360 | 2.87 | 416258 | 8.49 | 1.92 | 2.30 |
| PC7e6J1 | 125 | 18,695,360 | 3.15 | 456869 | 6.62 | 2.00 | 2.52 |
| PC7e6J3 | 125 | 18,695,360 | 3.74 | 542441 | 4.80 | 2.12 | 2.99 |
| PC7e6J7 | 125 | 18,695,360 | 3.75 | 543891 | 5.50 | 1.89 | 3.00 |
| PC7e6J9 | 125 | 18,695,360 | 4.20 | 609158 | 3.84 | 2.15 | 3.36 |
| PC7e6H1 | 125 | 18,695,360 | 3.02 | 438014 | 5.49 | 1.64 | 2.42 |
| PC7e6H3 | 125 | 18,695,360 | 3.79 | 549693 | 2.97 | 1.52 | 3.00 |
| PC7e6H7 | 125 | 18,695,360 | 2.88 | 417709 | 6.05 | 1.65 | 2.30 |
| PC7e6H9 | 125 | 18,695,360 | 2.92 | 423510.1 | 4.27 | 1.52 | 2.33 |

*assumed value

180 Degree Bend Testing

Figure 14:
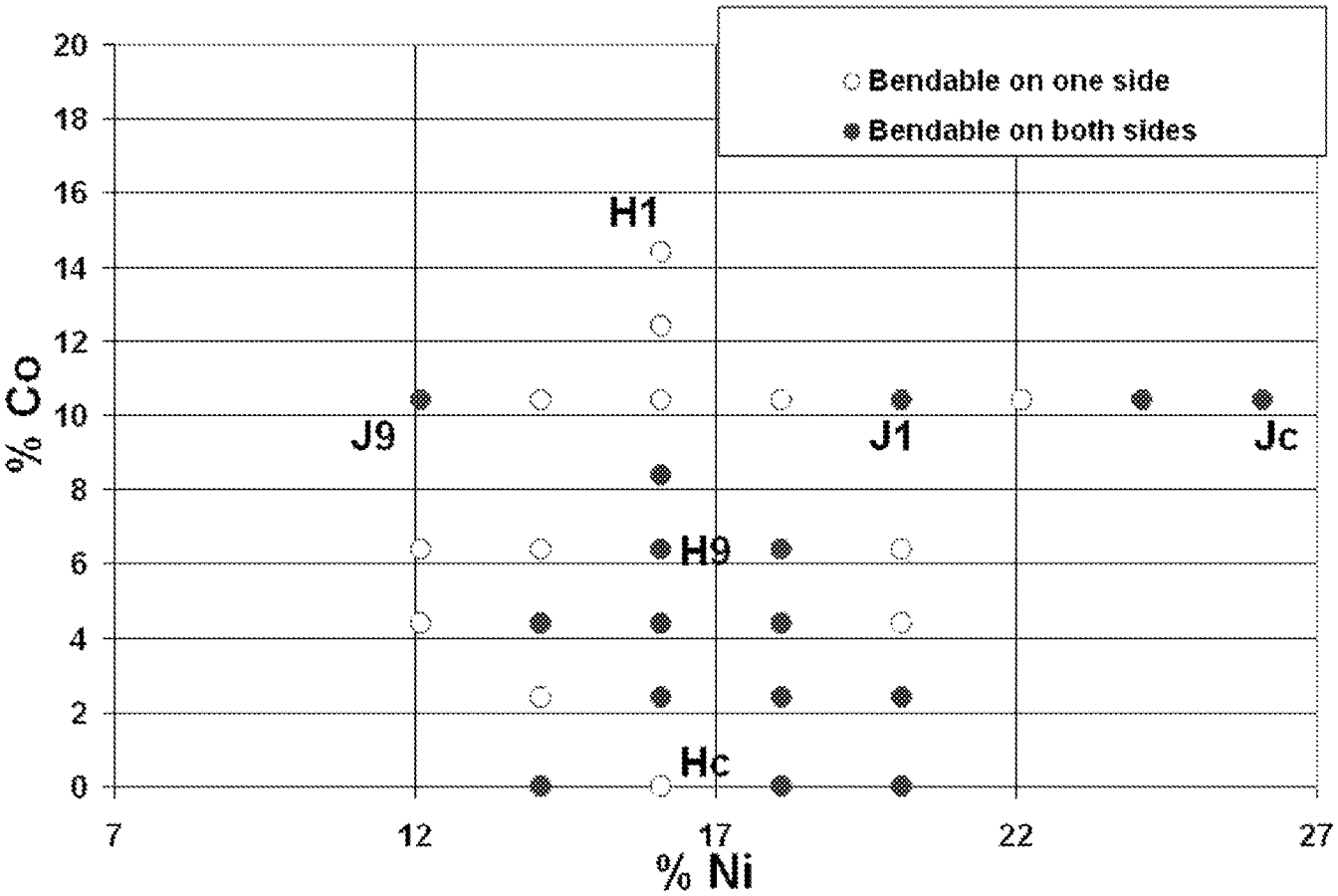
FIG. 14 illustrates the results on the PC7E6 series alloys which have been melt-spun at 16 m/s and then bent 180° until flat.
Figure 15:
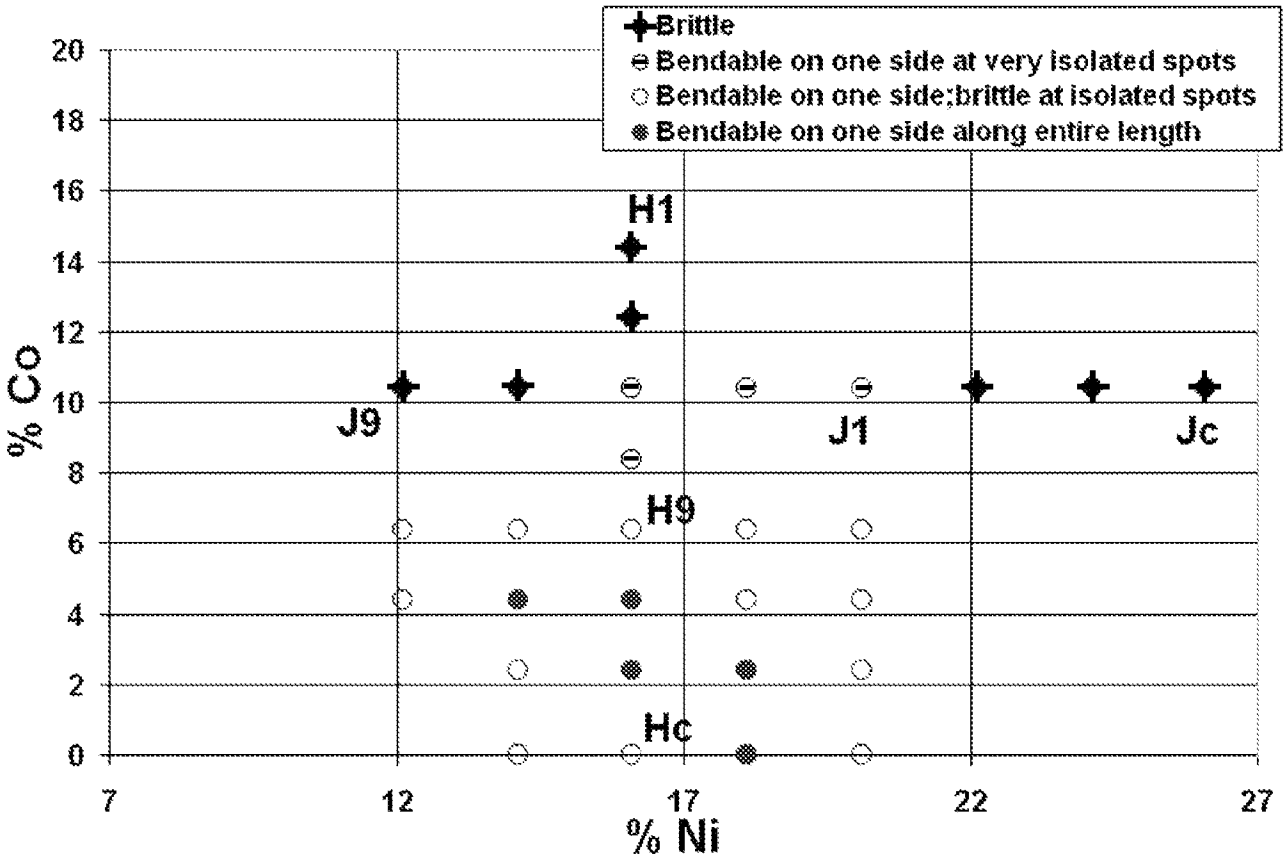
FIG. 15 illustrates the results of the PC7E6 series alloys which have been melt-spun at 10.5 m/s and then bent 180° until flat.

Bending ribbon samples completely flat indicates a special condition whereby high strain can be obtained but not measured by traditional bend testing. The results on the PC7E6 series alloys which have been melt-spun at 10.5 m/s and then bent 180° until flat are shown in FIGS. 14 and 15 for samples melt-spun at 16 and 10.5 m/s respectively. Note that the ribbons processed at 16 m/s had thickness which was generally 0.03 to 0.04 mm while the ribbons processed at 10.5 m/s exhibited thickness from 0.07 to 0.08 mm. When the ribbons are folded completely around themselves, they experience high strain which can be as high as 119.8% as derived from complex mechanics. In practice, the strain may be in the range of ~57% to ~97% strain in the tension side of the ribbon. The results show a varied behavior including brittle, bendable on one side along entire length (not counting occasion localized areas containing defects), bendable in isolated spots only in one direction, and bendable on both sides (i.e. wheel and free sides). As shown in FIG. 14, there is a wide composition regime with respect to nickel and cobalt, where the samples can be bent in both directions. For the thick ribbons (i.e. those processed at 10.5 m/s), no samples were found to be bendable in both directions. As shown in FIG. 15, there is a fairly narrow composition regime (i.e. nickel and cobalt ratios) where the ribbons are bendable flat along the entire length in one direction. These Figures illustrate the effects of changing nickel and cobalt content on bending response and intrinsic elongation. Note however that by changing the base elements including boron, carbon, silicon, and iron, it is expected that the bending response can be changed and enhanced especially at the lower wheel speeds such as 10.5 m/s.

CASE EXAMPLES

Case Example #1

Figure 16:
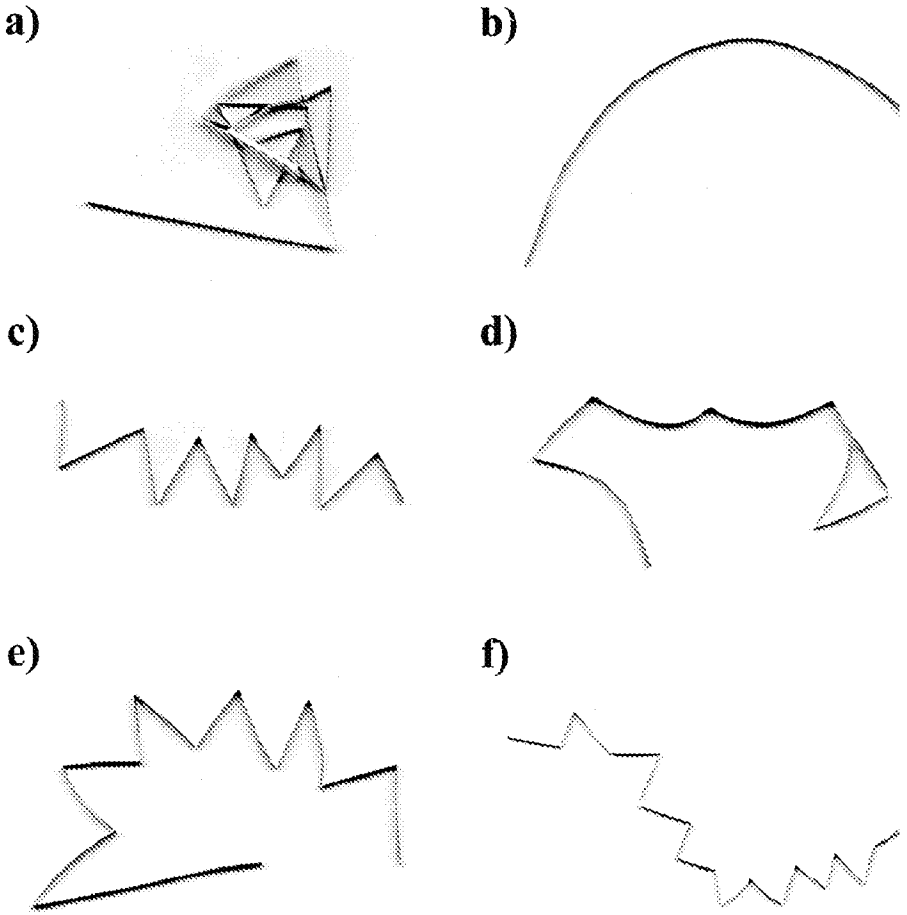
FIG. 16 illustrates examples of hand bent samples of PC7E6HA which have been hand bent 180°; a) melt-spun at 10.5 m/s in a ⅓ atm helium environment, b) melt-spun at 10.5 m/s in a 1 atm air environment, c) melt-spun at 16 m/s in a ⅓ atm helium environment, d) melt-spun at 16 m/s in a 1 atm air environment, e) melt-spun at 30 m/s in a ⅓ atm helium environment, and f) melt-spun at 30 m/s in a 1 atm air environment.
Figure 17A:
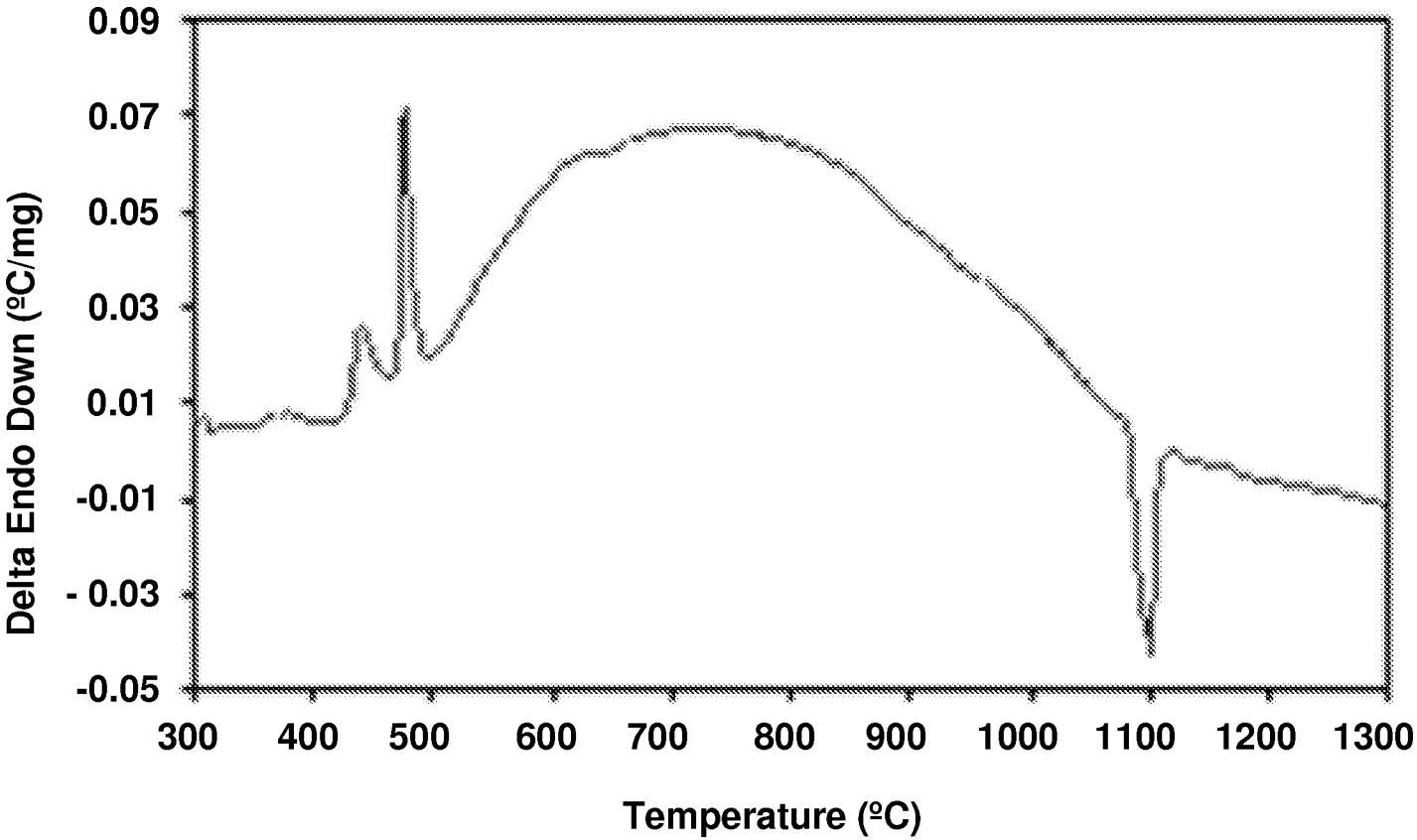
FIG. 17 illustrates DTA curves of the PC7E6HA alloy showing the presence of glass to crystalline transformation peak(s); a) melt-spun at 10.5 m/s in a ⅓ atm helium environment (also showing melting behavior), b) melt-spun at 10.5 m/s in a 1 atm air environment, c) melt-spun at 16 m/s in a ⅓ atm helium environment, d) melt-spun at 16 m/s in a 1 atm air environment, e) melt-spun at 30 m/s in a ⅓ atm helium environment, and f) melt-spun at 30 m/s in a 1 atm air environment.
Figure 17B:
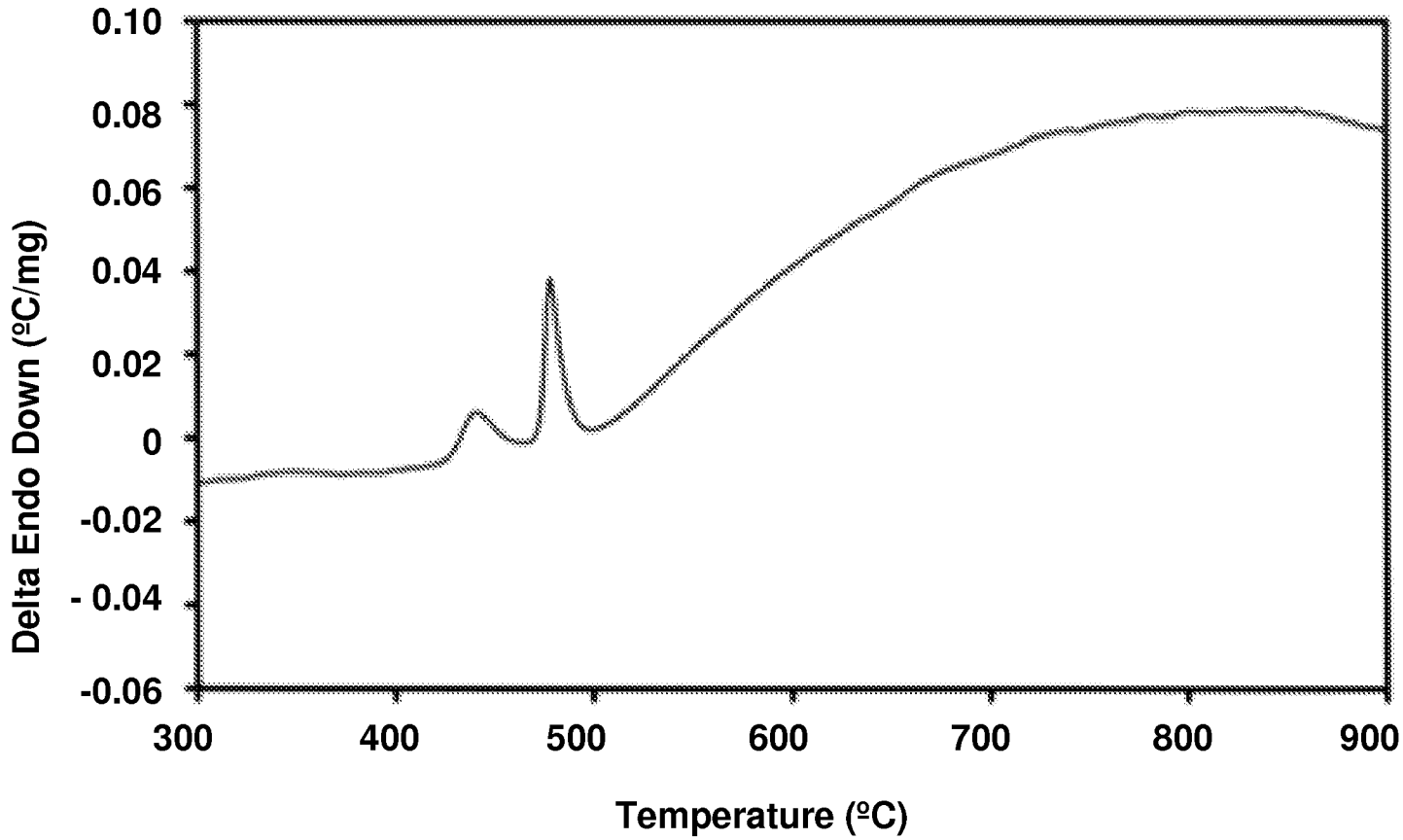
Figure 17C:
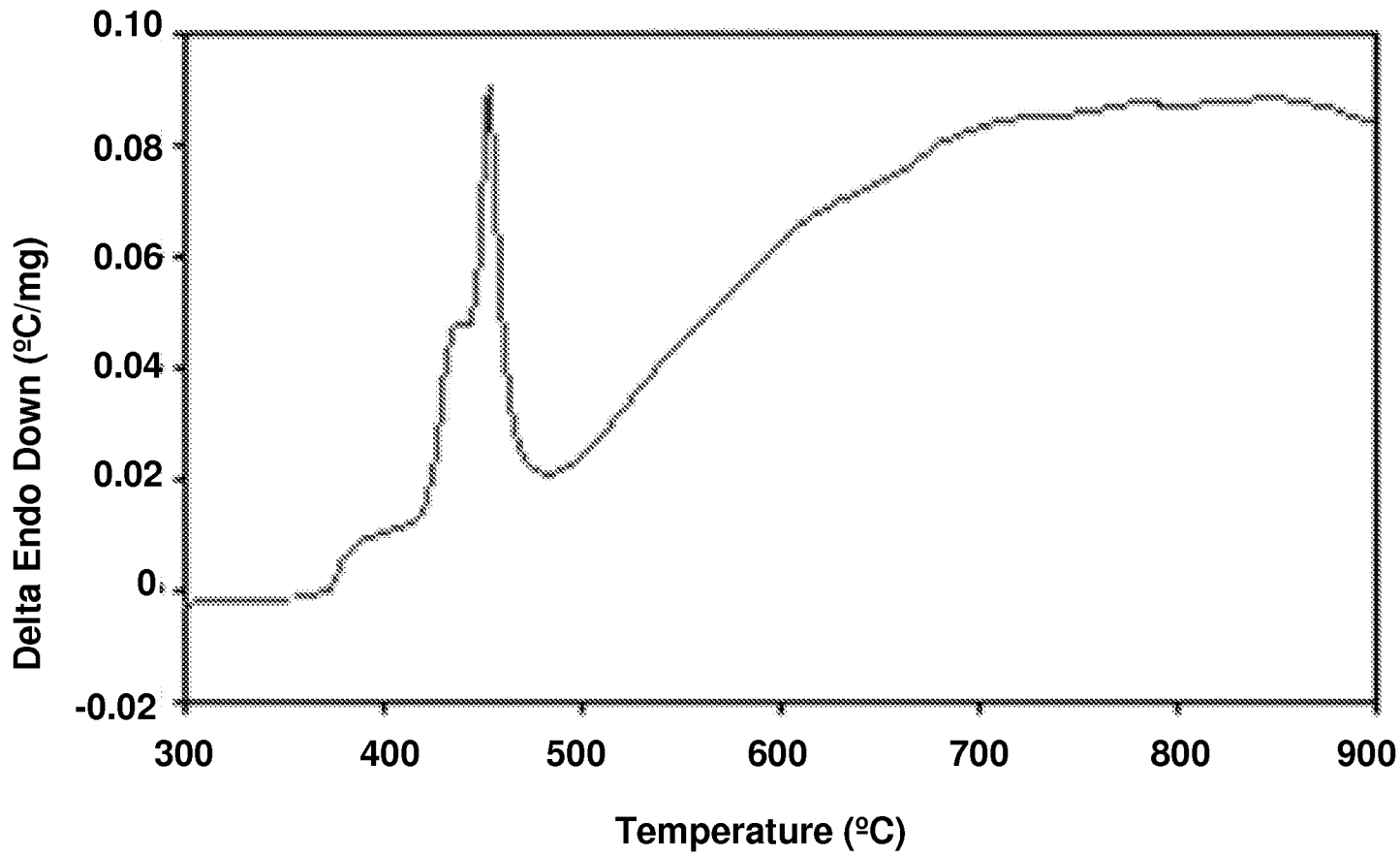
Figure 17D:
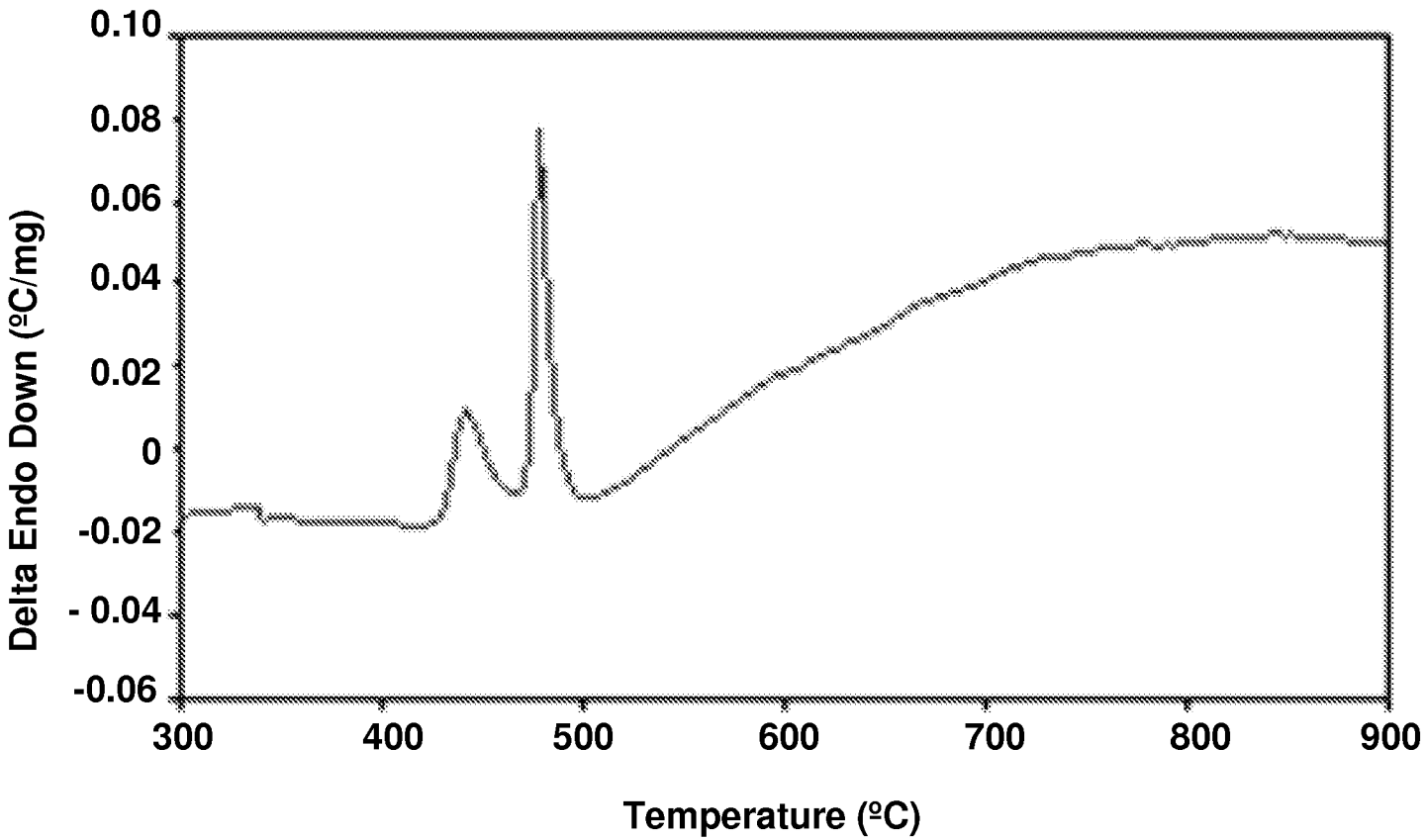
Figure 17E:
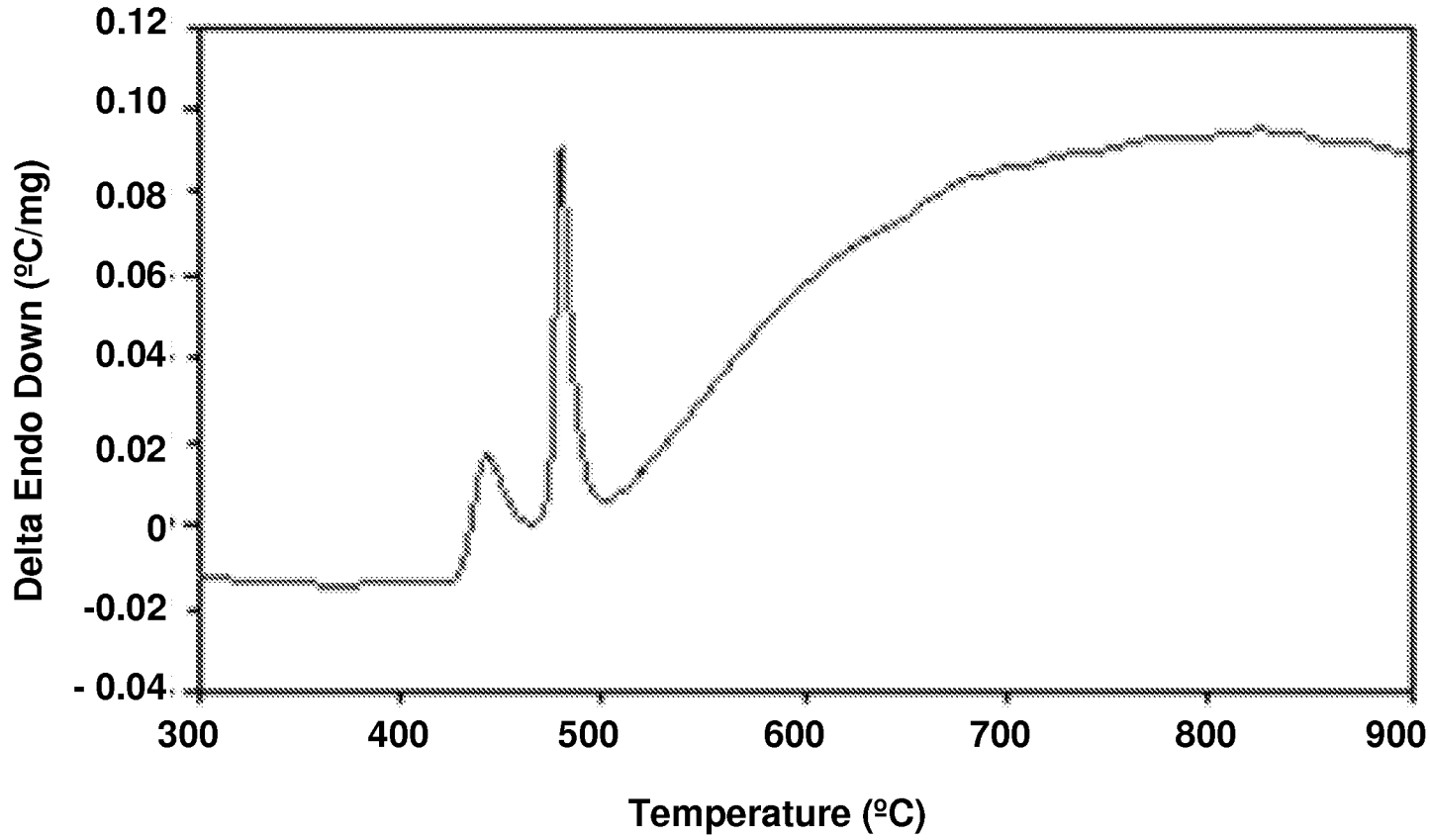
Figure 17F:
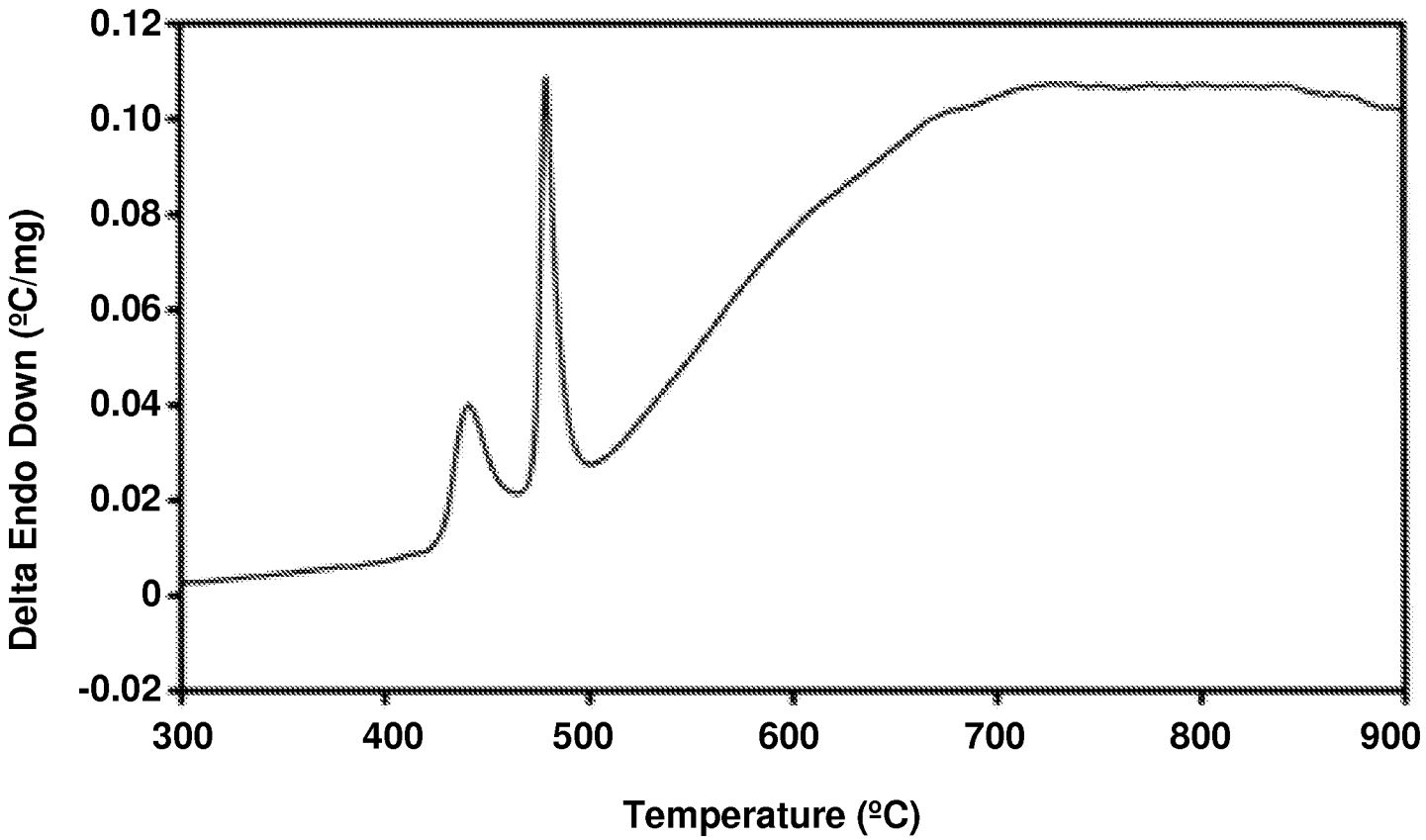

Using high purity elements, six fifteen gram charges of the PC7E6HA chemistry were weighed out according to the atomic ratio's in Table 1. The mixture of elements was placed onto a copper hearth and arc-melted into an ingot using ultra-high purity argon as a cover gas. After mixing, the resulting ingots were cast into a finger shape appropriate for melt-spinning. The cast fingers of PC7E6HA were then placed into a quartz crucible with a hole diameter nominally at 0.81 mm. The ingots were heated up by RF induction and then ejected onto a rapidly moving 245 mm copper wheel traveling at wheel tangential velocities of 30 m/s 16 m/s, and 10.5 m/s. Variations were used in the process, as shown in Table 7, with melting and ejection in an inert ⅓ atm helium environment or melting and ejection in a 1 atm air environment. The ability to hand bend the specimens is indicated in Table 6 and additionally examples are shown in FIG. 16. DTA/DSC analysis of the as-solidified ribbons were done at a heating rate of 10° C./min and were heated up from room temperature to 900° C. The glass to crystalline transformation curves are shown in FIG. 17 and the DSC analysis of the glass peaks are shown in Table 8.

TABLE 7

Melt-spinning Study on PC7e6HA Alloy

| # | Wheel speed, (m/s) | Atmosphere | Ribbon thickness, (μm) | Bend ability |
|---|---|---|---|---|
| 1 | 10.5 | ⅓ atm He | 70-80 | On one side along entire length |
| 2 | 10.5 | 1 atm air | 70-80 | Not bendable |
| 3 | 16 | ⅓ atm He | 40-50 | On both sides |
| 4 | 16 | 1 atm air | 40-50 | On one side only |
| 5 | 30 | ⅓ atm He | 20-25 | On both sides |
| 6 | 30 | 1 atm air | 20-25 | On both sides |

TABLE 8

DTA/DSC analysis of the PC7E6HA Ribbon Samples

| Wheel speed (m/s) | Atmosphere | Glass Present | Peak #1 Onset (° C.) | Peak #1 Peak (° C.) | ΔH (−J/g) | Peak #2 Onset (° C.) | Peak #2 Peak (° C.) | ΔH (−J/g) |
|---|---|---|---|---|---|---|---|---|
| 10.5 | ⅓ atm He | Yes | 425 | 438 | 37.6 | 475 | 479 | 67.4 |
| 10.5 | 1 atm air | Yes | 428 | 440 | 16.9 | 473 | 478 | 33.6 |
| 16 | ⅓ atm He | Yes | 421 | 437 | * | 442 | 453 | 134.3 * |
| 16 | 1 atm air | Yes | 430 | 441 | ~43.0 | 473 | 478 | 76.0 |

TABLE 8-continued

DTA/DSC analysis of the PC7E6HA Ribbon Samples

| Wheel speed (m/s) | Atmosphere | Glass Present | Peak #1 Onset (° C.) | Peak #1 Peak (° C.) | ΔH (−J/g) | Peak #2 Onset (° C.) | Peak #2 Peak (° C.) | ΔH (−J/g) |
|---|---|---|---|---|---|---|---|---|
| 30 | ⅓ atm He | Yes | 432 | 443 | 35.6 | 475 | 480 | 74.0 |
| 30 | 1 atm air | Yes | 429 | 441 | 39.2 | 474 | 480 | 70.9 |

* data combined for peaks 1 and 2 due to overlapping nature

Case Example #2

Using high purity elements, fifteen gram charges of the PC7E6J1 chemistry were weighed out according to the atomic ratio's in Table 1. The mixture of elements was placed onto a copper hearth and arc-melted into an ingot using ultra-high purity argon as a cover gas. After mixing, the resulting ingots were cast into a finger shape appropriate for melt-spinning. The cast fingers of PC7E6J1 were then placed into a quartz crucible with a hole diameter nominally at 0.81 mm. The ingots were heated up by RF induction and then ejected onto a rapidly moving 245 mm copper wheel traveling at wheel tangential velocities of 16 m/s, and 10.5 m/s. The as-spun ribbons were then cut and four to six pieces of ribbon were placed on an off-cut $SiO_2$ single crystal (zero-background holder). The ribbons were situated such that either the shiny side (free side) or the dull side (wheel side) were positioned facing up on the holder. A small amount of silicon powder was placed on the holder as well, and then pressed down with a glass slide so that the height of the silicon matched the height of the ribbon, which will allow for matching any peak position errors in subsequent detailed phase analysis.

Figure 18:
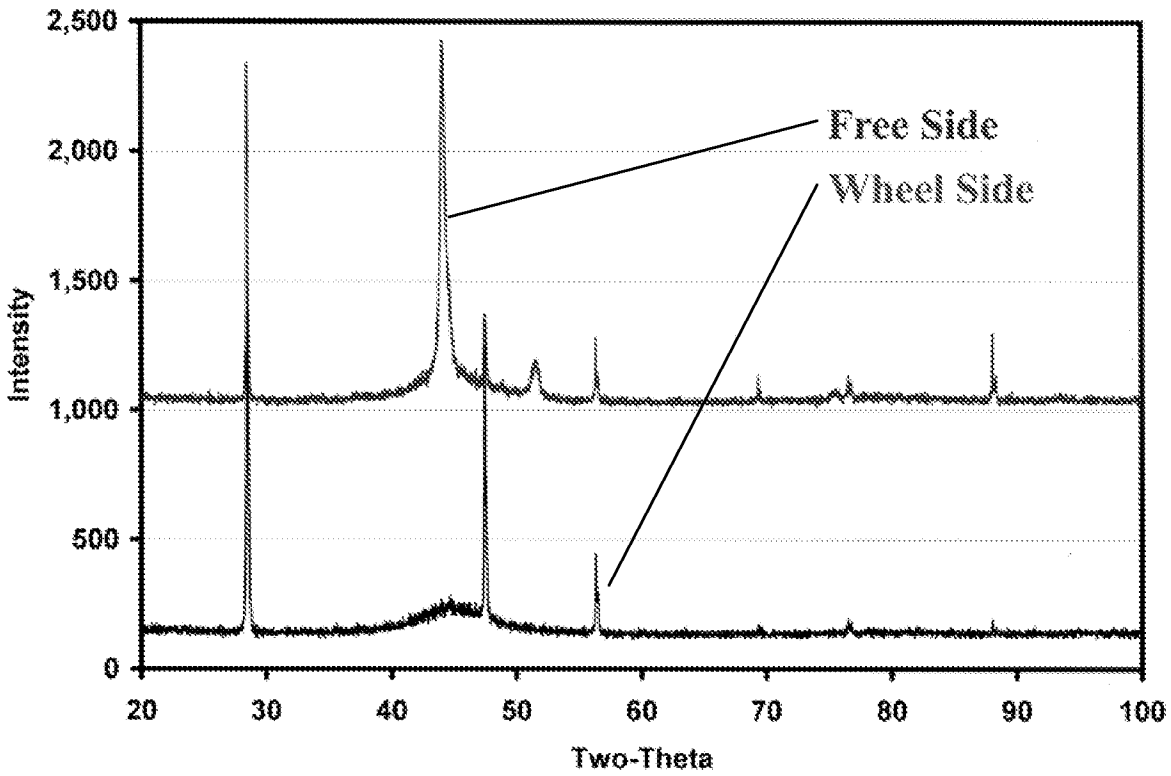
FIG. 18 illustrates X-ray diffraction scans of the PC7E6J1 sample melt-spun at 16 m/s; wherein the top curve illustrates the free side and the bottom curve illustrates the wheel side.
Figure 19:
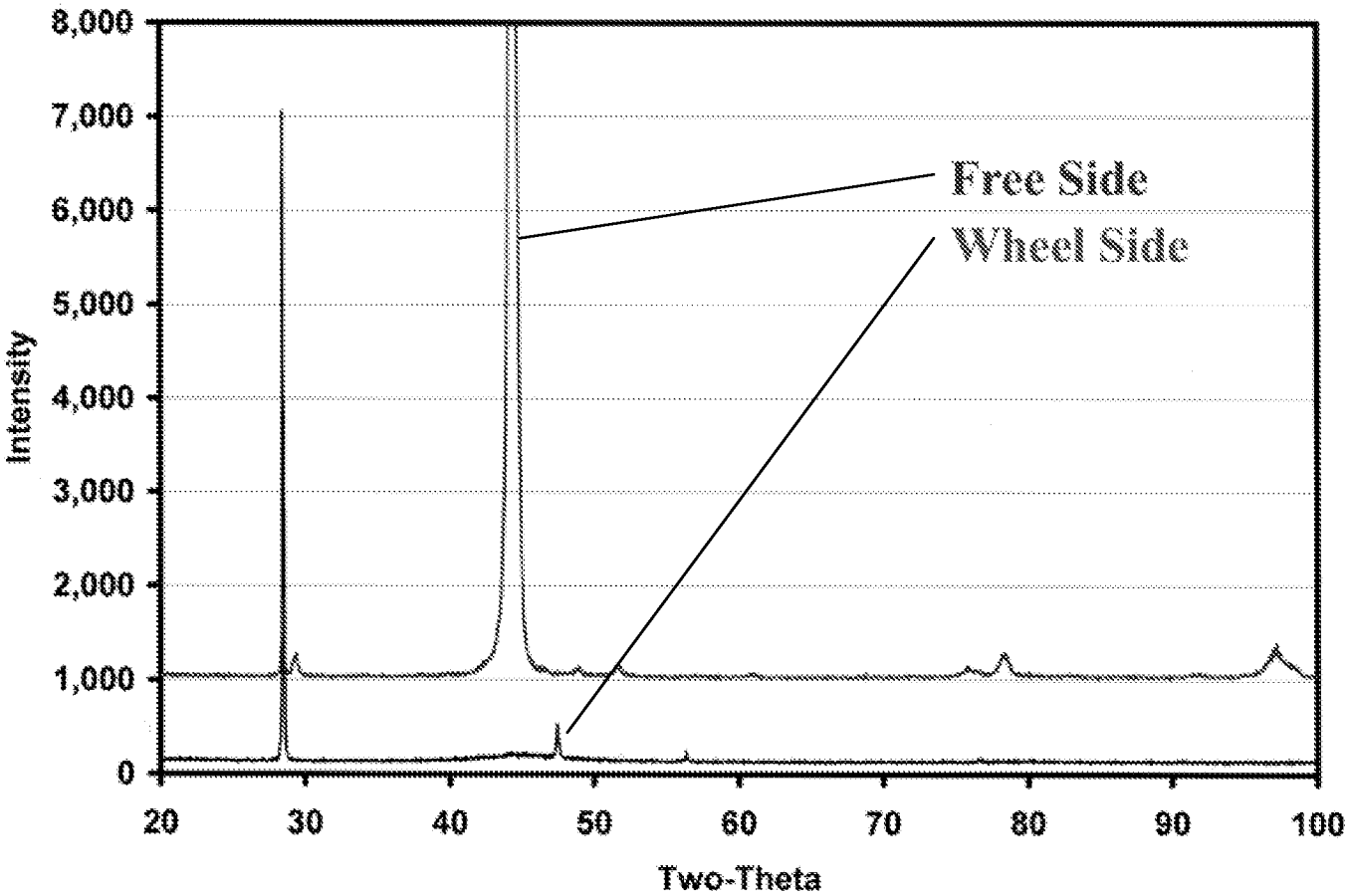
FIG. 19 illustrates X-ray diffraction scans of the PC7E6J1 sample melt-spun at 10.5 m/s; wherein the top curve illustrates the free side, and the bottom curve illustrates the wheel side.

X-ray diffraction scans were taken from 20 to 100 degrees (two theta) with a step size of 0.02 degrees and at a scanning rate of 2 degrees/minute. The X-ray tube settings with a copper target were 40 kV and 44 mA. In FIG. 18, X-ray diffraction scans are shown for the PC7E6J1 alloy melt-spun at 16 m/s showing the free side and wheel sides. In FIG. 19, X-ray diffraction scans are shown for the PC7E6J1 alloy melt-spun at 10.5 m/s showing the free side and wheel sides. While the silicon added can dominate in the X-ray scans, it is clear that the fraction of glass and crystalline content and the phases which are formed are varying as a function of both wheel speed and through the cross section of the ribbon. These differences in structure explain the reasons for the different bending results found in this alloy and others in Table 7.

Case Example #3

Using high purity elements, fifteen gram charges of the PC7E6 and PC7E6HA chemistries were weighed out according to the atomic ratio's in Table 1. The mixture of elements was placed onto a copper hearth and arc-melted into an ingot using ultrahigh purity argon as a cover gas. After mixing, the resulting ingots were cast into a finger shape appropriate for melt-spinning. The cast fingers of both alloys were then placed into a quartz crucible with a hole diameter nominally at 0.81 mm. The ingots were heated up by RF induction and then ejected onto a rapidly moving 245 mm copper wheel traveling at a wheel tangential velocity of 16 m/s. To further examine the ribbon structure, scanning electron microscopy (SEM) was done on selected ribbon samples. Melt spun ribbons were mounted in a standard metallographic mount with several ribbons held using a metallography binder clip in which the ribbons were contained while setting in a mold and an epoxy is poured in and allowed to harden. The resulting metallographic mount was ground and polished using appropriate media following standard metallographic practices.

Figure 20B:
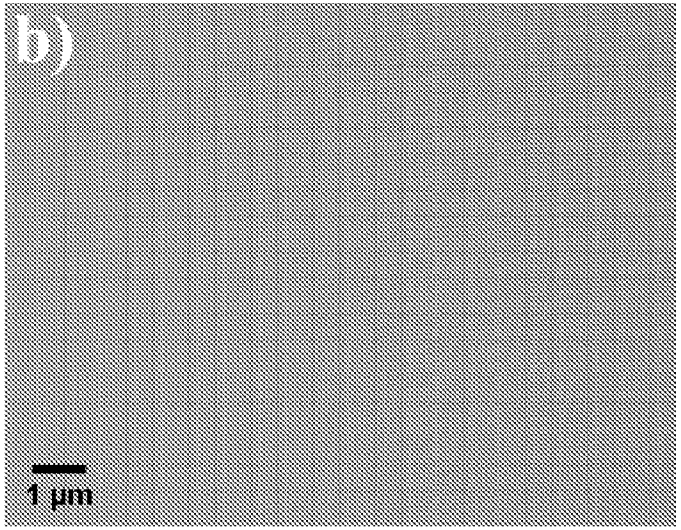
FIGS. 20*a* through 20*c* illustrate SEM backscattered electron micrographs of the PC7E6; a) low magnification showing the entire ribbon cross section, note the presence of isolated points of porosity, b) medium magnification of the ribbon structure, c) high magnification of the ribbon structure.
Figure 20A:
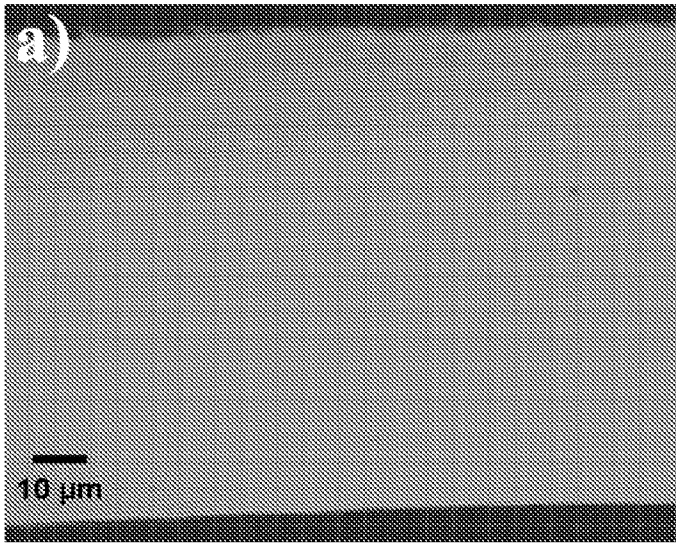
Figure 20C:
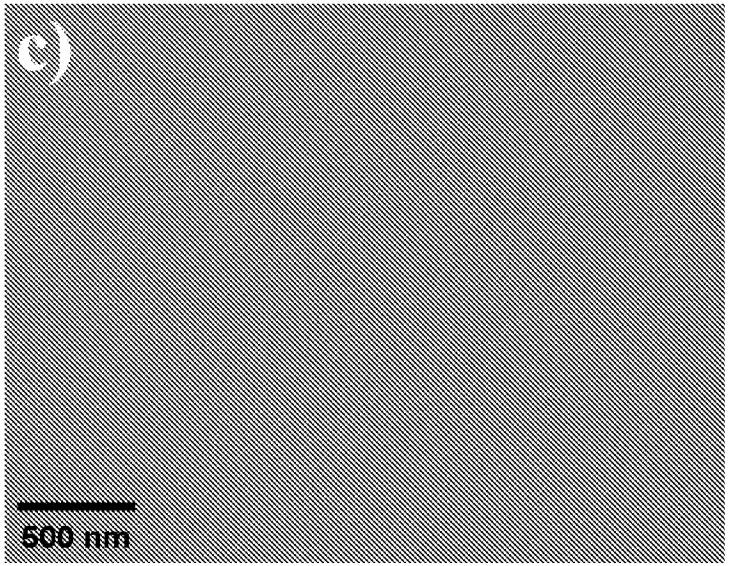
Figure 21B:
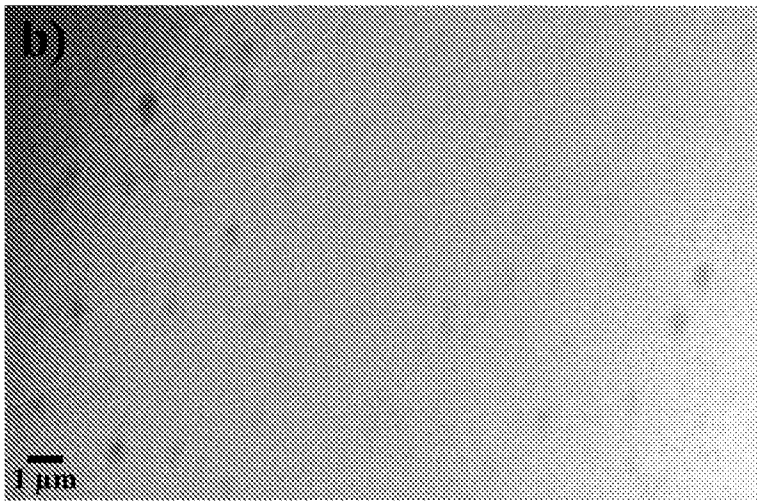
FIGS. 21*a* through 21*c* illustrate SEM backscattered electron micrographs of the PC7e6HA; a) low magnification showing the entire ribbon cross section, b) medium magnification of the ribbon structure, note the presence of isolated points of crystallinity, c) high magnification of the ribbon structure.
Figure 21A:
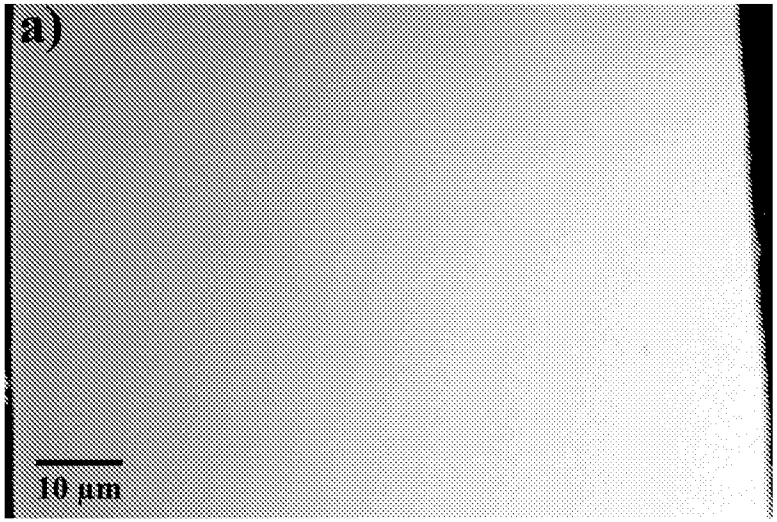
Figure 21C:
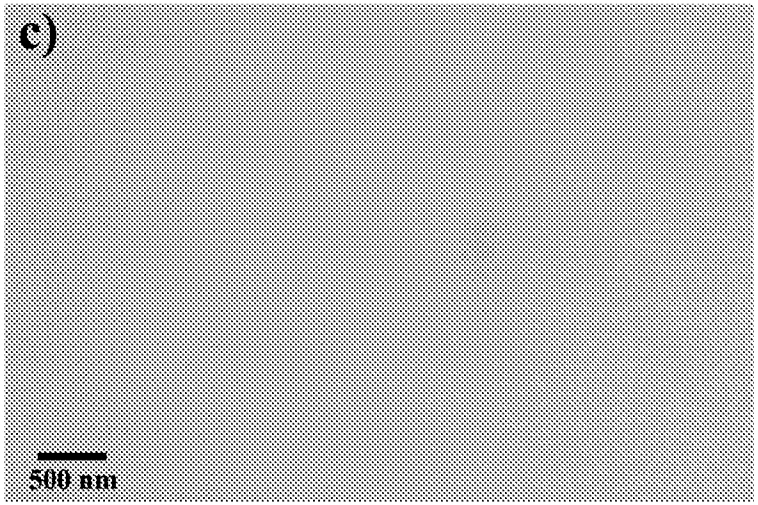

The structure of the samples was observed using an EVO-60 scanning electron microscope manufactured by Carl Zeiss SMT Inc. Typical operating conditions were electron beam energy of 17.5 kV, filament current of 2.4 A, and spot size setting of 800. Energy Dispersive Spectroscopy (EDS) was conducted with an Apollo silicon drift detector (SDD-10) using Genesis software both of which are from EDAX. The amplifier time was set to 6.4 micro-sec so that the detector dead time was about 12 to 15%. In FIG. 20, SEM backscattered electron micrographs are shown of the PC7E6 alloy at three different magnifications. As indicated in the Figures, at the resolution limit of the backscattered electrons no crystalline structural features (i.e. grains and phases) can be found. In FIG. 21, SEM backscattered electron micrographs are shown of the PC7E6HA alloy at three different magnifications. As shown, the images show generally a featureless microstructure but in the region at medium magnification, (i.e. FIG. 21*b*), isolated points of crystallinity are found on a scale of approximately 500 nm. This may indicate that a key component in getting high elongation may be crystalline precipitates in a glass matrix.

Case Example #4

Figure 22:
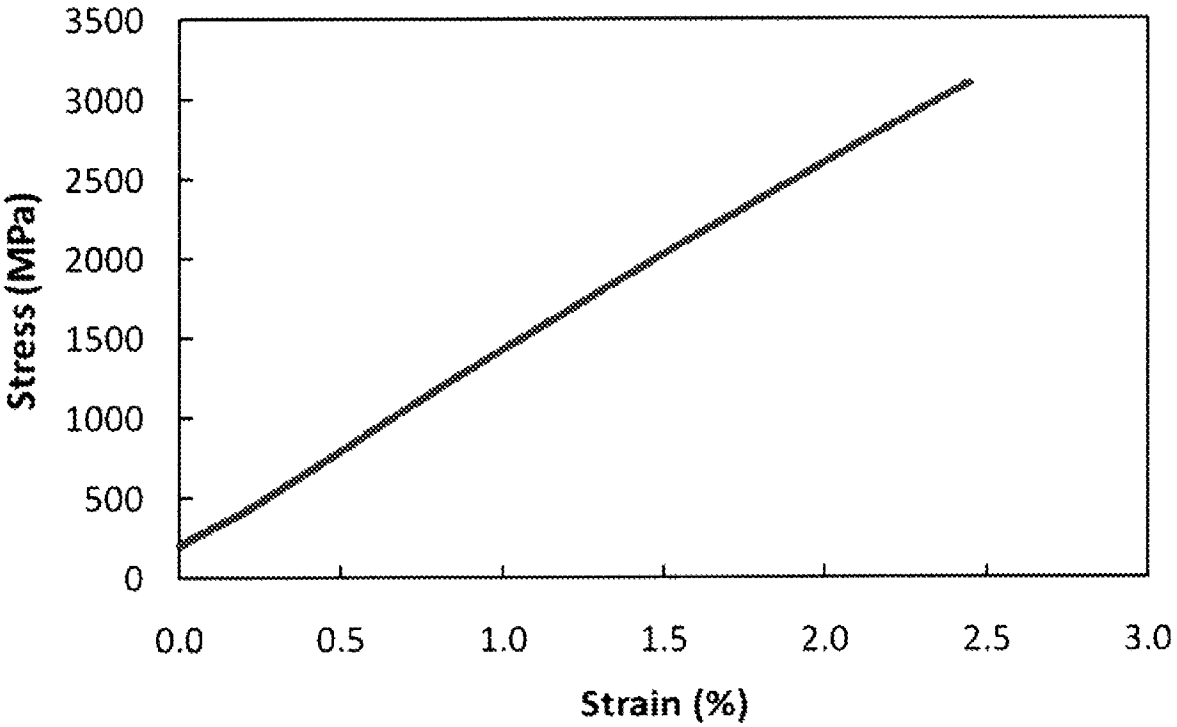
FIG. 22 illustrates a stress strain curve for the PC7E6HA alloy melt-spun at 16 m/s.

Using high purity elements, a fifteen gram charge of the PC7E6HA alloy was weighed out according to the atomic ratio's in Table 1. The mixture of elements was placed onto a copper hearth and arc-melted into an ingot using ultrahigh purity argon as a cover gas. After mixing, the resulting ingot was cast into a finger shape appropriate for melt-spinning. The cast fingers of PC7E6HA were then placed into a quartz crucible with a hole diameter nominally at 0.81 mm. The ingots were heated up by RF induction and then ejected onto a rapidly moving 245 mm copper wheel traveling at a wheel tangential velocities of 16 m/s. The ribbon was cut into pieces and then tested in tension. Testing conditions were completed with a gauge length of 23 mm, and at a strain rate of 10 N/s. The resulting tensile test stress/strain data is shown in FIG. 22.

Figure 23:
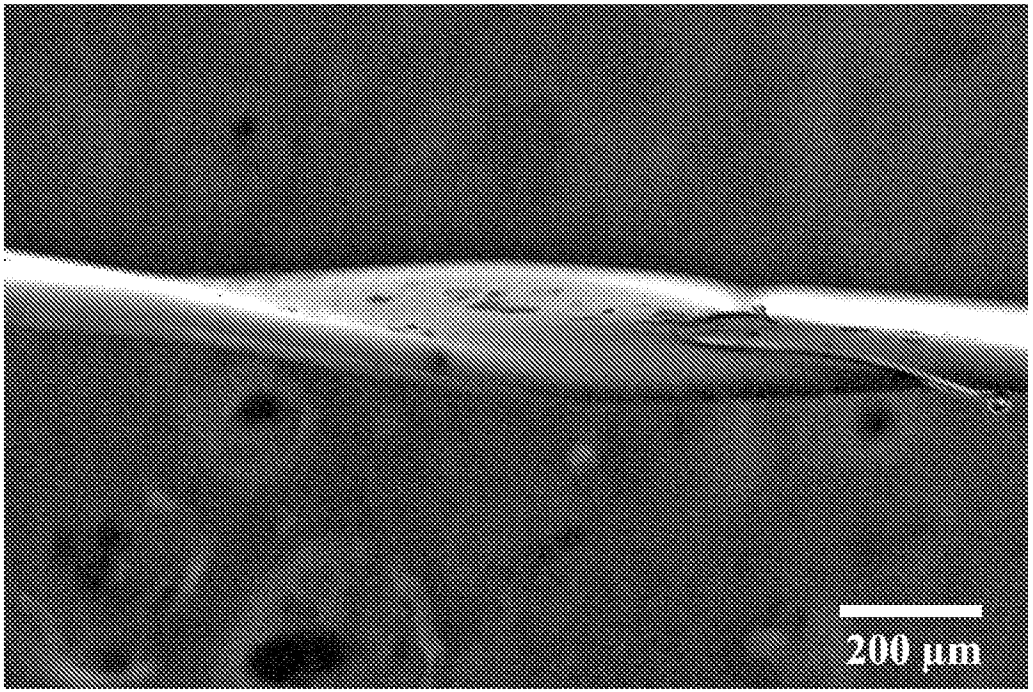
FIG. 23 illustrates a SEM secondary electron image of the PC7E6HA alloy melt-spun at 16 m/s and then tensile tested.

The Young's Modulus was found to be 112.8 GPA with a measured tensile strength of 3.17 GPa and a total elongation of 2.9%. Note that the initial tensile testing was performed with a relatively large gauge length (23 mm) which is approximately a factor of 10 longer than what it should be based on the sample cross sectional area. Additionally, the grips were not perfectly aligned in both the horizontal and vertical directions. Thus during tensile testing, misalignment and torsional strains were occurring which limited the maximum elongation and tensile strength. In FIG. 23, a SEM backscattered electron micrograph is shown of the PC7E6HA alloy melt-spun at 16 m/s after tensile testing. As shown, torsional strains are clearly evident but additionally necking can be observed in both the longitudinal and axial directions indicating significant inherent plasticity. Based on direct measurements of the reductions in cross sectional area, the localized strain is estimated to be ~30% in the axial direction and ~98% in the longitudinal direction.

Case Example #5

Figure 24:
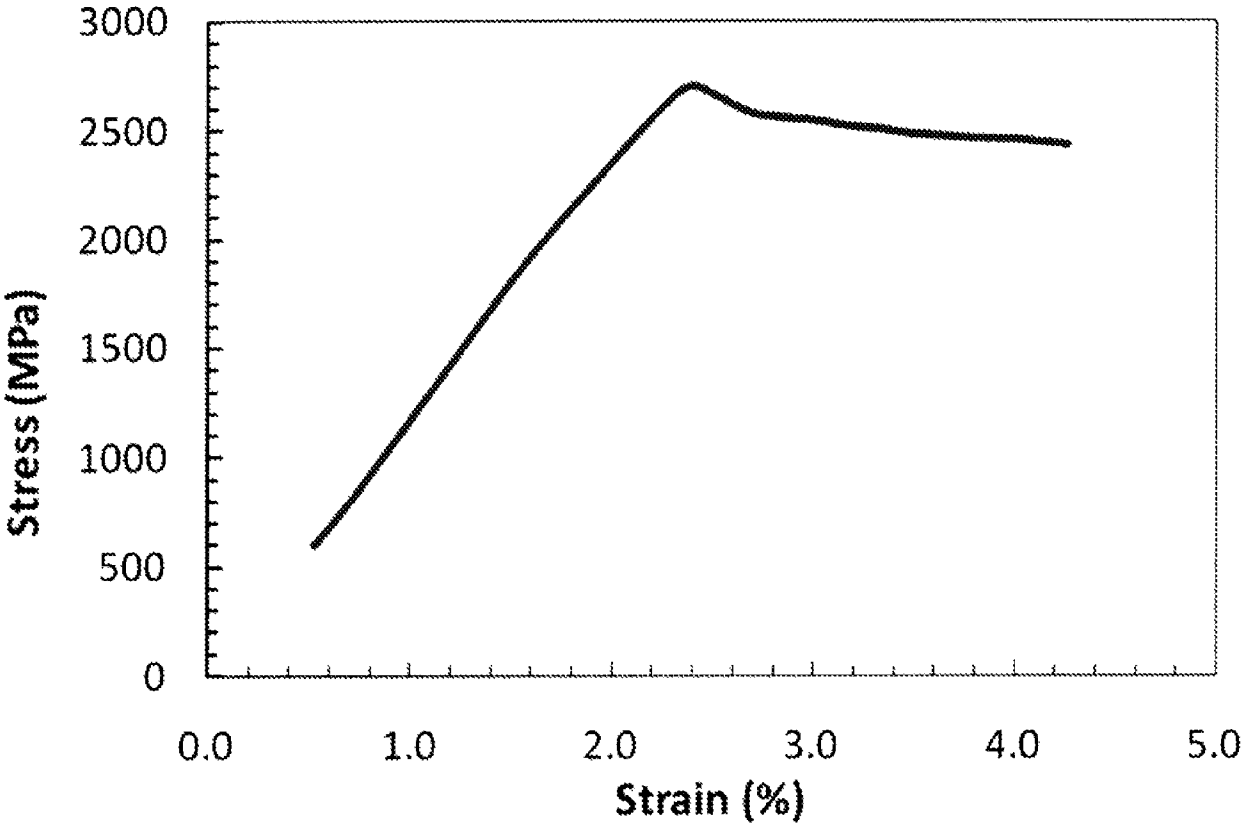
FIG. 24 illustrates a stress strain curve for the PC7E7 alloy melt-spun at 16 m/s.

Using high purity elements, a fifteen gram charge of the PC7E7 alloy was weighed out according to the atomic ratio's in Table 1. The mixture of elements was placed into a copper hearth and arc-melted into an ingot using ultrahigh purity argon as a cover gas. After mixing, the resulting ingot was cast into a finger shape appropriate for melt-spinning. The cast fingers of PC7E7 were then placed into a quartz crucible with a hole diameter nominally at 0.81 mm. The ingots were heated up by RF induction and then ejected onto a rapidly moving 245 mm copper wheel traveling at a wheel tangential velocities of 16 m/s. The ribbon was cut into pieces and then tested in tension. Testing conditions were done with a gauge length of 23 mm, and at a strain rate of 10 N/s. The resulting tensile test stress/strain data is shown in FIG. 24.

Figure 25:
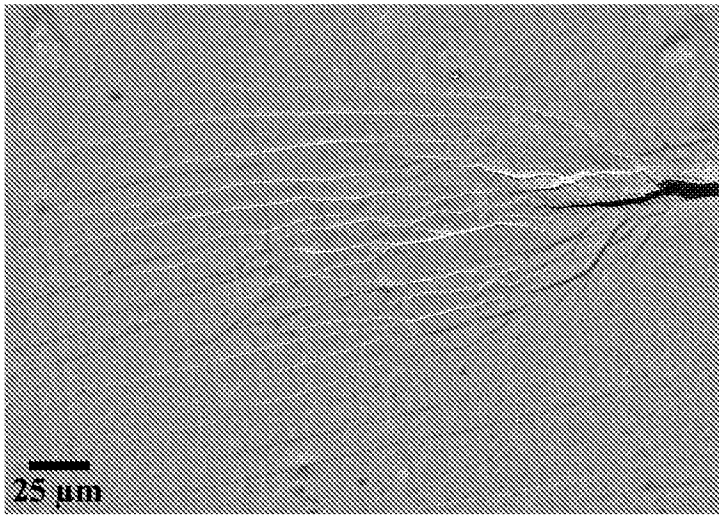
FIG. 25 illustrates a SEM secondary electron image of the PC7E7 alloy melt-spun at 16 m/s and then tensile tested. Note the presence of the crack on the right hand side of the picture (black) and the presence of multiple shear bands indicating a large plastic zone in front of the crack tip.

The Young's Modulus was found to be 108.6 GPA with a measured tensile strength of 2.70 GPa and a total elongation of 4.2%. Note that the initial tensile testing was done with an excessively large gauge length (23 mm) which is approximately a factor of 10 longer than what it should based on the sample cross sectional area. Additionally, the grips were not perfectly aligned in both the horizontal and vertical directions. Thus during tensile testing, misalignment and torsional strains were occurring which limited the maximum elongation and tensile strength. In FIG. 25, a SEM backscattered electron micrograph is shown of the PC7E7 alloy melt-spun at 16 m/s after tensile testing. Note the presence of the crack on the right hand side of the picture (black) and the presence of multiple shear bands indicating a large plastic zone in front of the crack tip. The ability to blunt the crack tip in tension is a remarkable new feature in a sample which is primarily metallic glass. Note that the shear bands themselves in the region in front of the crack tip are changing direction and in some cases splitting, which may indicate dynamic interactions between specific points in the microstructure and the moving shear bands.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. An iron based alloy composition, consisting essentially of:

iron present in the range of 45 to 70 atomic percent;
nickel present in the range of 10 to 30 atomic percent;
cobalt present in the range of 0 to 15 atomic percent;
boron present in the range of 7 to 25 atomic percent;
carbon present in the range of 0 to 6 atomic percent; and
silicon present in the range of 0 to 2 atomic percent
wherein said alloy exhibits an elastic strain of greater than 0.5% and a tensile strength of greater than 1 GPa and said alloy consists of metallic glass and crystalline phases wherein said crystalline phases are 1 nm to 500 nm.

2. The iron based alloy composition of claim 1, wherein said composition consists essentially of:

iron present in the range of 46 to 69 atomic percent;
nickel present in the range of 12 to 17 atomic percent;
cobalt present in the range of 2 to 15 atomic percent;
boron present in the range of 12 to 16 atomic percent;
carbon present in the range of 4 to 5 atomic percent; and
silicon present in the range of 0.4 to 0.5 atomic percent.

3. The iron based alloy composition of claim 1, wherein said composition exhibits a critical cooling rate of less than 100,000 K/s.

4. The iron based alloy composition of claim 1, wherein said composition includes amorphous fractions including structures that exhibit a mean grain size of less than 50 nm.

5. The iron based alloy composition of claim 1, wherein said composition includes nanocrystalline structures exhibiting a mean grain size of below 100 nm.

6. The iron based alloy composition of claim 1, wherein said composition includes microcrystalline structures exhibiting a mean grain size in the range of 100 nm to 500 nm.

7. The iron based alloy composition of claim 1, wherein said exhibits a glass to crystalline transition onset temperature in the range of 415° C. to 474° C. and a primary peak glass to crystalline transition temperature in the range of 425° C. to 479° C., measured by DSC at a rate of 10° C. per minute.

8. The iron based alloy composition of claim 1, wherein said composition exhibits melting temperatures in the range of 1060° C. to 1120° C., measured by DSC at a rate of 10° C. per minute.

9. The iron based alloy composition of claim 1, wherein said composition exhibits a density in the range of 7.70 grams per cubic centimeter to 7.89 grams per cubic centimeter.

10. The iron based alloy composition of claim 1, wherein said composition exhibits a Young's modulus in the range of 119 to 134 GPa.

11. The iron based alloy composition of claim 1, wherein said composition exhibits a failure modulus in the range of 1 GPa to 5 GPa.

12. The iron based alloy composition of claim 1, wherein said composition exhibits an elastic strain of 0.5% to 4.0%.

* * * * *